US012351349B2

(12) United States Patent
Neeser et al.

(10) Patent No.: US 12,351,349 B2
(45) Date of Patent: Jul. 8, 2025

(54) STRAPPING TOOL

(71) Applicant: Signode Industrial Group LLC, Tampa, FL (US)

(72) Inventors: Mirco Neeser, Ehrendingen (CH); Kurt Bolliger, Ehrendingen (CH); Andreas Keller, Birr (CH)

(73) Assignee: SIGNODE INDUSTRIAL GROUP LLC, Tampa, FL (US)

( * ) Notice: Subject to any disclaimer, the term of this patent is extended or adjusted under 35 U.S.C. 154(b) by 265 days.

(21) Appl. No.: 18/151,739

(22) Filed: Jan. 9, 2023

(65) Prior Publication Data

US 2023/0159198 A1 May 25, 2023
US 2024/0051693 A2 Feb. 15, 2024

Related U.S. Application Data

(63) Continuation of application No. 18/003,366, filed as application No. PCT/US2021/040834 on Jul. 8, 2021.

(60) Provisional application No. 63/196,391, filed on Jun. 3, 2021, provisional application No. 63/050,965, filed on Jul. 13, 2020.

(51) Int. Cl.

*B65B 13/22* (2006.01)
*B65B 13/02* (2006.01)
*B65B 13/30* (2006.01)

(52) U.S. Cl.

CPC ..... *B65B 13/22* (2013.01); *B65B 13/025* (2013.01); *B65B 13/305* (2013.01)

(58) Field of Classification Search

CPC ..... B65B 13/22; B65B 13/025; B65B 13/027; B65B 13/187; B65B 13/24; B65B 13/34; B65B 13/345; B65B 13/305

See application file for complete search history.

(56) References Cited

U.S. PATENT DOCUMENTS

| | | | |
|---|---|---|---|
| 1,891,239 | A | 12/1932 | Ekern |
| 1,984,652 | A | 12/1934 | Ekern |
| 2,007,002 | A | 7/1935 | Porter |
| 2,040,576 | A | 5/1936 | Erich |
| 2,076,276 | A | 4/1937 | Porter |
| 2,257,090 | A | 9/1941 | Childress |
| 2,336,264 | A | 12/1943 | Leslie, II |

(Continued)

FOREIGN PATENT DOCUMENTS

| | | | |
|---|---|---|---|
| BR | 112014014798 | A2 | 6/2017 |
| BR | 112014015409 | A2 | 6/2017 |

(Continued)

OTHER PUBLICATIONS

"Extended European Search Report", from corresponding European Patent Application No. 22216314.9, Jun. 16, 2023.

(Continued)

*Primary Examiner* — Jimmy T Nguyen

(74) *Attorney, Agent, or Firm* — Neal, Gerber & Eisenberg LLP

(57) ABSTRACT

Various embodiments of the present disclosure provide a strapping tool configured to tension metal strap around a load and, after tensioning, attach overlapping portions of the strap to one another by cutting notches into a seal element positioned around the overlapping portions of the strap and into the overlapping portions of the strap themselves.

15 Claims, 66 Drawing Sheets

(56) References Cited

U.S. PATENT DOCUMENTS 2,661,030 A 12/1953 Crosby et al.
2,801,558 A 8/1957 Crosby et al.
2,915,003 A 12/1959 Crosby et al.
2,936,156 A 5/1960 Coupland
2,941,782 A 6/1960 Winkler
2,986,376 A 5/1961 Falck-Pedersen
3,028,885 A 4/1962 Leslie et al.
3,032,075 A 5/1962 Hall et al.
3,103,955 A 9/1963 Ericsson et al.
3,150,694 A 9/1964 Meier
3,206,167 A 9/1965 Armington
3,211,186 A 10/1965 Harold
3,249,131 A 5/1966 Lingle
3,284,049 A 11/1966 Haraden
3,319,666 A 5/1967 Victor et al.
3,360,017 A 12/1967 Vilcins
3,396,760 A 8/1968 Peter et al.
3,442,733 A 5/1969 Vilcins
3,442,734 A 5/1969 Ericsson
3,506,041 A 4/1970 Angarola
3,583,315 A 6/1971 Hebert
3,586,572 A 6/1971 Ericsson
3,654,033 A 4/1972 Angarola et al.
3,718,526 A 2/1973 Annis
3,769,859 A 11/1973 Sykes et al.
3,792,808 A 2/1974 Neff et al.
3,810,495 A * 5/1974 Pack ..... E04C 5/166 29/818
3,844,317 A 10/1974 Angarola et al.
3,863,684 A 2/1975 Simmons
4,015,643 A 4/1977 Cheung
4,020,879 A 5/1977 Billett et al.
4,239,096 A 12/1980 Smilgys et al.
4,245,678 A 1/1981 Sansum
4,282,907 A 8/1981 Massion et al.
4,313,779 A 2/1982 Nix
4,356,845 A 11/1982 Kimbrough
4,450,032 A 5/1984 Wehr
4,488,926 A 12/1984 Rauch et al.
4,607,709 A 8/1986 Walser
4,718,522 A 1/1988 Frania et al.
5,078,185 A 1/1992 Angarola
5,632,851 A 5/1997 Young
5,653,095 A 8/1997 Stamm
5,689,943 A 11/1997 Wehr
5,881,855 A 3/1999 Putney et al.
5,916,108 A 6/1999 Drietz et al.
6,003,578 A 12/1999 Chang
6,109,325 A 8/2000 Chang
6,308,760 B1 10/2001 Finzo et al.
6,328,087 B1 12/2001 Finzo et al.
6,338,375 B1 1/2002 Harada
6,415,712 B1 7/2002 Helland et al.
6,422,272 B1 7/2002 Crittenden
6,578,337 B2 6/2003 Scholl et al.
6,895,733 B2 5/2005 Nix
6,918,235 B2 7/2005 Nix
7,073,431 B1 7/2006 Chen
7,089,970 B2 8/2006 Bernard
7,155,885 B1 1/2007 Nasiatka et al.
7,497,068 B2 3/2009 Nasiatka et al.
7,857,560 B2 12/2010 Leggett et al.
8,567,310 B2 10/2013 Yi
9,085,070 B2 7/2015 Skonieczy et al.
9,272,799 B2 3/2016 Figiel et al.
9,284,080 B2 3/2016 Neeser et al.
9,315,283 B2 4/2016 Neeser et al.
9,346,572 B2 5/2016 Leppert
9,403,609 B2 8/2016 Bonifazi et al.
9,468,968 B2 10/2016 Figiel et al.
9,630,265 B2 4/2017 Figiel et al.
9,630,730 B2 4/2017 Leppert
10,183,769 B2 1/2019 Figiel et al.
10,308,383 B2 6/2019 Boss et al.
10,322,831 B2 6/2019 Nasiatka et al.
10,577,137 B2 3/2020 Nasiatka et al.
10,745,158 B2 8/2020 Sikora et al.
10,882,649 B2 1/2021 Rauch
11,053,034 B1 7/2021 Sikora et al.
11,104,460 B2 8/2021 Neeser et al.
11,111,039 B2 9/2021 Yang
11,130,598 B2 9/2021 Sikora et al.
11,174,051 B2 11/2021 Graef et al.
11,267,596 B2 3/2022 Finzo et al.
2003/0230058 A1 12/2003 Nix
2005/0000586 A1 1/2005 Zeimetz et al.
2008/0219745 A1 9/2008 Bungert et al.
2011/0056390 A1 3/2011 Neeser et al.
2011/0056391 A1 3/2011 Neeser et al.
2011/0056392 A1 3/2011 Neeser et al.
2011/0100233 A1 5/2011 Neeser et al.
2012/0210682 A1 8/2012 Gardner et al.
2013/0085053 A1* 4/2013 Figiel ..... B65B 13/025 493/84
2014/0083311 A1 3/2014 Bonifazi et al.
2014/0290179 A1 10/2014 Keller
2015/0033959 A1 2/2015 Finzo
2015/0034206 A1 2/2015 Finzo
2015/0210411 A1 7/2015 Finzo et al.
2015/0246739 A1 9/2015 Finzo et al.
2015/0321777 A1 11/2015 Nasiatka et al.
2016/0107775 A1 4/2016 Amacker et al.
2016/0376041 A1 12/2016 Skonieczny, Jr. et al.
2017/0166335 A1 6/2017 Nasiatka et al.
2017/0174374 A1 6/2017 Figiel et al.
2018/0054033 A1 2/2018 Skonieczny et al.
2018/0127124 A1 5/2018 Sikora et al.
2019/0256233 A1 8/2019 Sikora et al.
2020/0339289 A1 10/2020 Finzo
2020/0339290 A1 10/2020 Finzo
2020/0377245 A1 12/2020 Sikora et al.
2021/0371143 A1 12/2021 Sikora et al.
2022/0144463 A1 5/2022 Finzo et al.

FOREIGN PATENT DOCUMENTS

CN 2346694 Y 11/1999
CN 1297270 A 5/2001
CN 1386675 A 12/2002
CN 1386676 A 12/2002
CN 1388040 A 1/2003
CN 201102638 Y 8/2008
CN 201411059 Y 2/2010
CN 101391661 B 6/2011
CN 102256875 A 11/2011
CN 105358432 A 2/2016
CN 110626539 A 12/2019
CN 110723340 A 1/2020
DE 929114 C 6/1955
DE 1185532 B 1/1965
DE 1973947 U 11/1967
DE 3525647 A1 1/1987
DE 29507452.3 U1 7/1995
DE 10026200 A1 11/2001
DE 102009016302 A1 10/2010
EP 0480627 A1 4/1992
EP 0664256 A1 7/1995
EP 0703146 A1 3/1996
EP 0999132 A1 5/2000
EP 1371560 A1 12/2003
EP 1413519 A1 4/2004
EP 1582463 A2 10/2005
EP 3272659 A1 1/2018
EP 3696102 A1 8/2020
EP 3696103 A1 8/2020
EP 3730415 A1 10/2020
GB 896398 A 5/1962
GB 2098163 A 11/1982
GB 2185229 A 7/1987
GB 2185228 B 12/1987
JP S36020086 Y 8/1961
JP 01006555 A 1/1989
JP 2004018117 A 1/2004
KR 100943256 B1 2/2010

(56) References Cited

FOREIGN PATENT DOCUMENTS

| | | | | |
|---|---|---|---|---|
| KR | 20160129060 A | * | 11/2016 | ..... B65B 13/30 |
| TW | M258045 U | | 3/2005 | |
| WO | 2009129634 A1 | | 10/2009 | |
| WO | 2009129636 A1 | | 10/2009 | |
| WO | 2019165142 A1 | | 8/2019 | |

OTHER PUBLICATIONS

"CB130 Operating Instructions—Hand Tool", Cyklop, available before the priority date of the present application.
"Cyklop CB130 Strapping Tool", available before the priority date of the present application and described in the internal "Service" document that to Applicant's knowledge was not publicly available before the priority date of the present application.
"Description of the Operating Sequence of the Cyklop CB 130 Tool", the Cyklop CB 130 Tool was publicly available before the priority date of the present application.
"International Search Report and Written Opinion", corresponding to PCT/US2021/040834, Jan. 14, 2022.
"Operating Instructions STR 64 Pneumatic Hand Tool For Steel Strapping", Orgapack GmbH, publicly available before the priority date of the present application.
"Operation Manual for Grippack 100/114 Sealers", Signode Industrial Group LLC, available before the priority date of the present application.
"Operation Manual for SLB Sealless Strapping Tool", Signode Industrial Group LLC, available before the priority date of the present application.
"Operation, Parts and Safety Manual PNSC-2 Pneumatic Combination Strapping Tool", Signode, publicly available before the priority date of the present application.
"Operation, Parts and Safety Manual RCNS2-34 RCNS2-114 Pistol-Grip Style Air Powered Sealers", Signode Engineered Products, publicly available before the priority date of the present application.
"OR-T 100 Operating and Safety Instructions", Orgapack, Battery-hand tool for plastic strapping, Nov. 2004.
"OR-T 120 Operating Instructions", Orgapack, Battery-operated hand tool for plastic strapping, Sep. 2012.
"OR-T 130, OR-T 260, OR-T 450 Operating Instructions", Orgapack, Battery-operated hand tool for plastic strapping, Mar. 2017.
"OR-T 200 Manual Battery-hand Tool for Plastic Strapping", Orgapack, available before the priority date of the present application.
"OR-T 250 Manual Battery-operated Hand Tool for Plastic Strapping", Orgapack, available before the priority date of the present application.
"OR-T 300 Operating and Safety Instructions", Orgapack, Battery-hand tool for plastic strapping, Mar. 2005.
"OR-T 400 Operating Instructions", Orgapack, Battery-hand tool for plastic strapping, Sep. 2009.
"OR-T 50 Operating and Safety Instructions", Orgapack, Hand tool for plastic strapping, May 2006.
"ORT 83 Operating Instructions", Orgapack, Hand tool for plastic strapping, Aug. 2000.
"OR-T 85 Operating Instructions", Orgapack, Hand tool for plastic strapping, Jun. 2000.
"OR-T 86 Operating Instructions", Orgapack, Hand tool for plastic strapping, Aug. 1999.
"OR-T 87 Operating and Safety Instructions", Orgapack, Hand tool for plastic strapping, May 2002.
"Service Manual Battery-Powered Plastic Strapping Tool Model P329", Fromm, available before the priority date of the present application.
"CB 130 Hand Tool for PP/PET Strapping Service For Internal Use Only", Cyklop GmbH, Aug. 2002 (indicated at p. 2), 39 pages.
"CB 130 Operating Manual Hand tool for PP/PET—strapping", Cyklop GmbH, Mar. 7, 2002 (indicated at p. 2), 22 pages.
"Friction Weld—Battery Powered—CB 130", Polyester / Polypropylene Friction Weld Single-Handed Operation, Cyklop International, the CB-130 tool was publicly available before the priority date of the present application.
"Fromm Operation Manual / Spare Parts List", Battery—Powered Plastic Strapping Tool Model P331 M/HA, Fromm System GmbH, Mar. 6, 2014 (indicated at p. 1), 26 pages.
"Fromm Operation Manual/Spare Parts List", Battery - Powered Plastic Strapping Tool Model P328 M/Ha, Fromm System GmbH, Mar. 6, 2014 (indicated at p. 1), 26 pages.
"Hand Tool CB 130 Operating Instructions", Cyklop GmbH, Mar. 7, 2002 (indicated at p. 2), 26 pages.
"SIAT GT One User's Manual", M. J. Maillis Group, SIAT S.p.a, May 15, 2012 (indicated at p. 99); 102 pages.
"Office Action and Examination Search Report", from corresponding Japanese patent application No. JP2023-500372, Nov. 29, 2024.

* cited by examiner

STRAPPING TOOL

PRIORITY

This application is a continuation application of U.S. patent application Ser. No. 18/003,366, having a 371(c) filing date of Dec. 27, 2022 and which is a national phase application of PCT/US2021/040834, filed on Jul. 8, 2021, which claims priority to and the benefit of U.S. Provisional Patent Application No. 63/050,965, filed Jul. 13, 2020, and U.S. Provisional Patent Application No. 63/196,391, filed Jun. 3, 2021, the entire contents of both of which are incorporated herein by reference.

FIELD

The present disclosure relates to strapping tools, and more particularly to strapping tools configured to tension strap around a load and to attach overlapping portions of the strap to one another to form a tensioned strap loop around the load.

BACKGROUND

Battery-powered strapping tools are configured to tension strap around a load and to attach overlapping portions of the strap to one another to form a tensioned strap loop around the load. To use one of these strapping tools to form a tensioned strap loop around a load, an operator pulls strap leading end first from a strap supply, wraps the strap around the load, and positions the leading end of the strap below another portion of the strap. The operator then introduces one or more (depending on the type of strapping tool) of these overlapped strap portions into the strapping tool and actuates one or more buttons to initiate: (1) a tensioning cycle during which a tensioning assembly tensions the strap around the load; and (2) after completion of the tensioning cycle, a sealing cycle during which a sealing assembly attaches the overlapped strap portions to one another (thereby forming a tensioned strap loop around the load) and during which a cutting assembly cuts the strap from the strap supply.

How the strapping tool attaches overlapping portions of the strap to one another during the sealing cycle depends on the type of strapping tool and the type of strap. Certain strapping tools configured for plastic strap (such as polypropylene strap or polyester strap) include friction welders, heated blades, or ultrasonic welders configured to attach the overlapping portions of the strap to one another. Some strapping tools configured for plastic strap or metal strap (such as steel strap) include jaws that mechanically deform (referred to as "crimping" in the strapping industry) or cut notches into (referred to as "notching" in the strapping industry) a seal element positioned around the overlapping portions of the strap to attach them to one another. Other strapping tools configured for metal strap include punches and dies configured to form a set of mechanically interlocking cuts in the overlapping portions of the strap to attach them to one another (referred to in the strapping industry as a "sealless" attachment).

SUMMARY

Various embodiments of the present disclosure provide a strapping tool configured to tension metal strap around a load and, after tensioning, attach overlapping portions of the strap to one another by cutting notches into a seal element positioned around the overlapping portions of the strap and into the overlapping portions of the strap themselves.

DETAILED DESCRIPTION

Figure 1A:
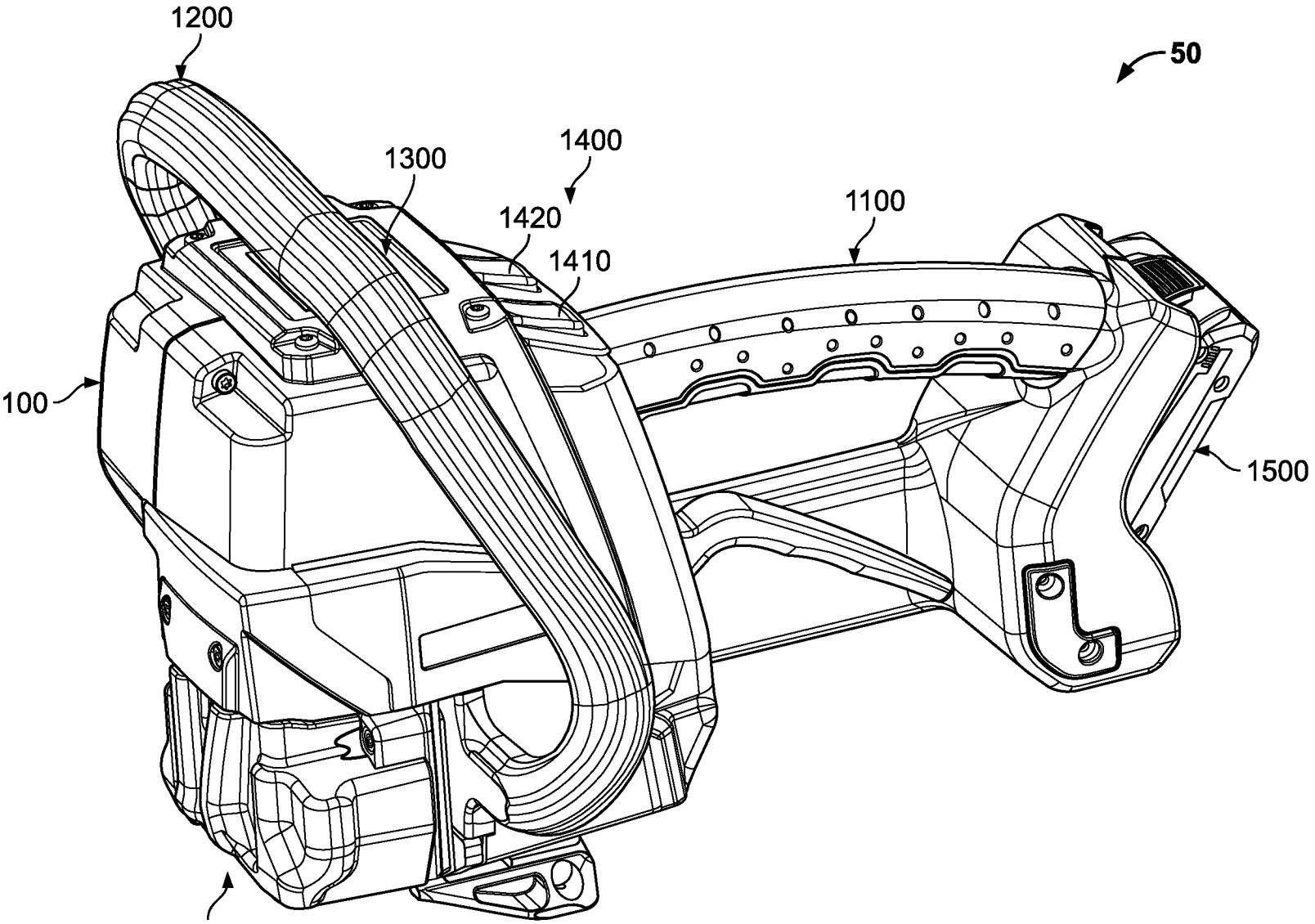
FIG. 1A is a perspective views of one example embodiment of a strapping tool of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Figure 1B:
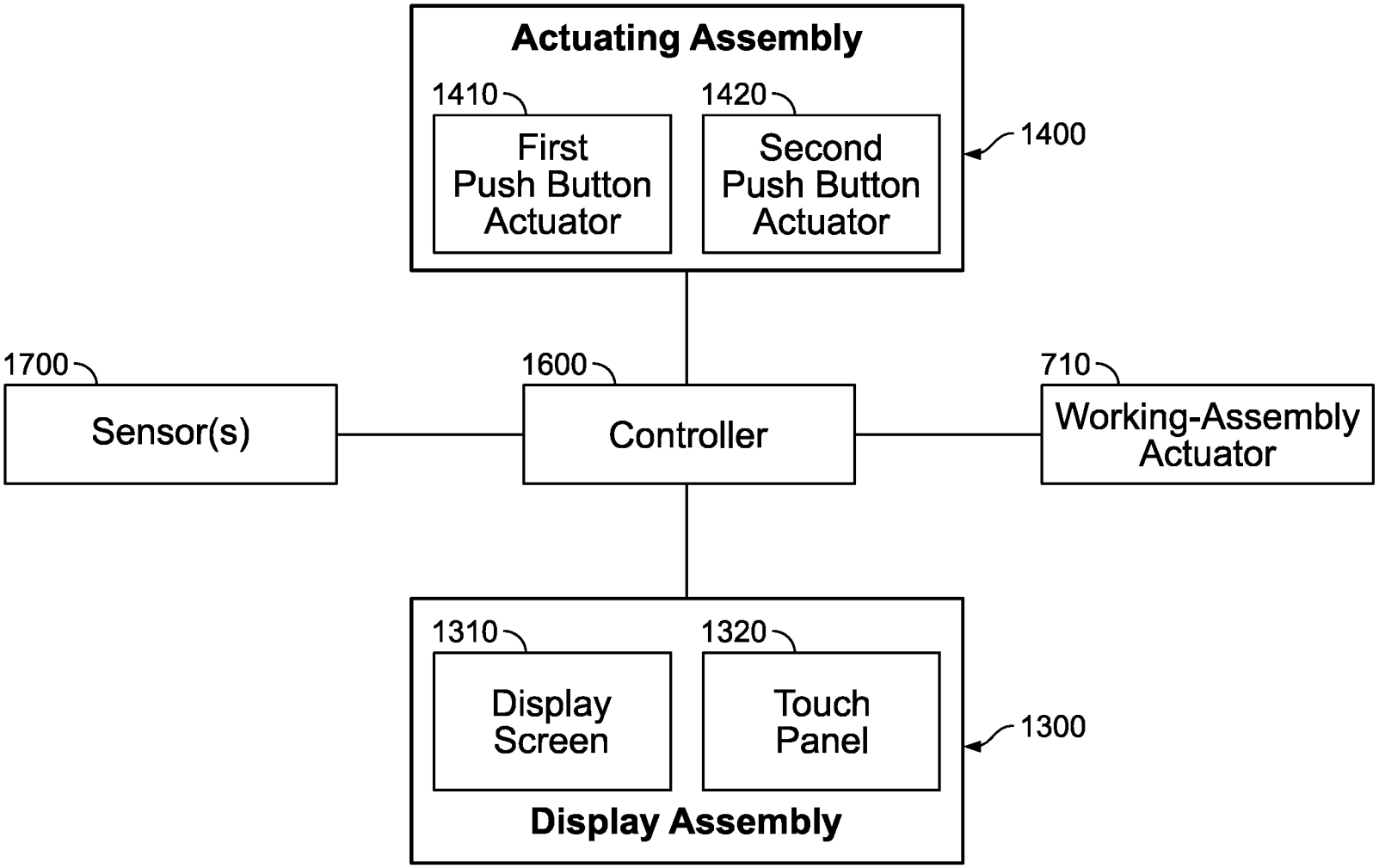
FIG. 1B is a block diagram of certain components of the strapping tool of FIG. 1A.

FIGS. 1A and 1B show one example embodiment of the strapping tool 50 of the present disclosure (sometimes referred to as the "tool" in the Detailed Description for brevity) and certain assemblies and components thereof. The strapping tool 50 is configured to carry out a strapping cycle including: (1) a tensioning cycle during which the strapping tool tensions strap (metal strap in this example embodiment) around a load; and (2) a sealing cycle during which the strapping tool, after tensioning the strap, attaches overlapping portions of the strap to one another by cutting notches into a seal element positioned around the overlapping portions of the strap and into the overlapping portions of the strap themselves (referred to as "notching" in the strapping industry and in this Detailed Description) and cuts the strap from the strap supply.

The strapping tool 50 includes a housing 100, a working assembly 200, first and second handles 1100 and 1200, a display assembly 1300, an actuating assembly 1400, a power supply 1500, a controller 1600 (FIG. 1B), one or more sensors 1700 (FIG. 1B), a retaining assembly 1800 (FIGS. 8A-9B), and a retainer-activation assembly 3850 (FIGS. 10-14).

The housing 100, which is best shown in FIG. 1A, is formed from multiple components (not individually labeled) that collectively at least partially enclose and/or support some (or all) of the other assemblies and components of the strapping tool 50. The housing also supports the retaining assembly 1800 and the retainer-activation assembly 3850, as explained below with reference to FIGS. 8A-14. In this example embodiment, the housing 100 includes a front housing section that at least partially encloses and/or supports at least some of the components of the working assembly 200, the display assembly 1300, and the actuating assembly 1400; a rear housing section that at least partially encloses and/or supports the power supply 1500 and the controller 1600; and a connector housing section that extends between and connects the bottoms of the front and rear housing sections. The first handle 1100 extends between the tops of the front and rear housing sections, and in some embodiments is integrally formed with the housing sections. This is merely one example, and in other embodiments the components of the strapping tool may be supported and/or enclosed by any suitable portion of the housing 100. The housing 100 may be formed from any suitable quantity of components joined together in any suitable manner. In this example embodiment, the housing 100 is formed from plastic, though it may be made from any other suitable material in other embodiments.

The working assembly 200 includes the majority of the components of the strapping tool 50 that are configured to carry out the strapping cycle to tension the strap around the load, attach the overlapping portions of the strap to one another, and cut the strap from the strap supply. Specifically, the working assembly 200 includes a support 300, a tensioning assembly 400, a sealing assembly 500, a drive assembly 700, a rocker-lever assembly 900, a gate assembly 1000, and a decoupling assembly 1900.

Figure 2:
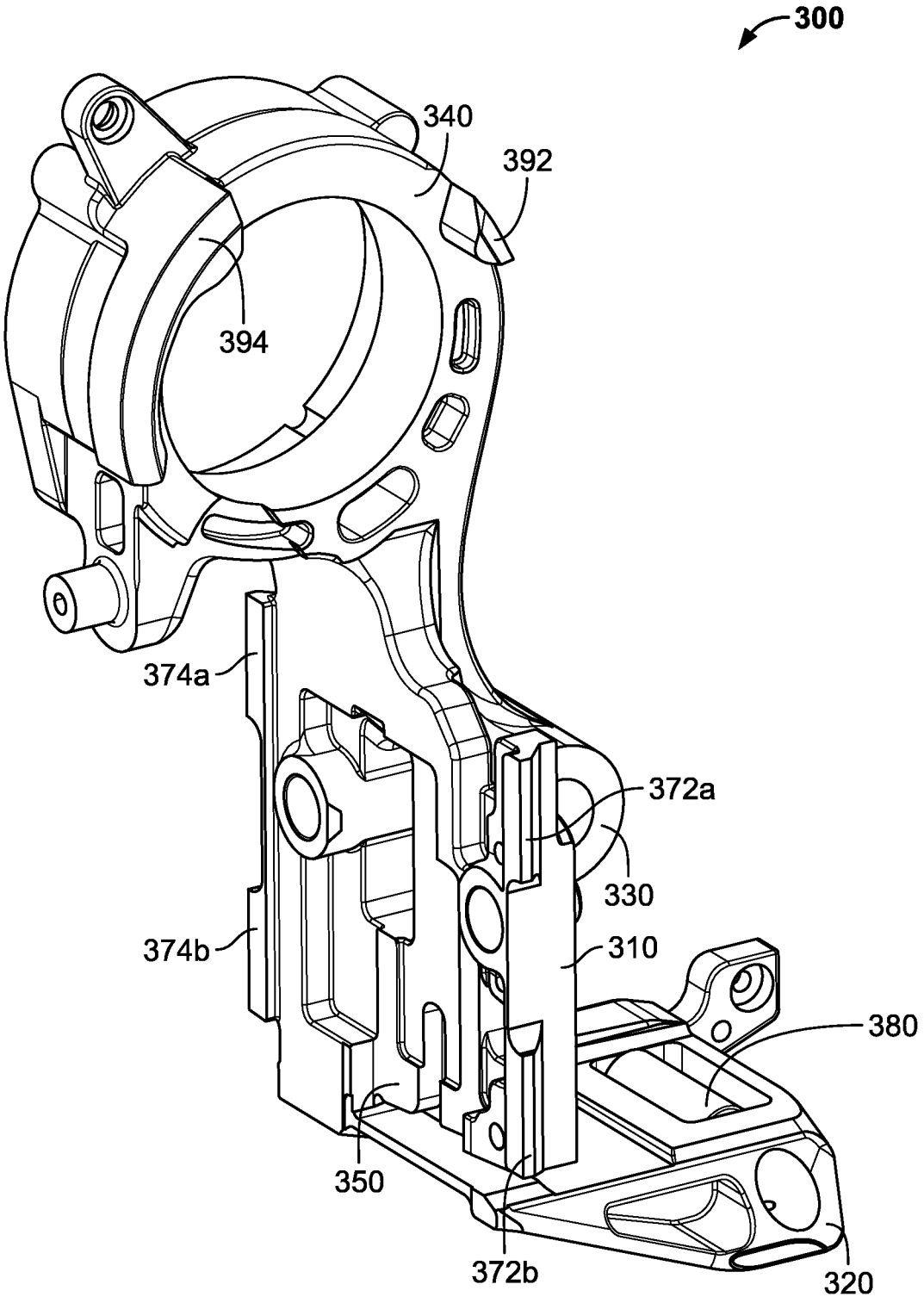
FIG. 2 is a perspective view of the support of the working assembly of the strapping tool of FIG. 1A.

The support 300, which is best shown in FIG. 2, serves as a direct or indirect common mount for the tensioning assembly 400, the sealing assembly 500, the drive assembly 700, the rocker-lever assembly 900, the gate assembly 1000, and the decoupling assembly 1900. The support 300 also includes components configured to help change the effective length of a linkage 820 of the conversion assembly 800 of the drive assembly 700 during the sealing cycle, as explained below with respect to FIGS. 24A-26H.

The support 300 includes a body 310, a foot 320 extending transversely from a bottom of the body 310, a tensioning-assembly-mounting element 330 extending rearward from the body 310, and a drive-and-conversion-assembly-mounting element 340 extending upwardly from the body 310. A front side of the body 310 defines a gate-receiving recess 350 sized, shaped, oriented, and otherwise configured to receive a gate 1010 of the gate assembly 1000 and to enable the gate 1010 to move between a lower home position and an upper strap-insertion position (described below with respect to FIGS. 8A-9B). The body 310 includes aligned first and second sealing-assembly-mounting tongues 372*a* and 372*b* on one side of the gate-receiving recess 350 and aligned third and fourth sealing-assembly-mounting tongues 374*a* and 374*b* on the other side of the gate-receiving recess 350. Circumferentially spaced first and second linkage engagers 392 and 394 project from the drive-and-conversion-assembly-mounting element 340. A roller 380 is coupled to and freely rotatable relative to the foot 320.

The tensioning assembly 400, which is best shown in FIGS. 4A-4D, is configured to tension the strap around the load during the tensioning cycle. The tensioning assembly 400 includes a tensioning-assembly support 410, tensioning-assembly gearing 420, a tension wheel 440 driven by the tensioning-assembly gearing 420, and covers (not labeled) mounted to the tensioning-assembly support 410 to partially or completely enclose certain components of the tensioning-assembly gearing 420 and the tension wheel 440.

The tensioning-assembly gearing 420 includes: a driven gear 421; a first sun gear 422; first planet gears 423*a*, 423*b*, and 423*c*; a carrier 424; a first ring gear 425; a spacer 426; a second ring gear 427; a tension-wheel mount 428; and second planet gears 429*a*, 429*b*, and 429*c*. The components of the tensioning-assembly gearing 420 are centered on—and certain of them are rotatable about—a tension-wheel rotational axis 440*a*. The carrier 424 includes a first planet-gear carrier 424*a* to which the first planet gears 423*a*-423*c* are rotatably mounted (such as via respective bearings and mounting pins) and a second sun gear 424*b* rotatable with (and here integrally formed with) the planet-gear carrier 424*a* about the tension-wheel rotational axis 440*a*. The first ring gear 425 includes internal teeth 425*it* and external teeth 425*ot*. The second ring gear 427 includes internal teeth 427*it*. The tension-wheel mount 428 includes a second planet-gear carrier 428*a* and a tension-wheel shaft 428*b* rotatable with (and here integrally formed with) the second planet-gear carrier 428*a* about the tension-wheel rotational axis 440*a*. The second planet gears 429*a*-429*c* are rotatably mounted to the second planet-gear carrier 428*a* (such as via respective bearings and mounting pins).

The first sun gear 422 is fixedly mounted to the driven gear 421 (such as via a splined connection) such that the driven gear and the first sun gear rotate together about the tension-wheel rotational axis 440*a*. The first sun gear 422 meshes with and drivingly engages the first planet gears 423*a*-423*c*. The first planet gears mesh with the internal teeth 425*it* of the first ring gear 425. The second planet gears mesh with the internal teeth 427*it* of the second ring gear 427. The spacer 426 separates the first and second ring gears 425 and 427. The second sun gear 424*b* extends through the spacer 426 and meshes with and drivingly engages the second planet gears 429*a*-429*c*. The tension wheel 440 is fixedly mounted to the tension-wheel shaft 428*b* (such as via a splined connection) such that the tension-wheel shaft and the tension wheel rotate together about the tension-wheel rotational axis 440*a*.

The tensioning-assembly gearing 420 is mounted to the tensioning-assembly support 410. The second ring gear 427 is fixed in rotation about the tension-wheel rotational axis 440*a* relative to the tensioning-assembly support 410 (that is, the second ring gear 427 is not rotatable about the tension-wheel rotational axis 440*a* relative to the tensioning-assembly support 410). In this example embodiment, pins (which are shown but not labeled) are positioned between the outer surface of the second ring gear 427 and the tensioning-assembly support 410 to prevent relative rotation, though any suitable components (such as set screws, glue, or high-friction components or fasteners) may be used to do so. The decoupling assembly 1900 (except when actuated, as described below) fixes the first ring gear 425 in rotation about the tension-wheel rotational axis 440*a* relative to the tensioning-assembly support 410 (so the first ring gear cannot rotate about the tension-wheel rotational axis 440*a* relative to the tensioning-assembly support 410).

During the tensioning cycle, the drive assembly 700 drives the driven gear 421, as described below. The driven gear 421 begins rotating itself and the first sun gear 422 about the tension-wheel rotational axis 440*a* in a tensioning rotational direction (clockwise from the perspective of FIG. 4B in this example embodiment). The first sun gear 422 drives the first set of planet gears 423*a*-423*c*. Since the decoupling assembly 1900 prevents the first ring gear 425 from rotating about the tension-wheel rotational axis 440*a*, rotation of the planet gears 423*a*-423*c* causes the carrier 424—including the second sun gear 424*b*—to rotate about the tension-wheel rotational axis 440*a* in the tensioning rotational direction. the second sun gear 424*b* drives the second set of planet gears 429*a*-429*c*. Since the second ring gear 427 cannot rotate about the tension-wheel rotational axis 440*a*, rotation of the planet gears 429*a*-429*c* causes the tension-wheel mount 428 and the tension wheel 440 mounted thereto to rotate about the tension-wheel rotational axis 440*a* in the tensioning rotational direction. Accordingly, the tensioning-assembly gearing 420 operatively connects the drive assembly 700 to the tension wheel 440 to rotate the tension wheel 440 about the tension-wheel rotational axis 440*a* in the tensioning rotational direction.

Figure 7A:
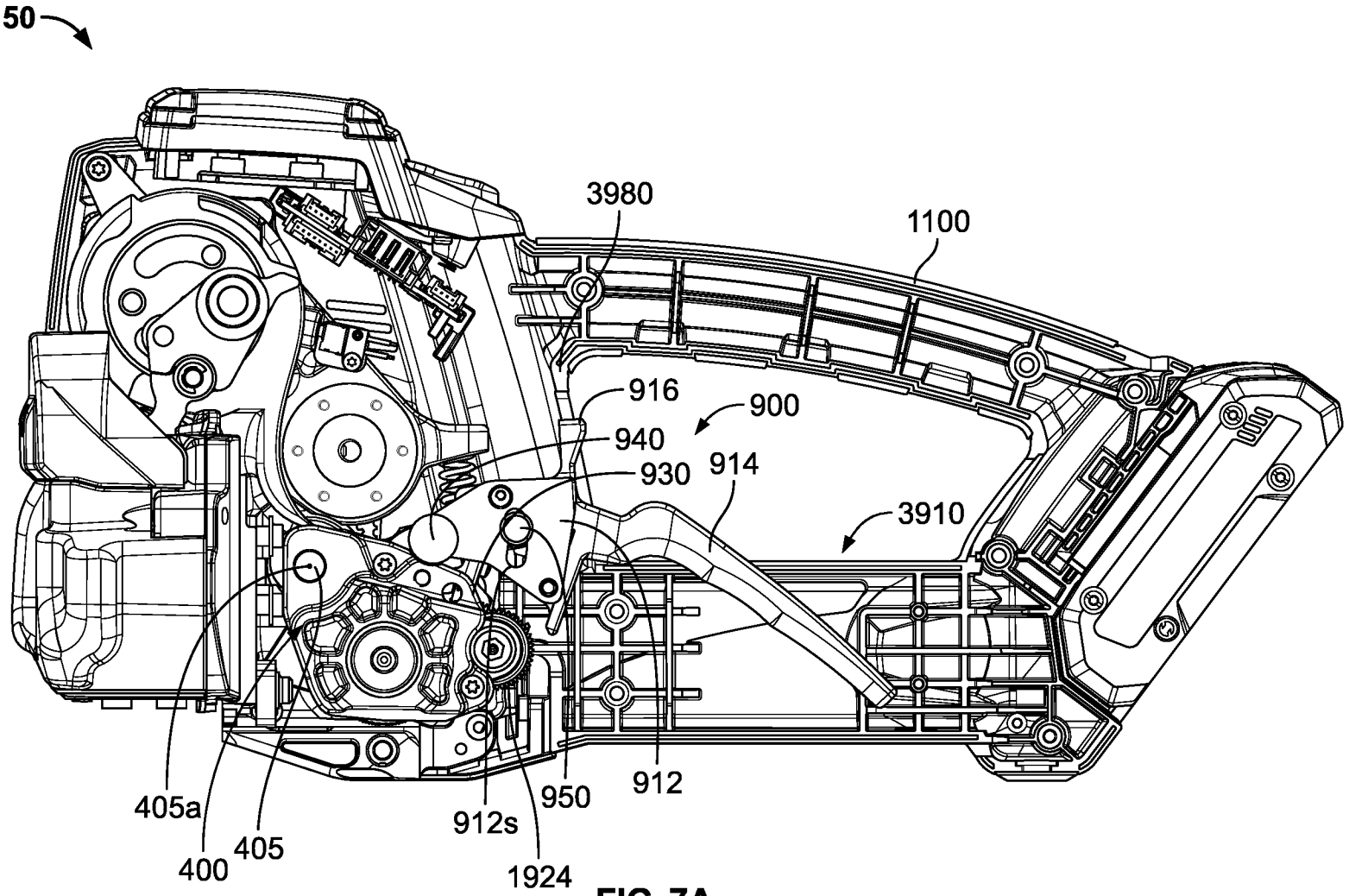
FIGS. 7A-7D are cross-sectional side views of the strapping tool of FIG. 1A showing the rocker-lever assembly and the tensioning assembly in different positions.
Figure 7B:
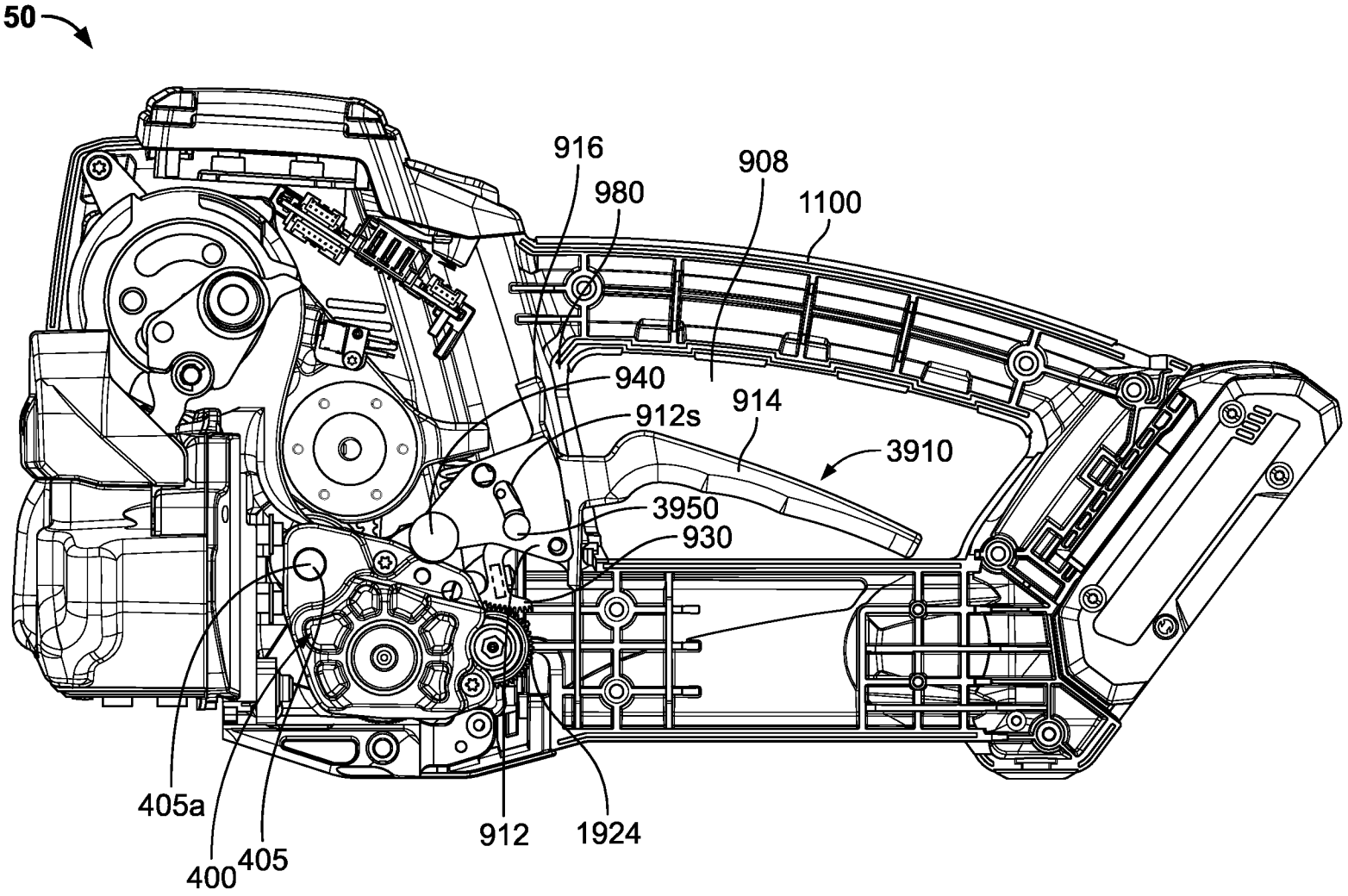
Figure 7C:
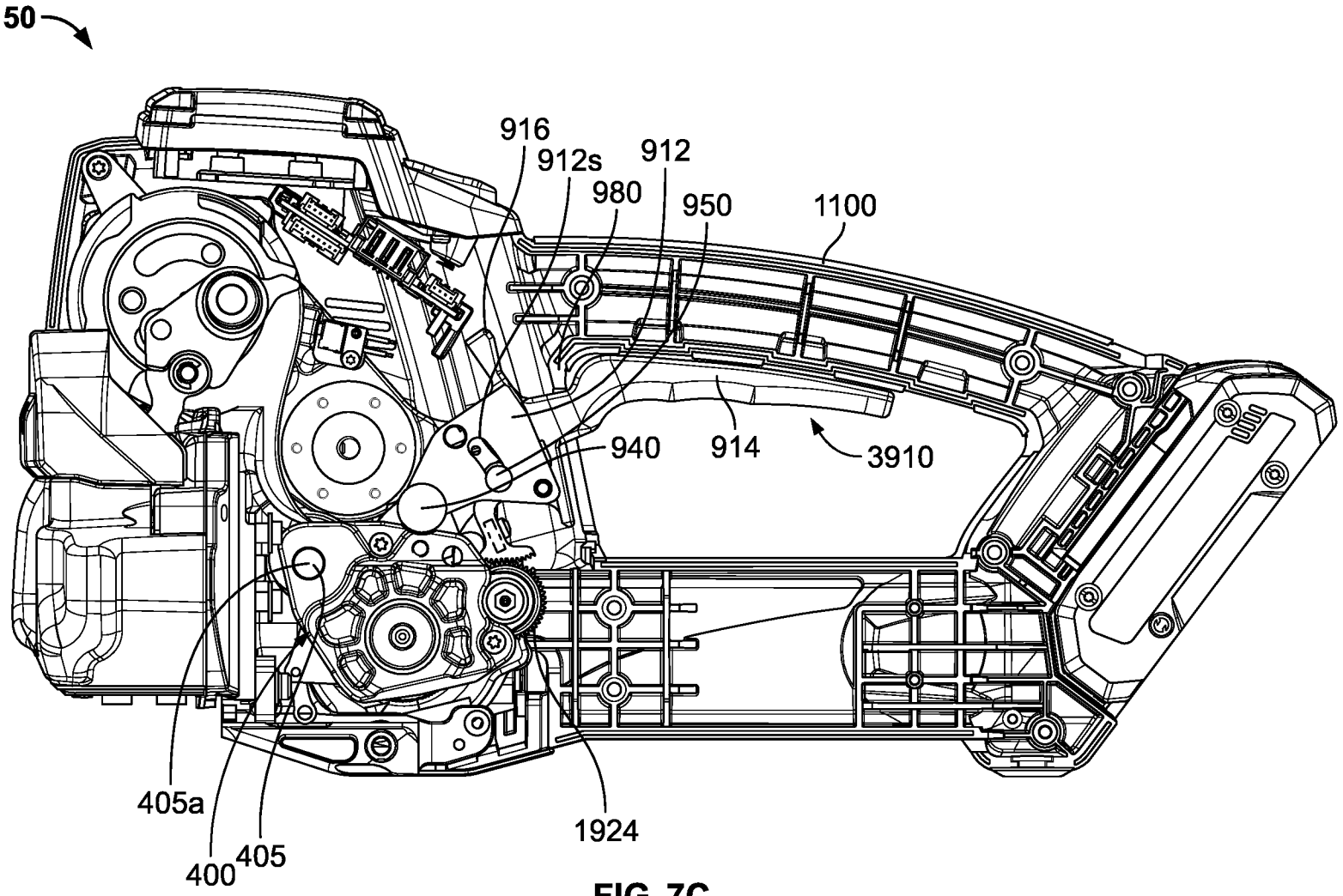
Figure 8A:
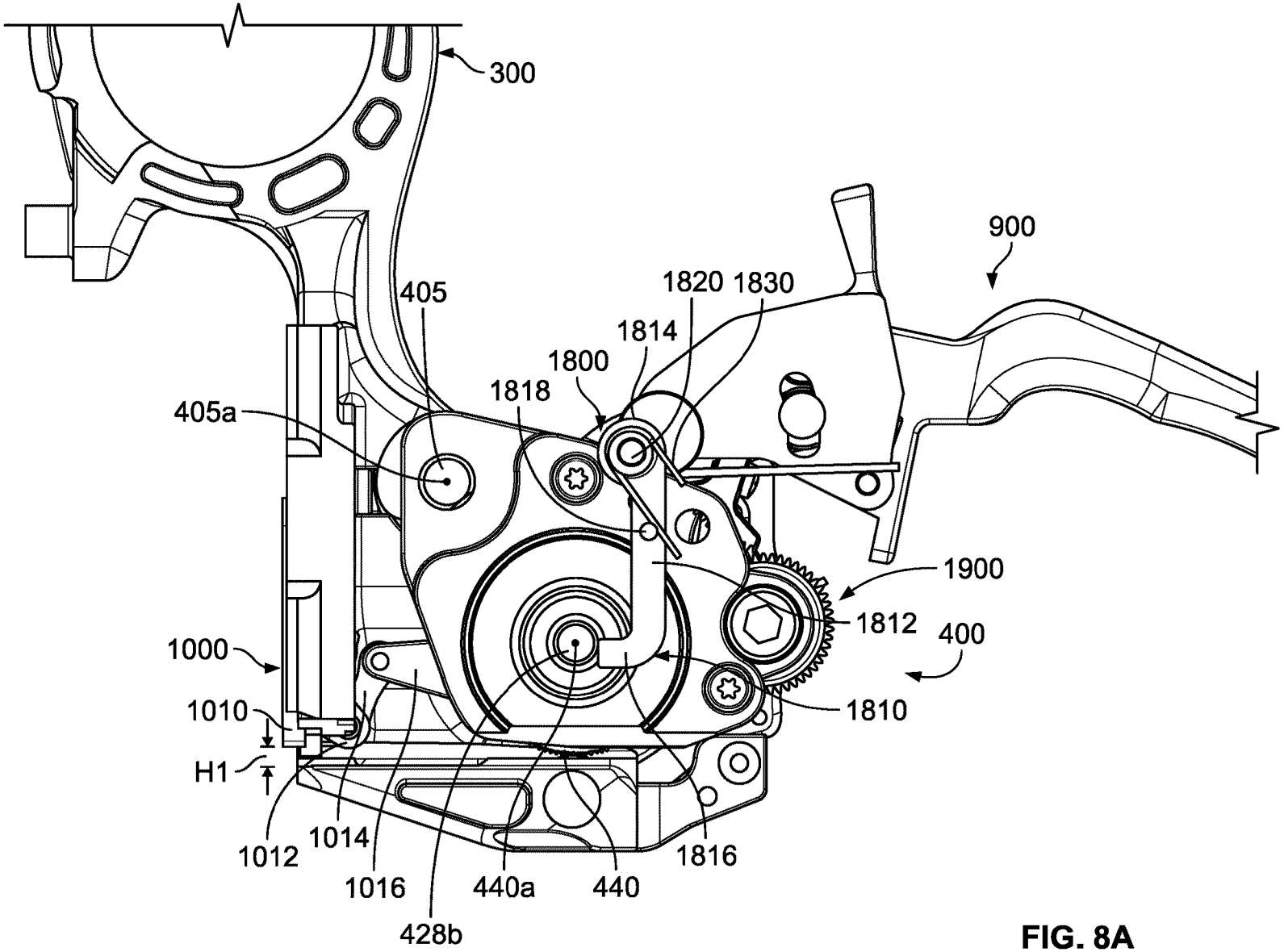
FIGS. 8A and 8B are elevational and perspective views, respectively, of part of the tensioning assembly and the gate assembly of the working assembly of FIG. 3A and of the retaining assembly of the strapping tool of FIG. 1A. The tensioning assembly and the gate of the gate assembly are in their respective strap-tensioning and home positions, and the retainer of the retaining assembly is in its release position.
Figure 8B:
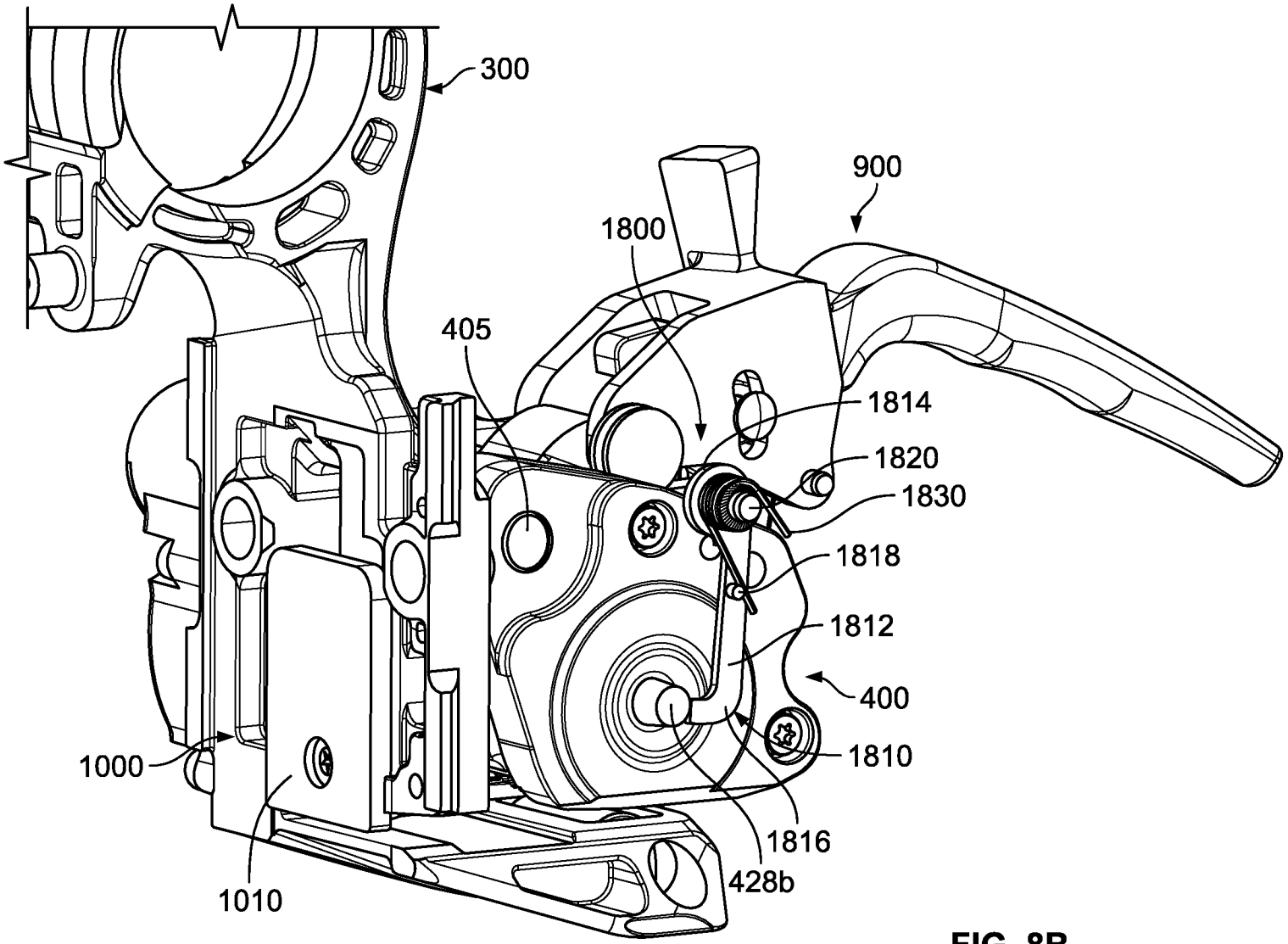
Figure 9A:
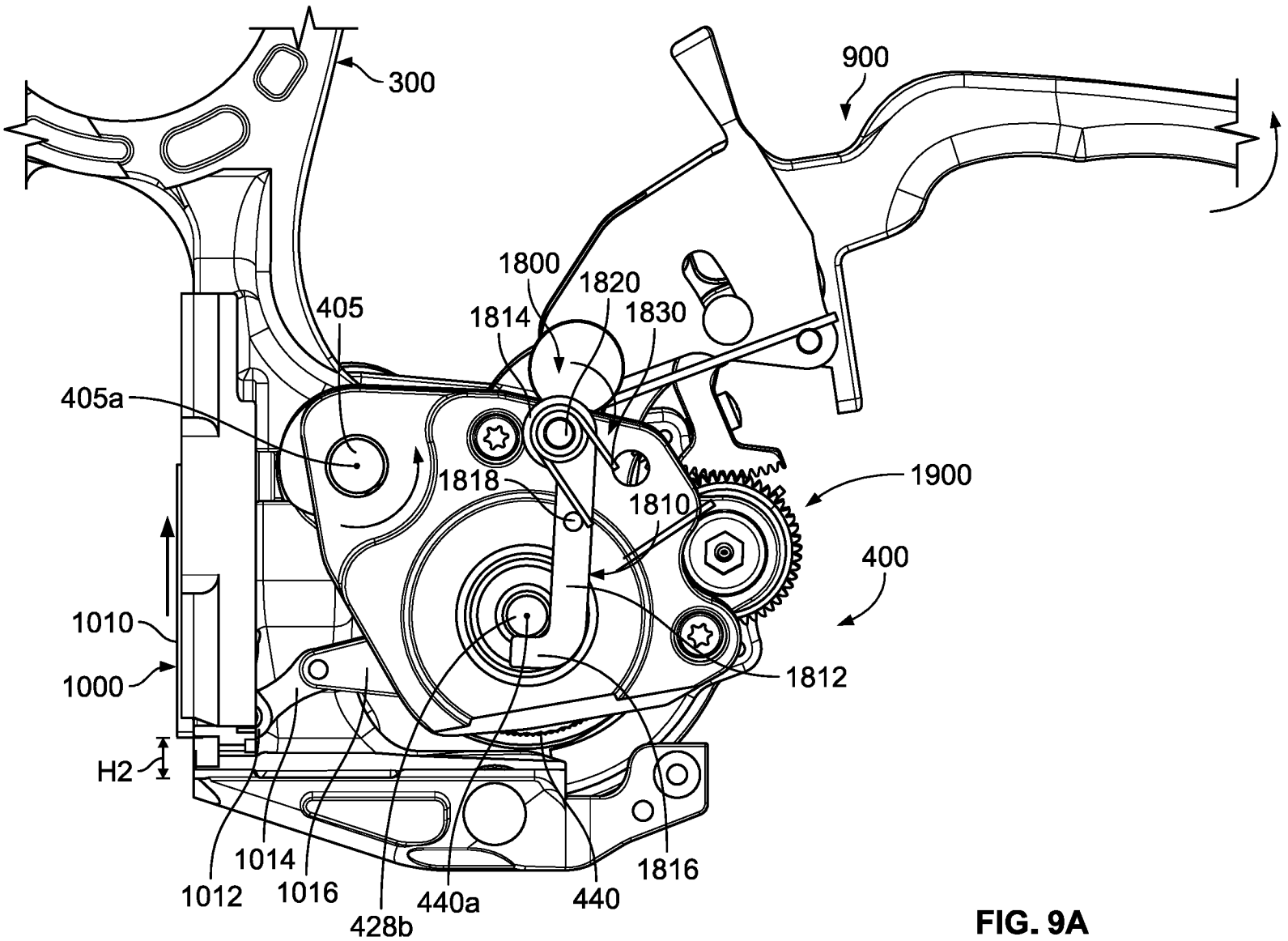
FIGS. 9A and 9B are elevational and perspective views, respectively, of the part of the tensioning assembly and the gate assembly shown in FIGS. 8A and 8B and of the retaining assembly shown in FIGS. 8A and 8B. The tensioning assembly and the gate of the gate assembly are in their respective strap-insertion positions, and the retaining assembly is in its retaining position.
Figure 9B:
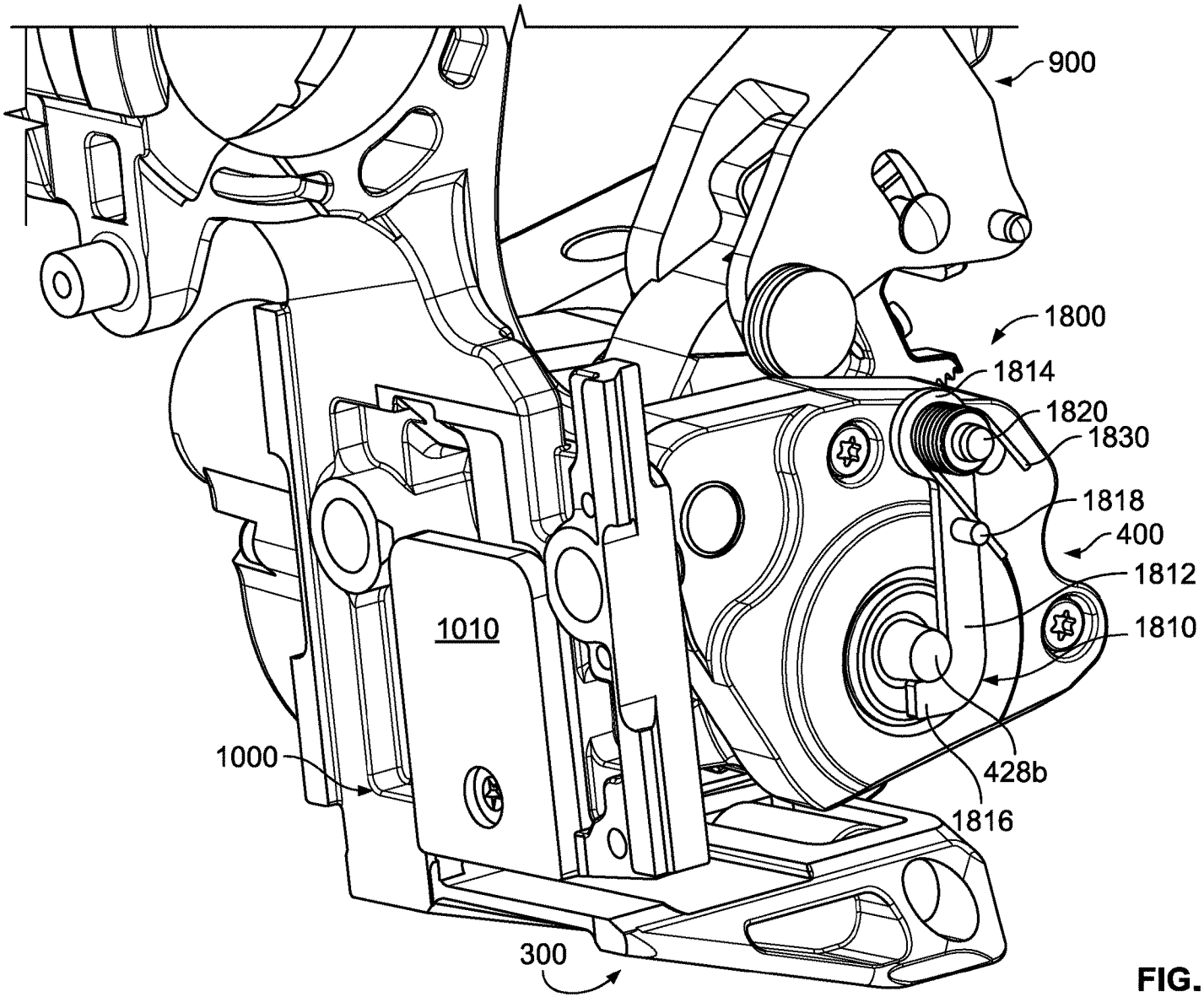

The tensioning assembly 400 is movably mounted to the tensioning-assembly-mounting element 330 of the support 300 and configured to pivot relative to the support 300—and particularly relative to the foot 320 of the support 300—under control of the rocker-lever assembly 900 (as described below) and about a tensioning-assembly-pivot axis 405*a* of a tensioning-assembly-pivot shaft 405 between a strap-tensioning position (FIGS. 7A, 8A, and 8B) and a strap-insertion position (FIGS. 7C, 9A, and 9B). When the tensioning assembly 400 is in the strap-tensioning position, the tension wheel 440 is adjacent to (and in this embodiment contacts) the roller 380 of the support 300 (or the upper surface of the strap if the strap has been inserted into the strapping tool 50). When the tensioning assembly 400 is in the strap-insertion position, the tension wheel 440 is spaced-apart from the roller 380 to enable the top portion of the strap (described below) to be inserted between the tension wheel 440 and the roller 380. A tensioning-assembly-biasing element 400*s* (FIG. 3B), which is a compression spring in this example embodiment but may be any other suitable type of biasing element, biases the tensioning assembly 400 to the strap-tensioning position.

The decoupling assembly 1900, which is best shown in FIGS. 5A-5D, is configured to enable the tension wheel 440 to rotate about the tension-wheel rotational axis 440*a* in a direction opposite the tensioning rotational direction to facilitate removal of the tool 50 from the strap after the tensioning process is complete. The decoupling assembly 1900 includes a decoupling-assembly shaft 1910, a decoupling-assembly housing 1920, a first engageable element 1930, an expandable element 1940, a second engageable element 1950, and first and second bearings 1960*a* and 1960*b*.

The decoupling-assembly shaft 1910 includes a body 1912 having a first end 1912*a* having an irregular cross-section and second end 1912*b* having teeth. A first bearing support 1914 extends from the first end 1912*a*, and a second bearing support 1916 extends from the second end 1912*b*. The decoupling-assembly housing 1920 includes a tubular body 1922 having teeth 1924 extending around its outer circumference. The body 1922 defines an opening 1922*o*. The first engageable element 1920 comprises a tubular bushing having a cylindrical outer surface and an interior surface having a perimeter that matches the perimeter of the first end 1912*a* of the body 1912 of the decoupling-assembly shaft 1910. The expandable element 1940 includes a torsion spring having a first end 1940*a* and a second end 1940*b*. The second engageable element 1950 includes a tubular body 1952 and an annular flange 1954 at one end of the body 1952. An opening 1954*o* is defined through the flange 1954.

The first engageable element 1930 is mounted on the first end 1912*a* of the body 1912 of the decoupling-assembly shaft 1910 for rotation therewith and is disposed within the body 1922 of the decoupling-assembly housing 1920. The second engageable element 1950 is also disposed within the body 1922 of the decoupling-assembly housing 1920 such that the body 1952 of the second engageable element 1950 is adjacent the first engageable element 1930 and such that at least part of the decoupling-assembly shaft 1910 extends through the second engageable element 1950. The expandable element 1940, which is a torsion spring in this example embodiment, is disposed within the body 1922 of the decoupling assembly housing 1920 and circumscribes the first engageable element 1930 and the body 1952 of the second engageable element 1950. The outer diameters of the first engageable element 1930 and the body 1952 of the second engageable element are substantially the same and are equal to or larger than the resting inner diameter of the torsion spring 1940. This means that the torsion spring 1940 exerts a compression force on the first engageable element 1930 and the body 1952 of the second engageable element that prevents those components (and the decoupling-assembly shaft 1910) from rotating relative to one another. The first end 1940*a* of the expandable element 1940 is received in the opening 1954*o* defined through the flange 1954 of the second engageable element 1950, and the second end 1940*b* of the expandable element 1940 is received in the opening 1922*o* defined in the body 1922 of the decoupling-assembly housing 1920. The bearings 1960*a* and 1960*b* are mounted on the first and second bearing supports 1914 and 1916, respectively, of the decoupling-assembly shaft 1910.

Figure 3A:
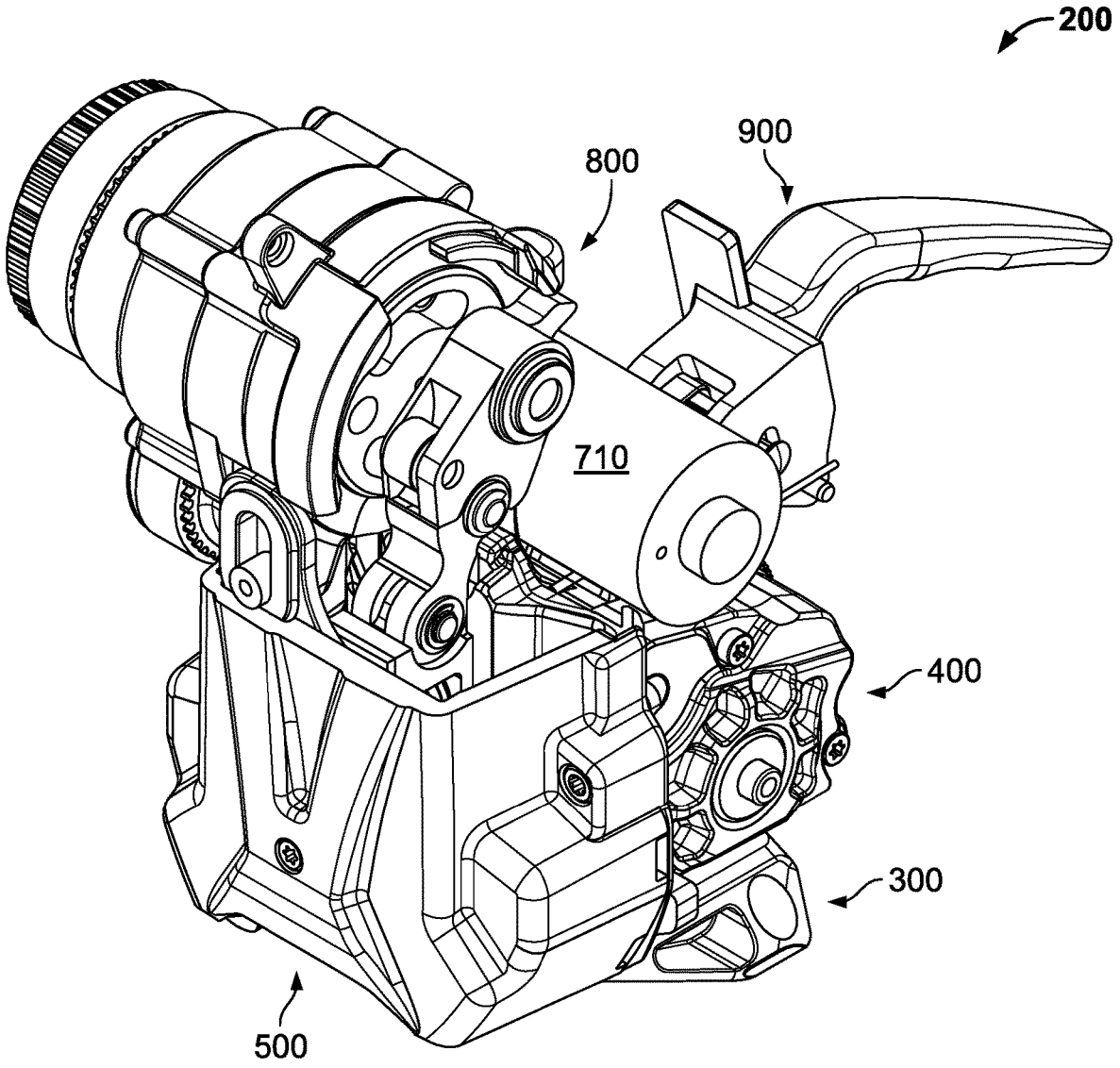
FIGS. 3A and 3B are perspective views of the working assembly of the strapping tool of FIG. 1A.
Figure 3B:
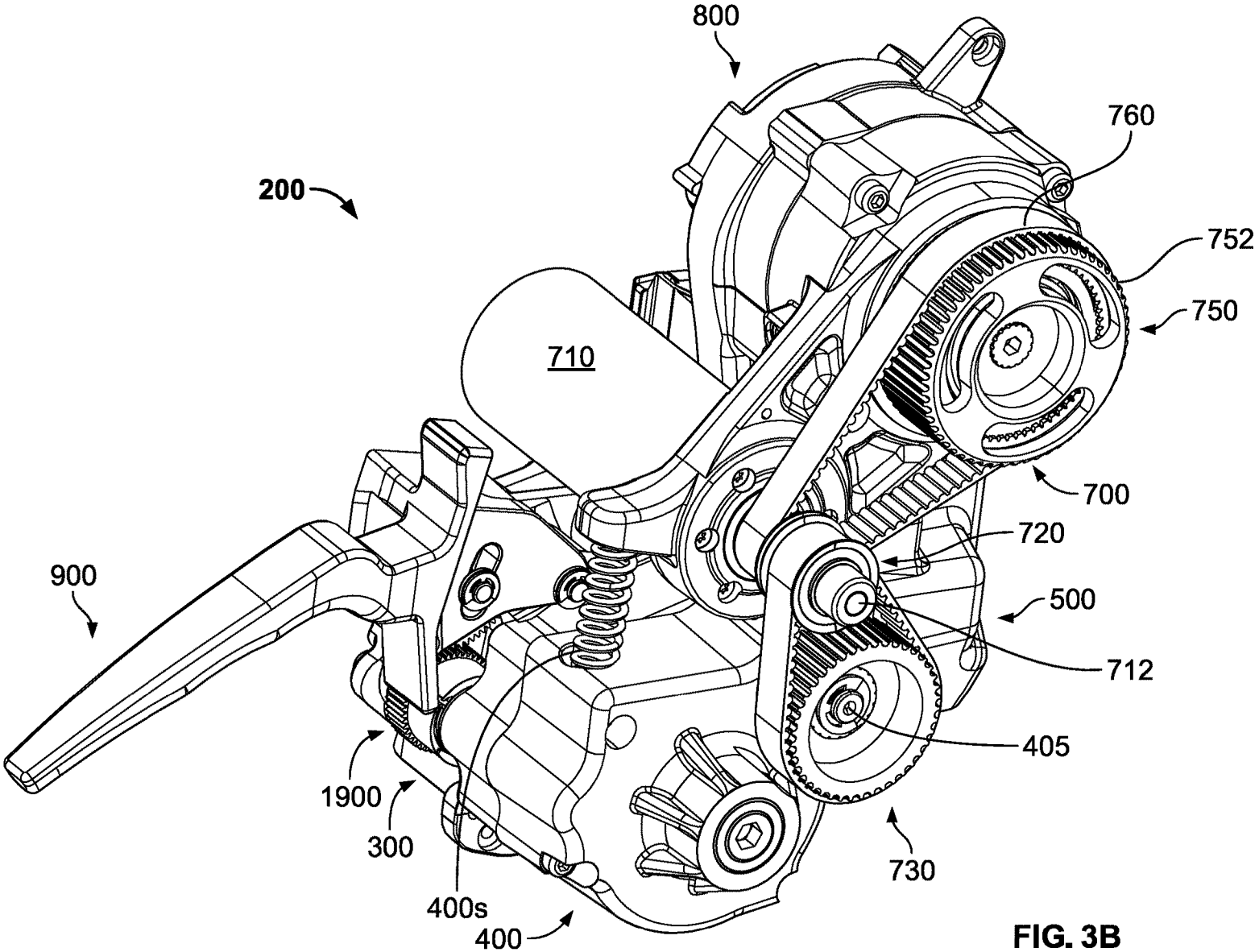
Figure 4A:
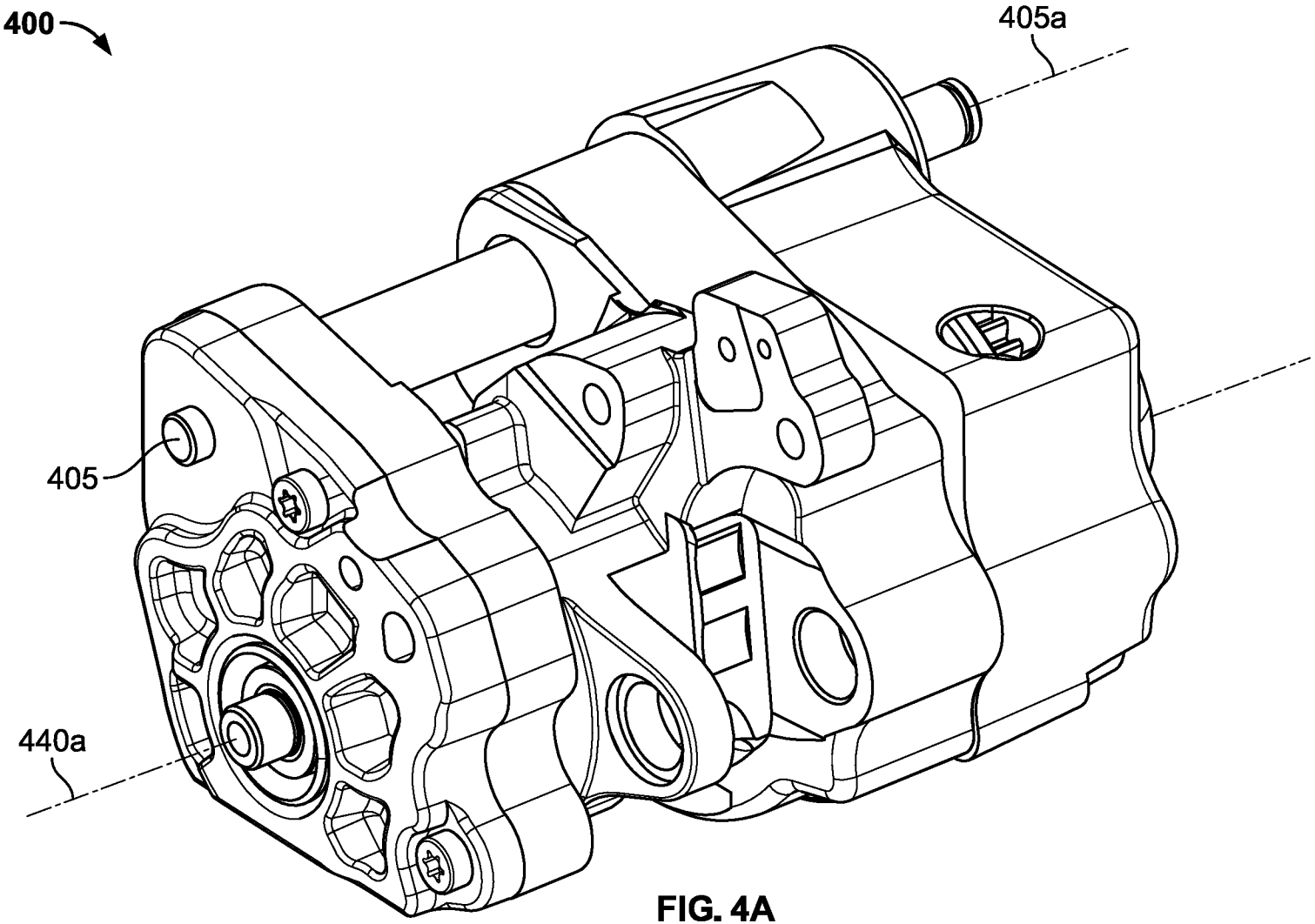
FIG. 4A is a perspective view of the tensioning assembly of the working assembly of FIG. 3A.
Figure 4B:
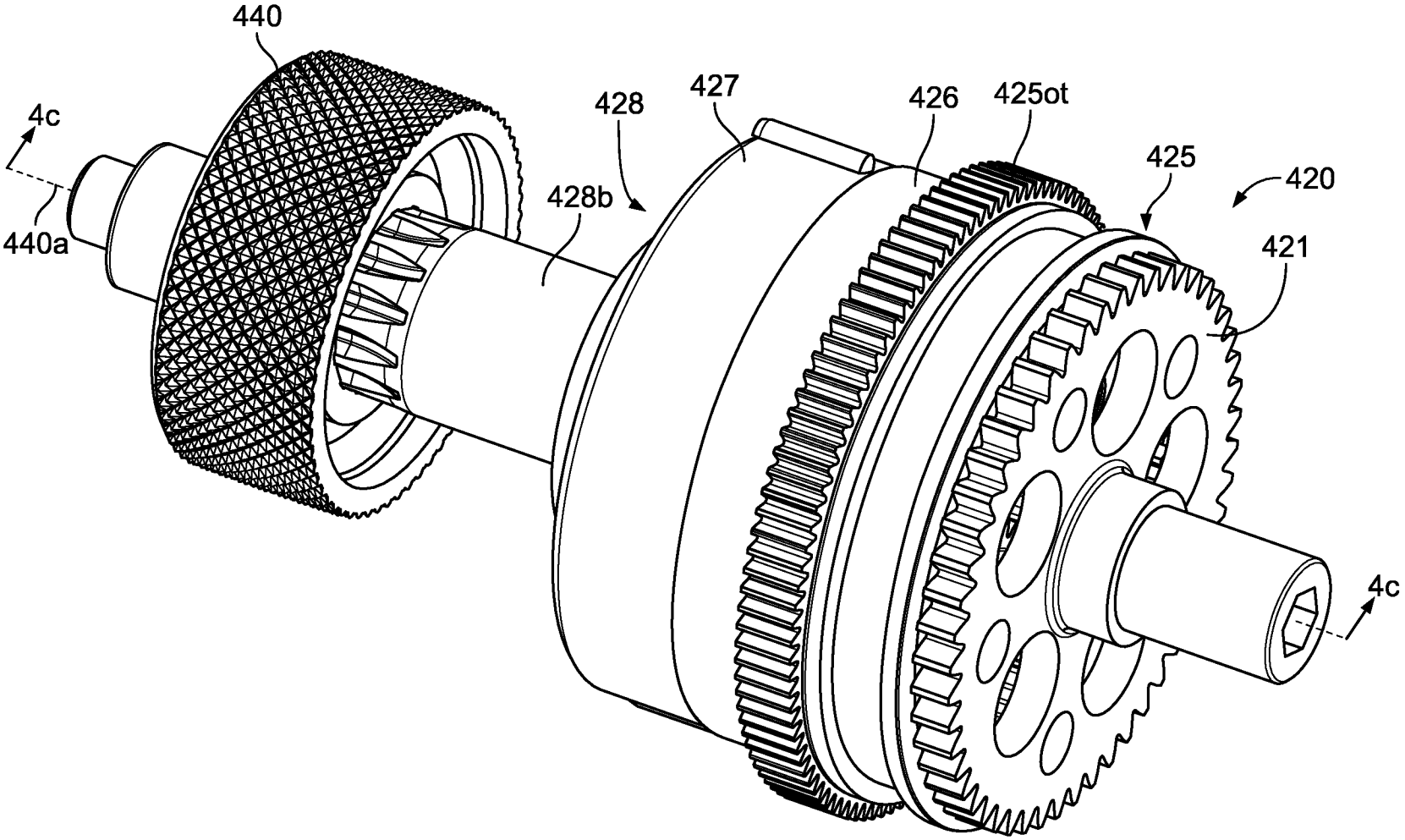
FIG. 4B is a perspective view of the tensioning-assembly gearing and the tension wheel of the tensioning assembly of FIG. 4A.
Figure 4C:
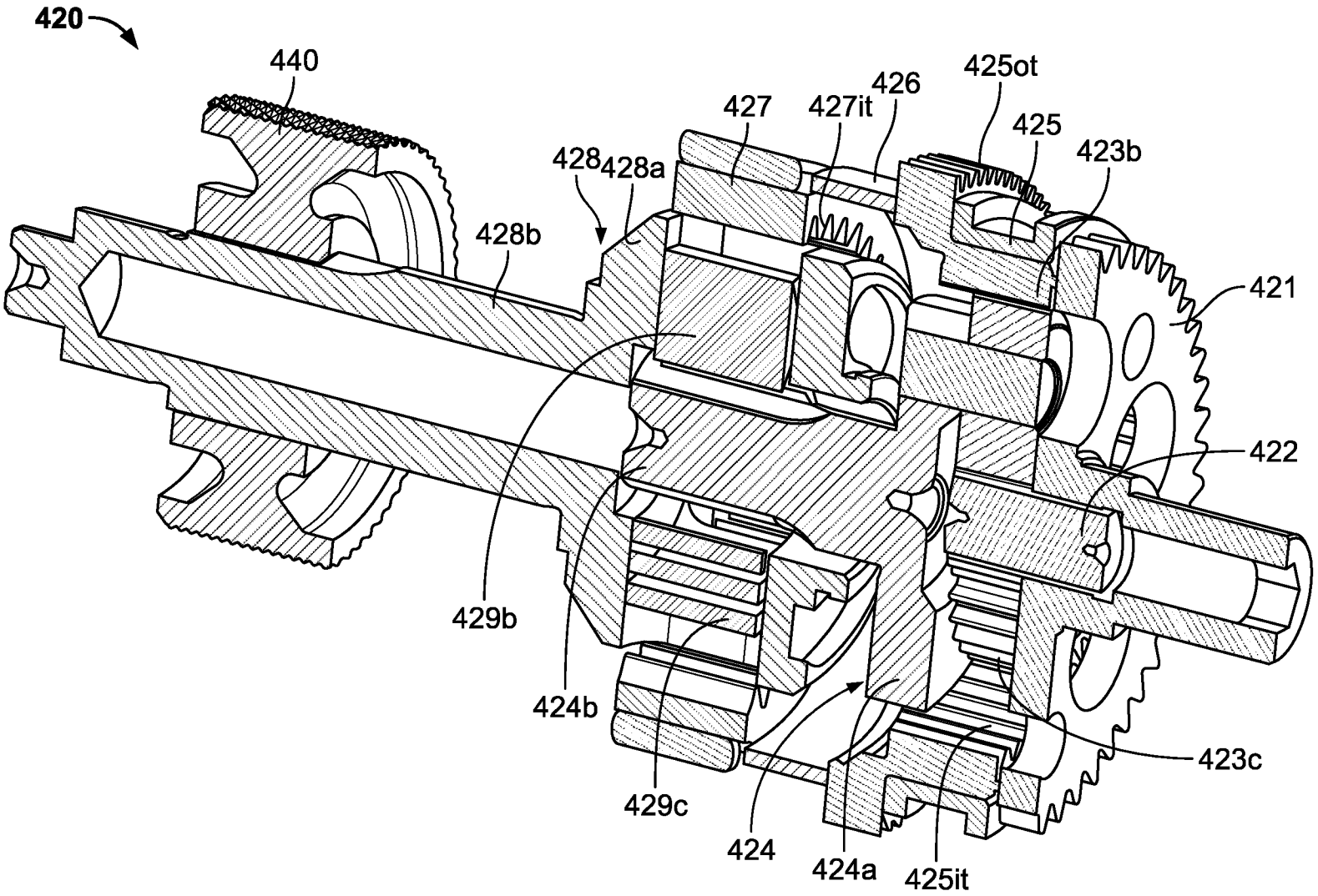
FIG. 4C is a cross-sectional perspective view of the tensioning assembly gearing and the tension wheel of FIG. 4B taken along line 4C-4C of FIG. 4B.
Figure 4D:
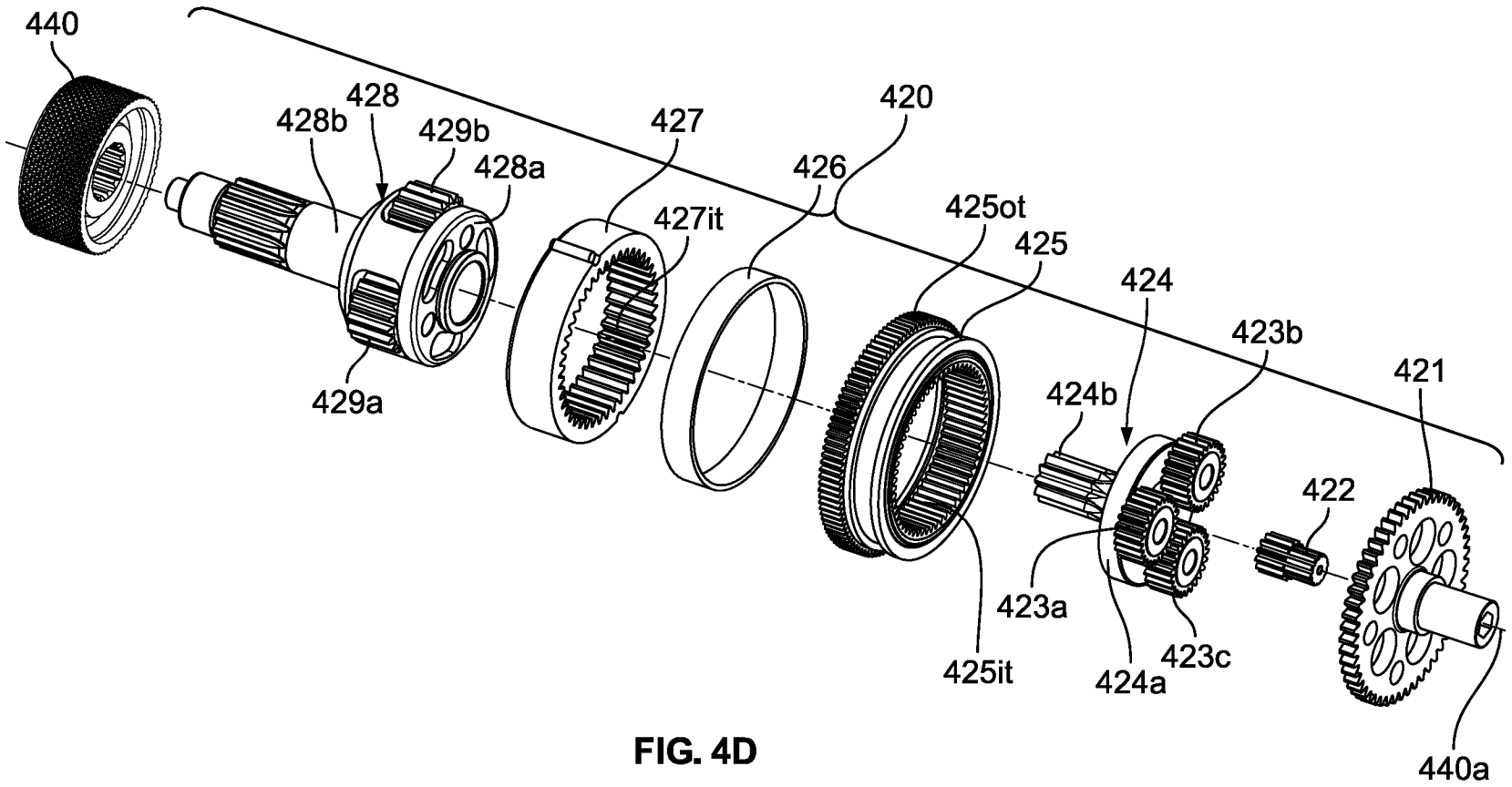
FIG. 4D is an exploded perspective view of the tensioning-assembly gearing and the tension wheel of FIG. 4B.
Figure 5A:
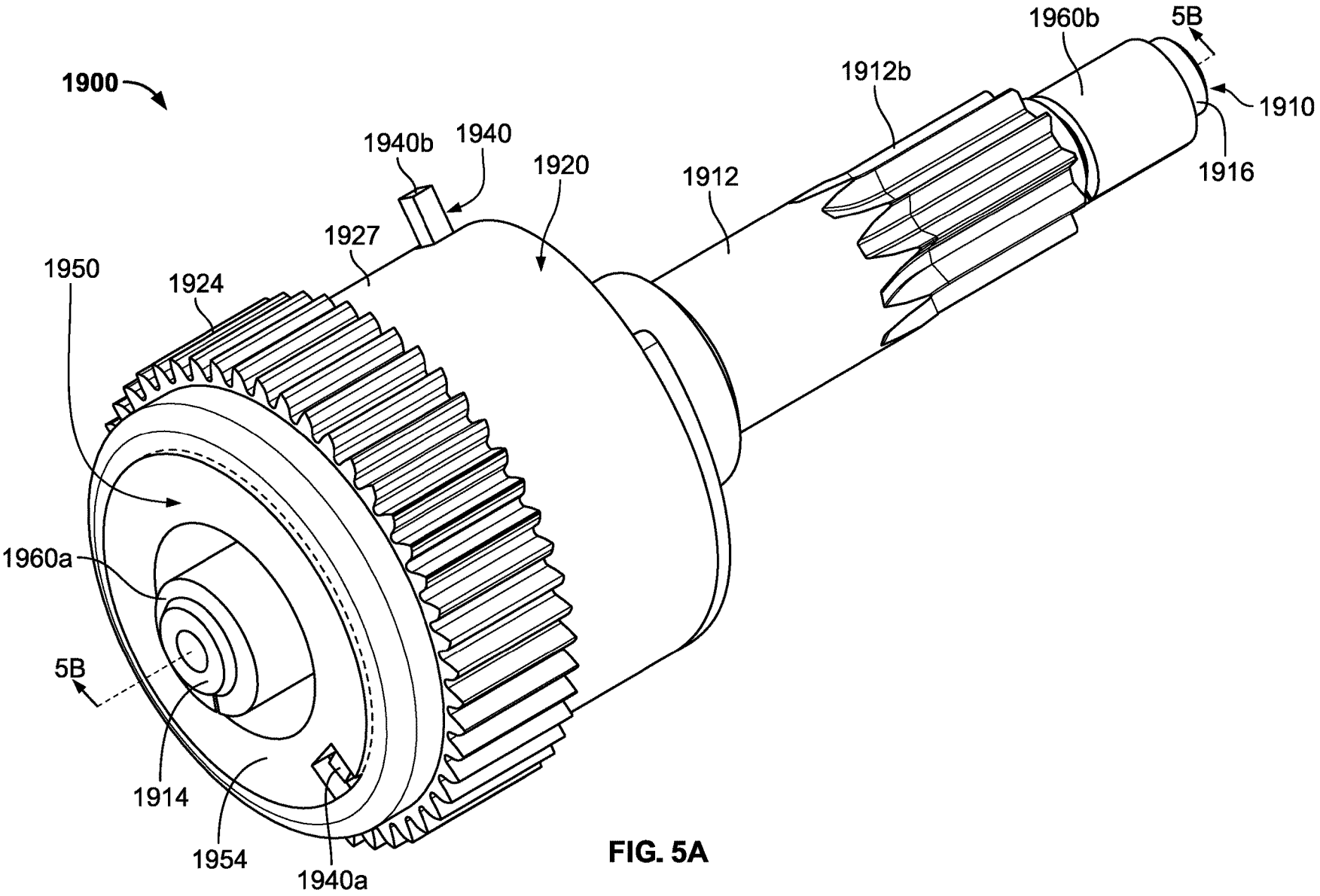
FIG. 5A is a perspective view of the decoupling assembly of the working assembly of FIG. 3A.
Figure 5B:
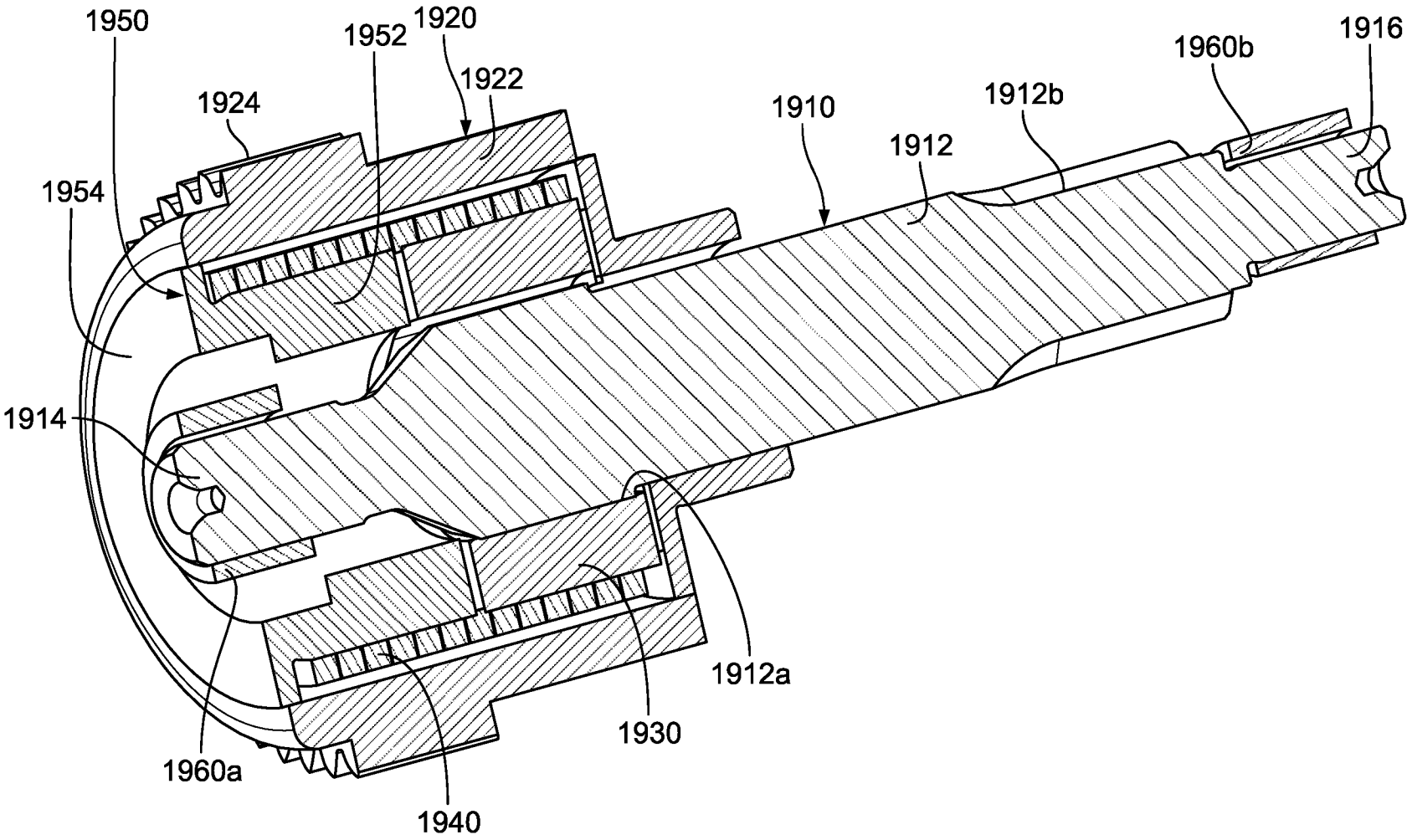
FIG. 5B is a cross-sectional perspective view of the decoupling assembly of FIG. 5A taken along line 5B-5B of FIG. 5A.
Figure 5C:
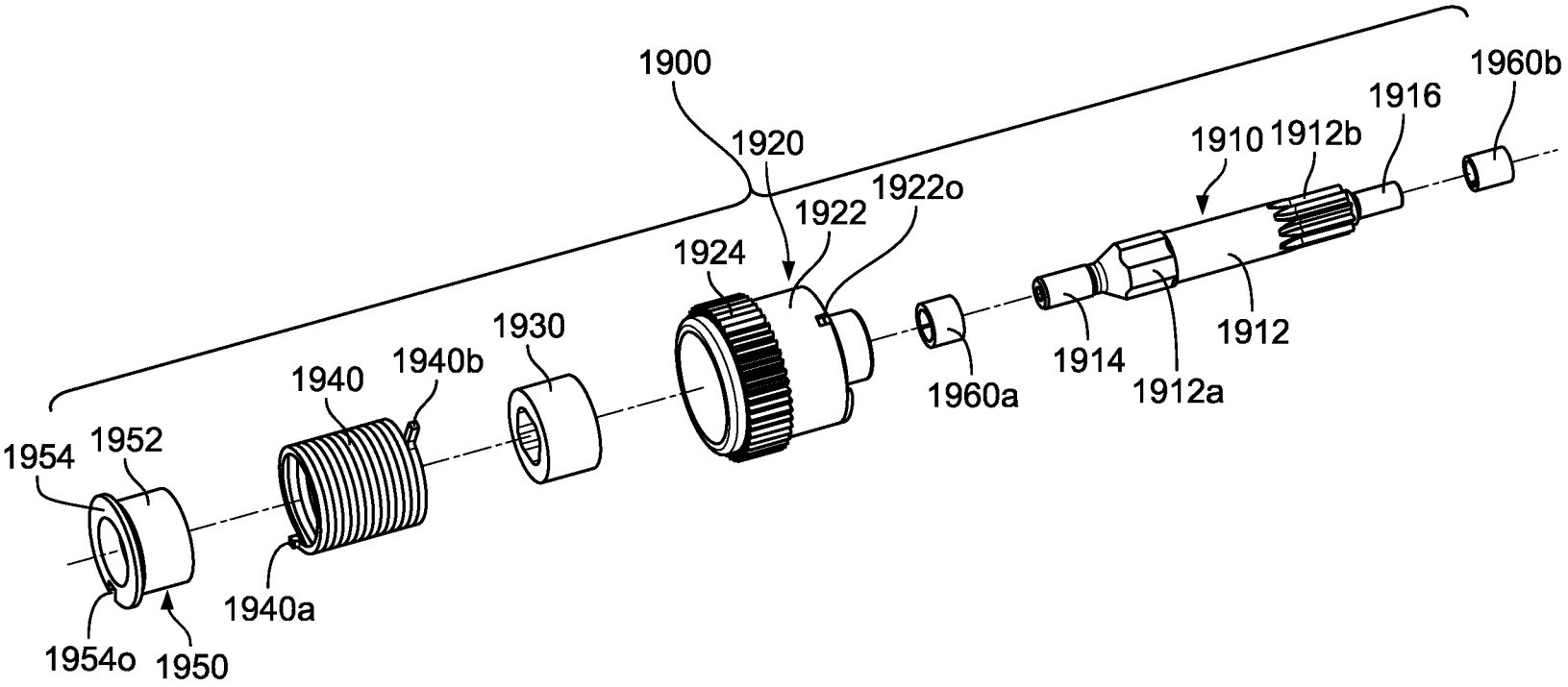
FIG. 5C is an exploded perspective view of the decoupling assembly of FIG. 5A.
Figure 5D:
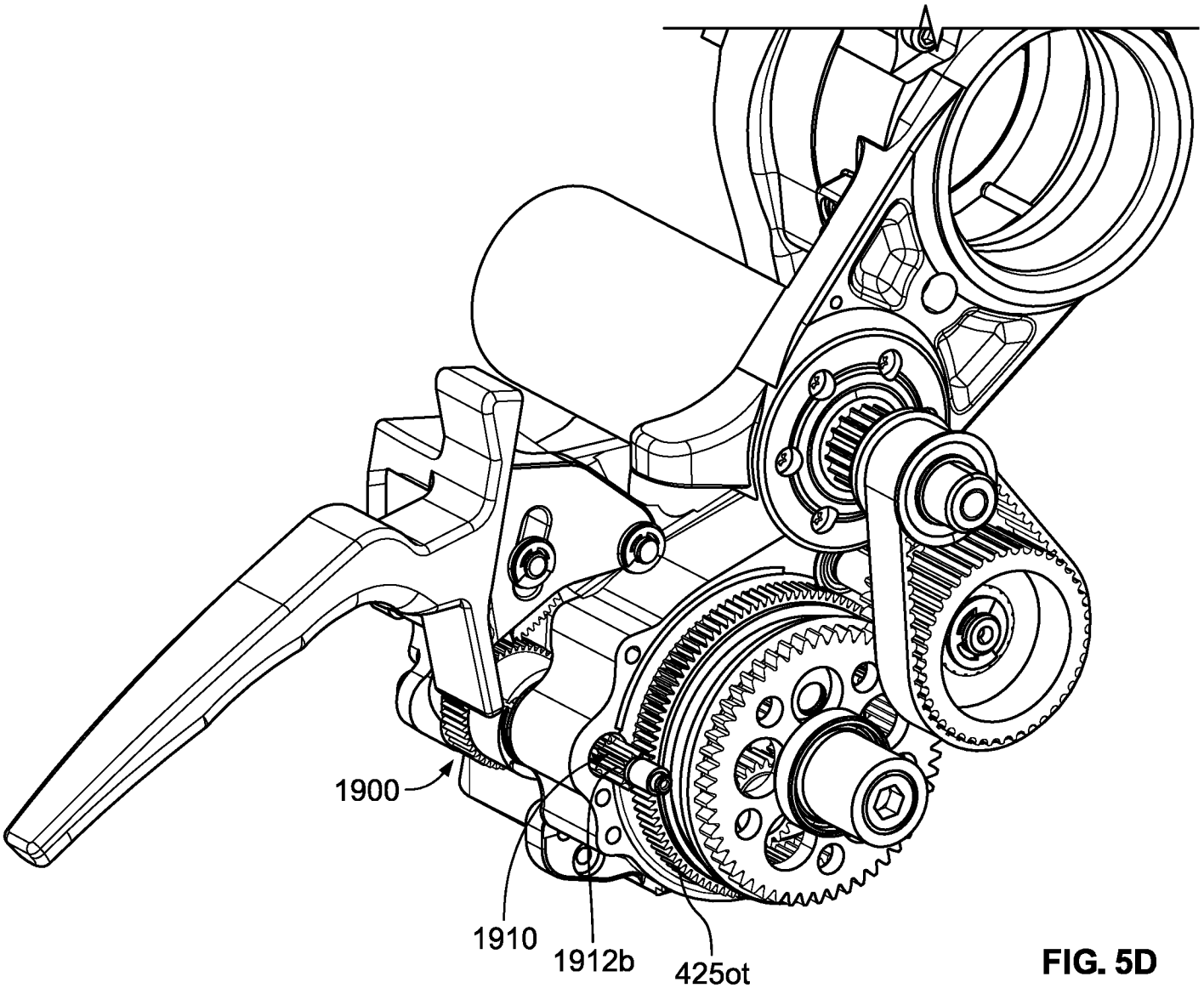
FIG. 5D is a perspective view of part of the working assembly of FIG. 3A including parts of the decoupling assembly and parts of the tensioning assembly.
Figure 6A:
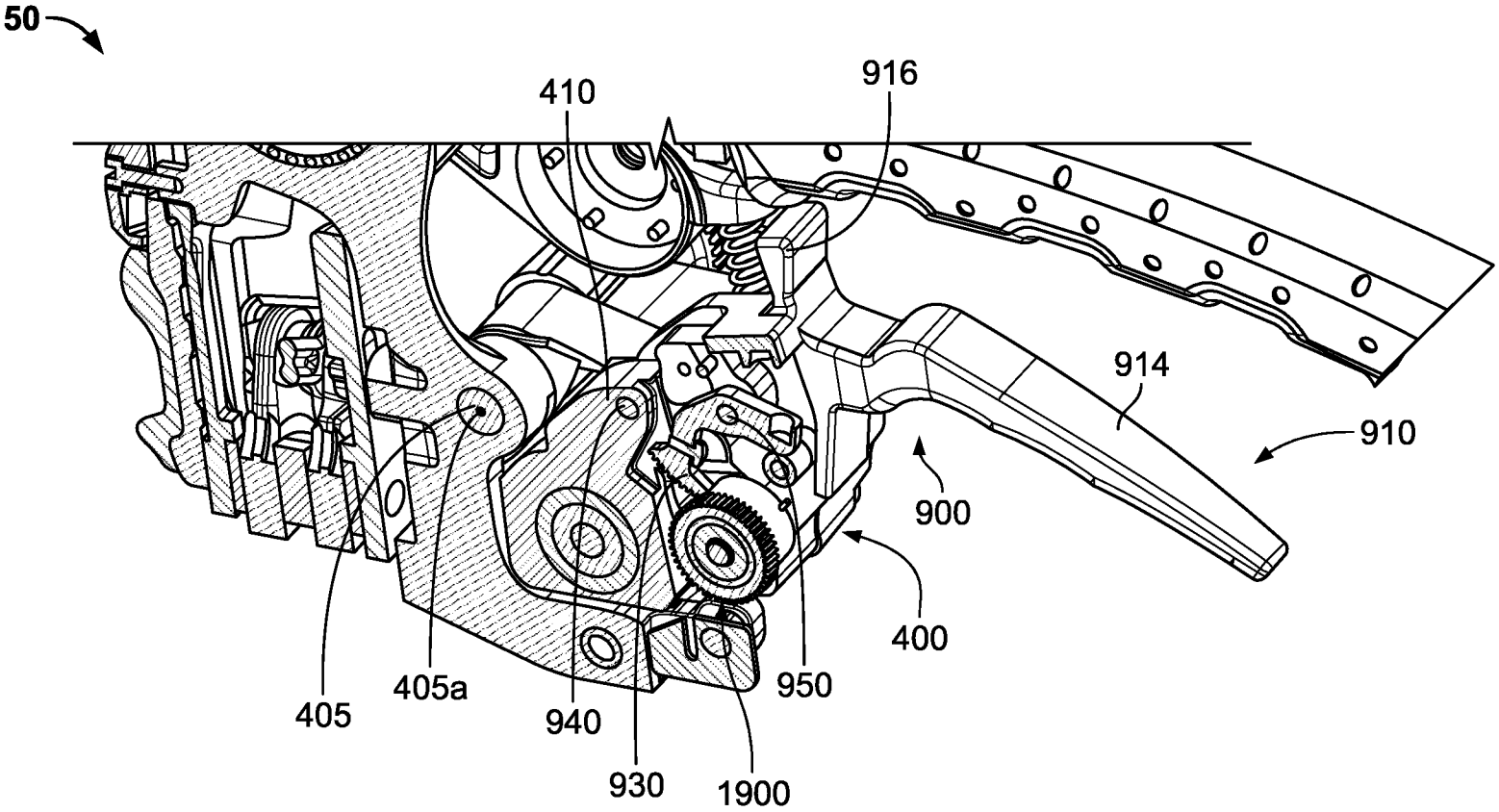
FIG. 6A is a cross-sectional perspective view of part of the working assembly of FIG. 3A including the rocker-lever assembly.
Figure 6B:
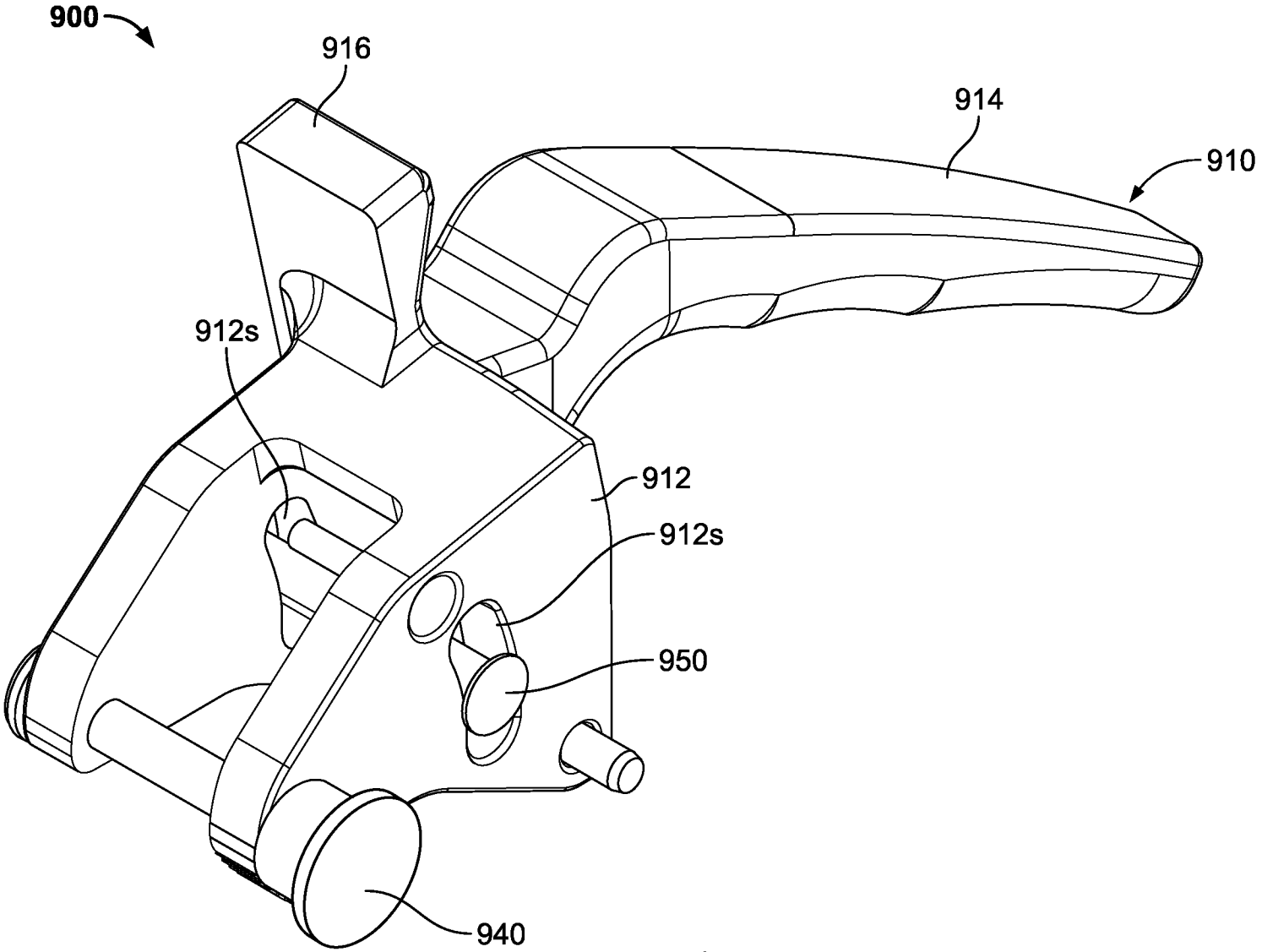
FIGS. 6B and 6C are perspective views of the rocker-lever assembly.
Figure 6C:
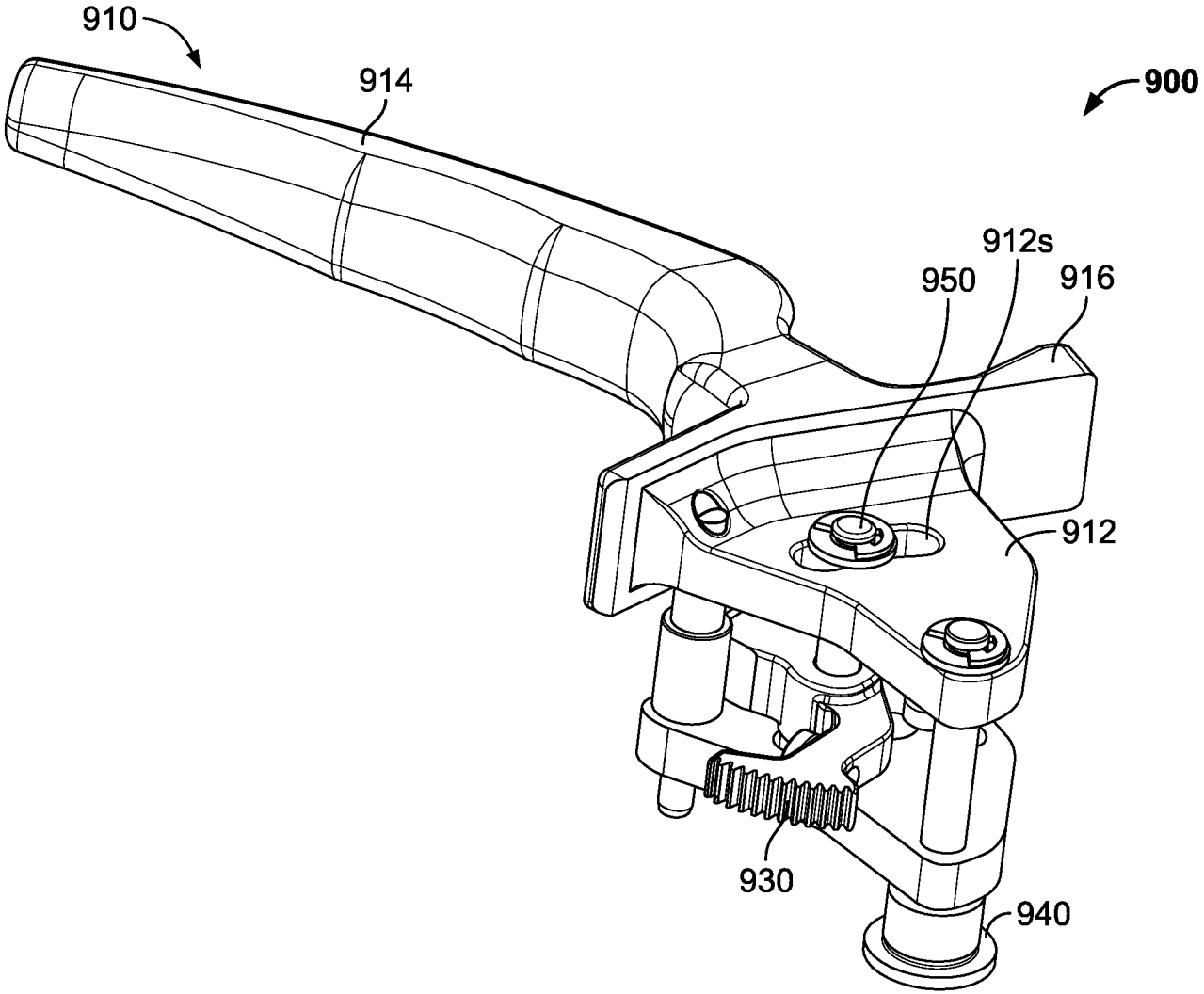
Figure 6D:
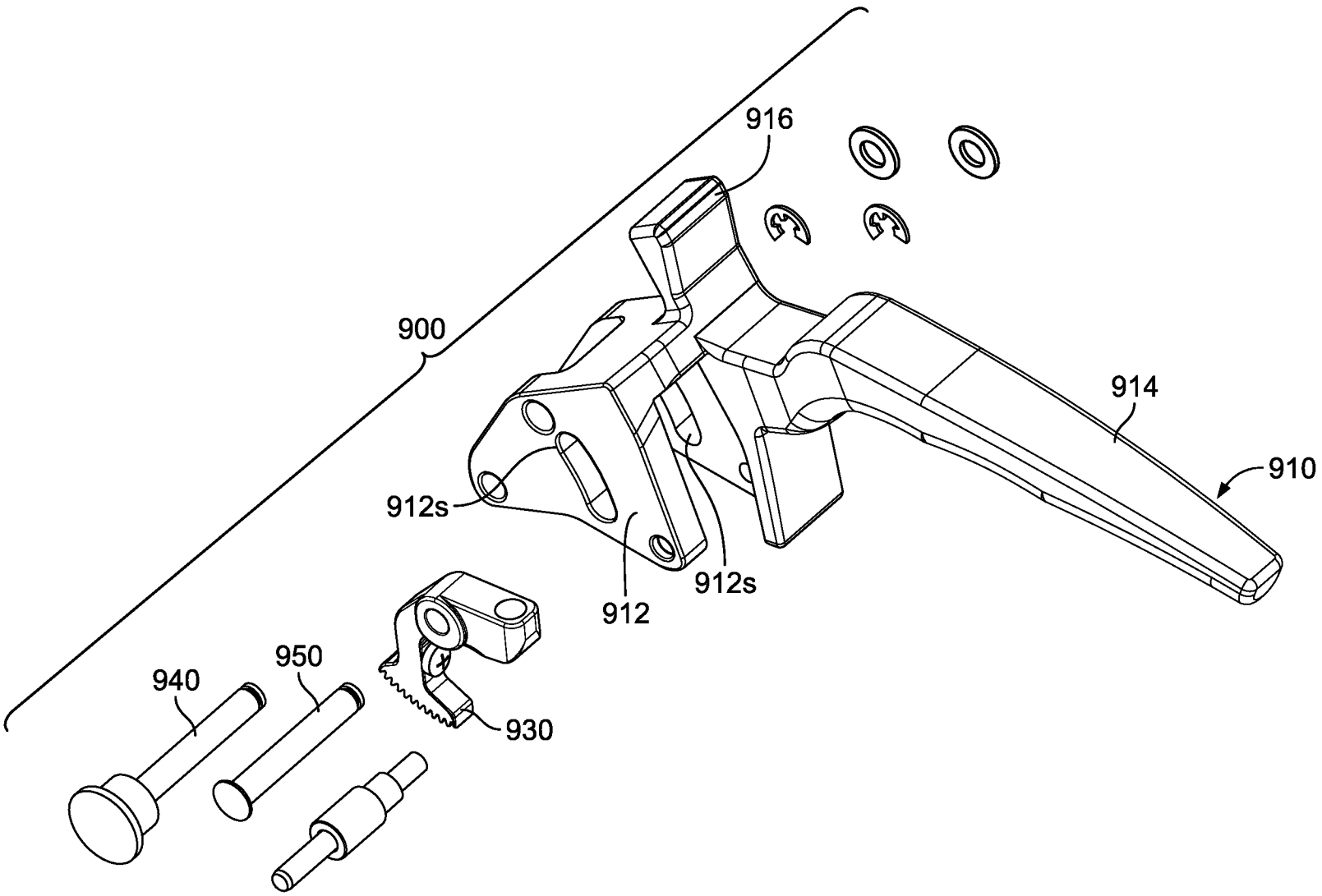
FIGS. 6D and 6E are exploded perspective views of the rocker-lever assembly.
Figure 6E:
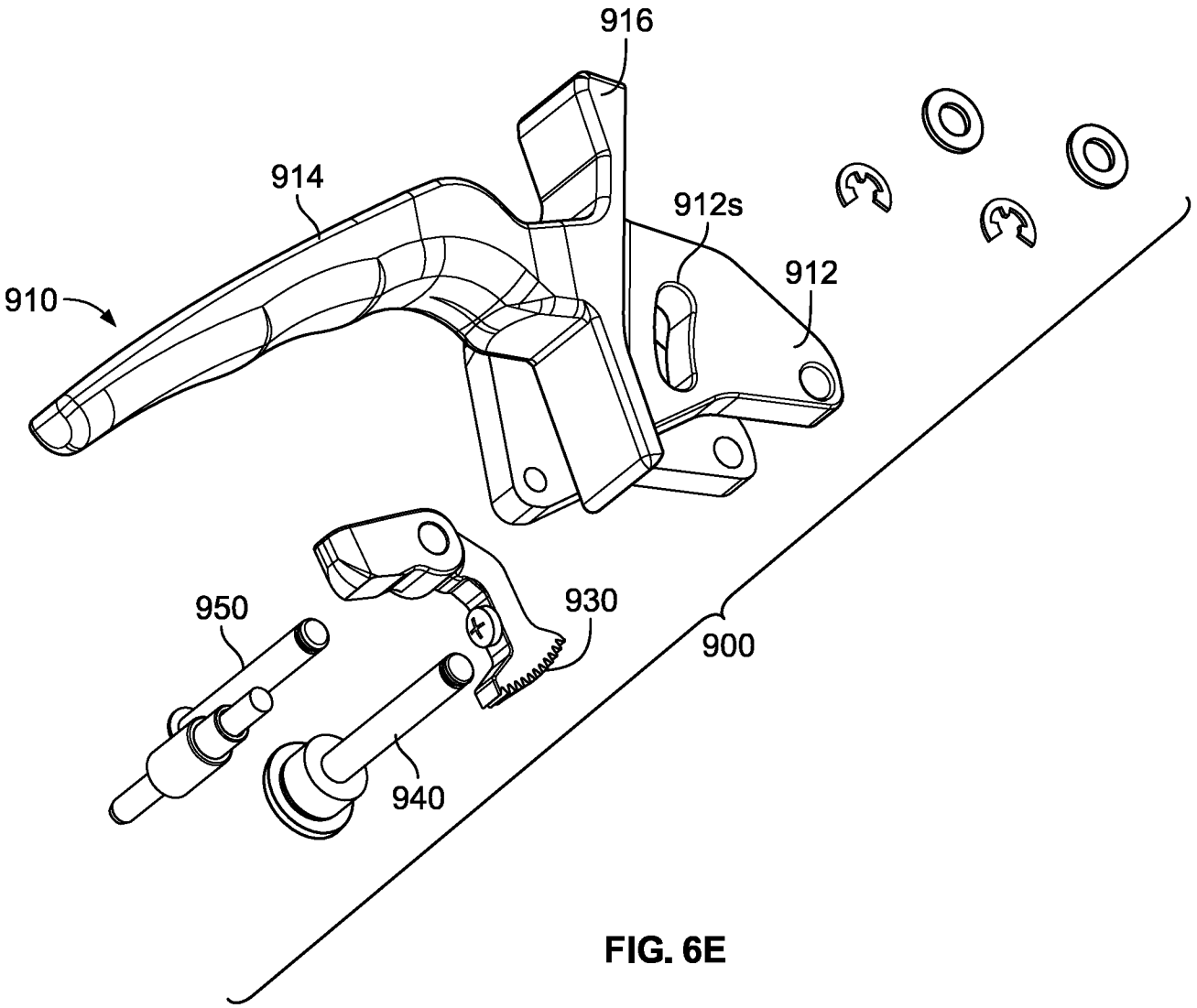

As best shown in FIGS. 3B, 5D, and 6A, the decoupling assembly 1900 is mounted to the tensioning-assembly support 410 and operatively connected to the tensioning-assembly gearing 420. More specifically, the decoupling assembly 1900 is mounted to the tensioning-assembly support 410 via a fastener (not labeled) that fixes the second engageable element 1950 in rotation relative to the tensioning-assembly support 410 such that the second engageable element 1950—and the first end 1940*a* of the expandable element 1940 received in the opening 1954*o* of the flange 1954 of the second engageable element 1950—cannot rotate relative to the tensioning-assembly support 410. The teeth on the second end 1912*b* of the body 1912 of the decoupling-assembly shaft 1910 mesh with the outer teeth 425*ot* of the first ring gear 425 of the tensioning-assembly gearing 420 of the tensioning assembly 400. Since the body 1952 is fixed in rotation relative to the tensioning-assembly support 410 and the decoupling-assembly shaft 1910 is fixed in rotation with the first engageable element 1930, the decoupling-assembly shaft 1910 is fixed in rotation relative to the tensioning-assembly housing 410. Since the teeth on the second end 1912*b* engage the outer teeth 425*ot* of the first ring gear 425 of the tensioning-assembly gearing 420, the decoupling assembly 1900 prevents the first ring gear 425 from rotating about the tension-wheel rotational axis 440*a*.

The decoupling assembly 1900 is actuatable (such as by the rocker-lever assembly 900 as described below) to eliminate the connection between the torsion spring 1940 and the first engageable element 1930 such that the first engageable element 1930 and the decoupling-assembly shaft 1910 may rotate relative to the second engageable element 1930. As explained above, the second engageable element 1950 and the first end 1940*a* of the expandable element 1940 (that is received in the opening 1954*o* of the flange 1954 of the second engageable element 1950) are fixed in rotation relative to the tensioning-assembly support 410. To eliminate the connection between the torsion spring 1940 and the first engageable element 1930, the decoupling-assembly housing 1920 is rotated relative to the tensioning-assembly support 410, the first end 1940*a* of the torsion spring 1940, and the second engageable element 1950. The second end 1940*b* of the torsion spring 1940, which is received in the opening 1922*o* defined in the body 1922 of the decoupling-assembly housing 1920, rotates with the decoupling-assembly housing 1920. As this occurs, the inner diameter of the torsion spring 1940 near its second end 1940*b* begins expanding, and eventually expands enough (thereby reducing the compression force or eliminating it altogether) to enable the first engageable element 1930 and the decoupling-assembly shaft 1910 to rotate relative to the second engageable element 1950 (and the torsion spring 1940).

Upon completion of the tensioning cycle, the tension wheel 440 holds a significant amount of tension in the strap, and the strap exerts a counteracting force (or torque) on the tension wheel 440 in a direction opposite the tensioning direction. Actuation of the decoupling assembly 1900 after the tensioning process is completed enables the tension wheel 440 to rotate in the direction opposite the tensioning direction to release that tension in a controlled manner. Specifically, upon completion of the tensioning cycle, the decoupling-assembly shaft 1910 continues to prevent the first ring gear 425 of the tensioning-assembly gearing 420 from rotating about the tension-wheel rotational axis 440, which prevents the tension wheel 440 from rotating in the direction opposite the tensioning direction. As the decoupling-assembly housing 1920 is rotated (such as via actuation of the rocker-lever assembly 900 as described below), the inner diameter of the torsion spring 1940 near its second end 1940*b* begins expanding. Eventually, the force the first ring gear 425 exerts on the decoupling-assembly shaft 1910 exceeds the compression force the torsion spring 1940 exerts on the first engageable element 1930. When this occurs, the first ring gear 425 rotates in the direction opposite the tensioning direction about the tension-wheel rotational axis 440*a*. Since the first sun gear 422 is fixed in rotation (by the drive assembly 700), this causes the first planetary gears 423*a*-423*c* to rotate in the direction opposite the tensioning direction about the tension-wheel rotational axis 440*a*. This (as explained above) causes the tension wheel 440 to rotate in the direction opposite the tensioning direction about the tension-wheel rotational axis 440*a*.

The rocker-lever assembly 900, which is best shown in FIGS. 6A-6E, is operably connected to: (1) the tensioning assembly 400 and configured to move the tensioning assembly 400 relative to the support 300 from the strap-tensioning position to the strap-insertion position; and (2) the decoupling assembly 1900 and configured to actuate the decoupling assembly, thereby enabling the tension wheel 440 to rotate in the direction opposite the tensioning rotational direction. The rocker-lever assembly 900 includes a rocker lever 910, a rocker-lever gear 930, a rocker-lever pivot pin 940, a rocker-lever travel pin 950, and a rocker-lever biasing element (not shown). The rocker lever 910 includes a rocker-lever body 912 defining two aligned travel-pin slots 912*s*, a rocker-lever arm 914 extending rearwardly from the rocker-lever body 912, and a blocking finger 916 extending upwardly from the rocker-lever body 912 and transverse to the rocker-lever arm 914.

The rocker-lever pivot pin 940 and the rocker-lever travel pin 950 attach the rocker lever 910 to the tensioning assembly 400 such that the rocker lever 910 is pivotable relative to the tensioning assembly 400 between a home position (FIG. 7A) and an intermediate position (FIG. 7B). Specifically, the rocker-lever pivot pin 940 extends through openings (not shown) defined through the tensioning-assembly support 410 and the rocker-lever body 912 of the rocker lever 910 such that the rocker lever 910 is pivotable about the pivot pin 940—which defines a rocker-lever pivot axis (not shown)—and relative to the tensioning assembly 400 and the decoupling assembly 1900. The rocker-lever travel pin 950 extends through an opening (not shown) defined through the tensioning-assembly support 410 and through the travel-pin slots 912*s* of the rocker-lever body 912.

As the rocker lever 910 pivots about the pivot pin 940 (and the rocker-lever pivot axis) and relative to the tensioning assembly 400 and the support 300, the travel-pin slots 912*s* move relative to the rocker-lever travel pin 950 (which is mounted to the tensioning-assembly support 410). The size, shape, position, and orientation of the travel-pin slots 912*s* enable the rocker lever 910 to pivot about the pivot pin 910 from the home position to, but not past, the intermediate position and from the intermediate position to, but not past, the home position. More specifically, as shown in FIG. 7A, when the rocker lever 910 is in its home position, the rocker-lever travel pin 950 is positioned at and engages the upper ends (not labeled) of the travel-pin slots 912*s*, preventing the rocker lever 910 from further rotation relative to the tensioning assembly 400 in the clockwise direction. Conversely, and as shown in FIG. 7B, when the rocker lever 910 is in its intermediate position, the rocker-lever travel pin 950 is positioned at the lower ends (not labeled) of the travel-pin slots 912*s*, preventing the rocker lever 910 from further rotation relative to the tensioning assembly 400 in the counter-clockwise direction. Although not shown here, the rocker-lever biasing element, which is a torsion spring in this example embodiment but may be any other suitable component, biases the rocker lever 910 to its home position.

As best shown in FIG. 6A, the rocker-lever gear 930 is attached to the rocker-lever body 912 of the rocker lever 910 via the rocker-lever travel pin 950 such that the rocker-lever gear 930 is rotatable about the rocker-lever travel pin 950. The rocker lever 910 is operably connected to the rocker-lever gear 930 and configured to rotate the rocker-lever gear 930 about the rocker-lever travel pin 950 as the rocker lever 910 pivots from its home position to its intermediate position. As the rocker-lever gear 930 rotates, it actuates the decoupling assembly 1900, as described above. More specifically, as the rocker-lever gear 930 rotates, it meshes with the teeth 1924 of the body 1922 of the decoupling-assembly housing 1920, thereby forcing the decoupling-assembly housing 1920 to rotate (thereby actuating the decoupling assembly 1900).

As explained above and as shown in FIG. 7B, once the rocker lever 910 reaches its intermediate position, the rocker-lever travel pin 950 is positioned at the lower ends of the travel pin slots 912*s*, preventing the rocker lever 910 from further rotation relative to the tensioning assembly 400 in the counter-clockwise direction. At this point, if the tensioning assembly 400 is in its strap-tensioning position, as shown in FIG. 7B, continued application of force on the rocker lever 910 (and particularly the rocker-lever arm 914) towards the handle 1100 causes the rocker lever 910 and the tensioning assembly 400 to rotate together about the tensioning-assembly-pivot axis 405*a* until the rocker lever 910 reaches its actuated position and the tensioning assembly 400 reaches its strap-insertion position. FIG. 7C shows the rocker lever 910 in its actuated position and the tensioning assembly 400 in its strap-insertion position.

The blocking finger 916 is sized, shaped, positioned, oriented, and otherwise configured such that, when the rocker lever 910 is in its home position and the tensioning assembly 400 is in its strap-tensioning position, the blocking finger 916 prevents the tensioning assembly 400 from moving from its strap-tensioning position to its strap-insertion position (and the resultant movement of the rocker lever 910 towards the handle 1100). As best shown in FIGS. 7A-7D, the housing 100 defines a blocking finger opening 980 sized and shaped to enable the blocking finger 916 to pass through the opening 980 and into the housing 100 as the rocker lever 910 pivots from its home position to its intermediate position.

Figure 7D:
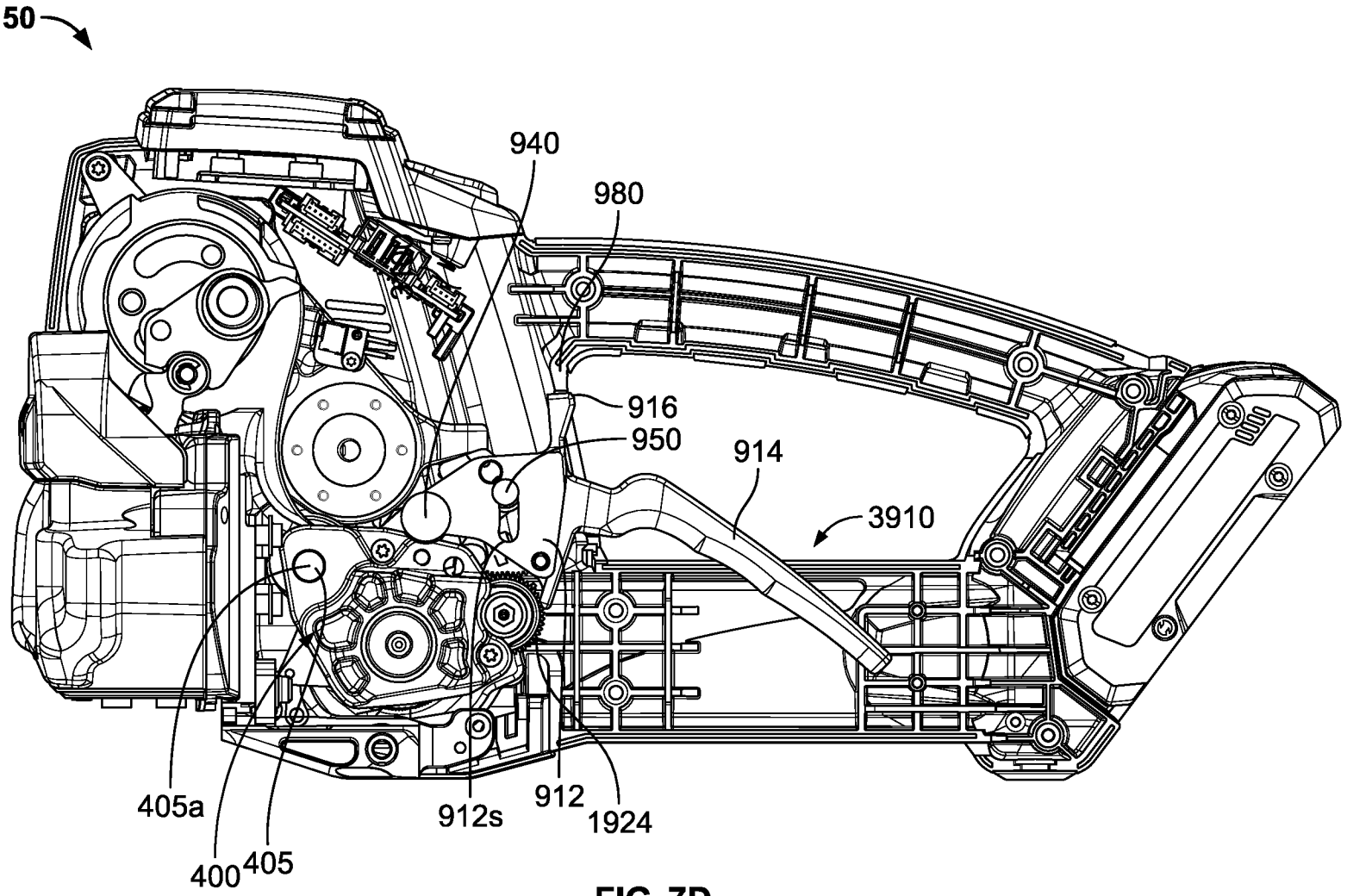

When the tensioning assembly 400 is in its strap-tensioning position and the rocker lever 910 is in its home position, as shown in FIG. 7A, the blocking finger 916 is adjacent a portion of the housing 100 that defines the blocking finger opening 980 (though it may be adjacent any other suitable portion of the housing or other component of the tool used for this purpose). If at this point a force acts on the tensioning assembly 400 (such as the force caused by cutting the strap from the strap supply and releasing the stored tension therein) and attempts to move the tensioning assembly 400 from its strap-tensioning position to its strap-insertion position, the resultant upward movement of the rocker lever 910—without pivoting away from its home position relative to the tensioning assembly 400—results in the blocking finger 916 engaging the housing 100. As shown in FIG. 7D, this prevents further movement of the tensioning assembly 400 toward its strap-insertion position and prevents further movement of the rocker lever 910 toward the handle 1100.

The blocking finger 916 does not prevent the tensioning assembly 400 from moving from its strap-tensioning position to its strap-insertion position when the rocker lever 910 is in its intermediate position and the tensioning assembly 400 is in its strap-tensioning position. As shown in FIG. 7B, the blocking finger 916 passes through the blocking finger opening 980 and into the housing as the rocker lever 910 moves from its home position to its intermediate position. As shown in FIG. 7C, as the operator keeps moving the rocker lever 910 to its actuated position, the blocking finger 916 does not prevent the tensioning assembly 400 from pivoting upwards about the tensioning-assembly-pivot axis 405*a* to its strap-insertion position. Accordingly, for the rocker lever 910 to move the tensioning assembly 400 from its strap-tensioning position to its strap-insertion position, the rocker lever 910 must first be moved from its home position to its intermediate position while the tensioning assembly 400 is in its strap-tensioning position (best shown in FIG. 7B).

The retaining assembly 1800, which is best shown in FIGS. 8A-9B, is mounted to the housing 100 and configured to retain the tensioning assembly 400 in its strap-insertion position and, responsive to initiation of the tensioning cycle, to automatically release the tensioning assembly 400 and enable the tensioning assembly 400 to move (via the tensioning-assembly-biasing element) to its strap-tensioning position. The retaining assembly 1800 includes a retainer 1810, a retainer mount 1820, and a retainer biasing element 1830.

The retainer 1810 includes a body 1812 with a mounting ear 1814 at one end, a tension-wheel-shaft engager 1816 at the opposite end, and a biasing-element engager 1818 projecting from the body 1812 between the mounting ear 1814 and the tension-wheel-shaft engager 1816. The retainer mount 1820 includes a mounting pin attached to and projecting inward from the housing 100. The retainer 1810 is mounted to the retainer mount 1820 via the mounting ear 1814 so the retainer 1810 is rotatable about the retainer mount 1820 and relative to the tension-wheel shaft 428*b* (and here the entire tensioning assembly 400) between a release position (FIGS. 8A and 8B) and a retaining position (FIGS. 9A and 9B). The retainer biasing element 1830 (here, a torsion spring though it may include any suitable spring or other type of biasing element) exerts a force on the biasing-element engager 1818 that biases the retainer 1810 toward its retaining position.

As shown in FIGS. 8A and 8B, when the tensioning assembly 400 is in its strap-tensioning position, the retainer 1810 is in its release position. When the retainer 1810 is in its release position, the retainer biasing element 1830 forces the tension-wheel-shaft engager 1816 into contact with the tension-wheel shaft 428*b*. This force is low enough (e.g., the spring constant is sufficiently low and the coefficient of friction between the tension-wheel shaft and the tension-wheel-shaft engager is sufficiently low) so as not to affect the ability of the tension-wheel shaft 428*b* to rotate during the tensioning cycle. As the operator moves the rocker lever 910 from its home position to its actuated position (such as to release strap from the strapping tool 50), the tensioning assembly 400 begins rotating to its strap-insertion position. As the tensioning assembly 400 reaches its strap-insertion position, the tension-wheel shaft 428*b* ascends above the tension-wheel-shaft engager 1816. When this occurs, the retainer biasing element 1830 forces the retainer 1810, which at this point is no longer blocked by the tension-wheel shaft 428*b*, to rotate to its retaining position. When the retainer 1810 is in its retaining position, the retainer biasing element 1830 forces the body 1812 into contact with the tension-wheel shaft 428*b*.

At this point, as shown in FIGS. 9A and 9B, the tension-wheel-shaft engager 1816 is beneath (between the tension-wheel shaft 428*b* and the foot 320 of the support 300) and engages the underside of the tension-wheel shaft 428*b*. When the operator releases the rocker lever 910, the tension-wheel-shaft engager 1816 prevents the tensioning assembly 400 from moving to its strap-tensioning position. The tensioning-assembly-biasing element 400*s* causes the tension-wheel shaft 428*b* to impose a force on the tension-wheel-shaft engager 1816. This force is large enough to prevent the tension-wheel-shaft engager 1816 from moving to its release position as the strapping tool 50 is moved around. Additionally, the force the retainer-biasing element 1830 continues to exert on the retainer 1810 acts to resist against the retainer 1810 moving to its release position. Upon initiation of the tensioning cycle, the tension-wheel shaft 428*b* begins rotating (counter-clockwise from the viewpoint shown in FIGS. 9A and 9B). The coefficient of friction between the tension-wheel shaft 428*b* and the retainer 1810 is sufficiently high and the force the retainer biasing element 1830 exerts on the retainer 1810 is sufficiently low so that the rotation of the tension-wheel shaft 428*b* forces the retainer 1810 to rotate to its release position. As this occurs, the tensioning-assembly-biasing element forces the tensioning assembly 400 to its strap-tensioning position, at which point the tensioning assembly 400 begins tensioning the strap.

The ability of the retaining assembly to retain the tensioning assembly in its strap-insertion position reduces operator fatigue by: (1) eliminating the requirement for the operator to continuously hold the rocker lever against the force of the tensioning-assembly-biasing element in its actuated position while removing the strap from the strapping tool; and (2) eliminating the requirement for the operator to, when ready to insert another strap into the strapping tool for tensioning, pull the rocker lever and continuously hold it against the force of the tensioning-assembly-biasing element in its actuated position while inserting the strap into the strapping tool.

The retainer-activation assembly 3850, which is best shown in FIGS. 10-14, is configured to enable an operator of the strapping tool 50 to activate or deactivate the ability of the retaining assembly 1800 to retain the tensioning assembly 400 in its strap-insertion position. The retainer-activation assembly 3850 includes a retainer-activation switch 3852, a retainer-activation-switch biasing element 3854 (which is a spring in this example embodiment but may be any other suitable biasing element), and first and second biasing-element retainers 3856 and 3858 (which are washers in this example embodiment but may be any other suitable components). The retainer-activation switch 3852 includes a disc-shaped head 3852*a*, a shaft 3852*b* extending from and rotatable with the head 3852*a*, and a retainer engager 3852*c* (which is a cam in this example embodiment but may be any other suitable component) at the end of the shaft 3852*b* opposite the head 3852*a* and rotatable with the head 3852*a* and the shaft 3852*b*. The retainer-activation-switch biasing element 3854 circumscribes the shaft 3852*b* and is positioned between the head 3852*a* and the retainer engager 3852*c*. The biasing-element retainers 3856 and 3858 also circumscribe the shaft 3852*b* and are positioned on opposite sides of the retainer-activation-switch biasing element 3854.

The retainer-activation assembly 3850 is mounted to the housing 100 such that the head 3852*a* of the retainer-activation switch 3852 is outside the housing 100, the shaft 3852*b* of the retainer-activation switch 3852*b* extends through an opening (not labeled) in the housing 100, and the retainer engager 3852*c* is inside the housing 100 and adjacent the retainer 1810. The retainer-activation-switch biasing element 3854 is in a compressed state and thus exerts a force against the housing 100 and the retainer engager 3852*c* via the biasing-element retainers 3856 and 3858. This force acts to resist rotation of the retainer-activation switch 3852.

Figure 11:
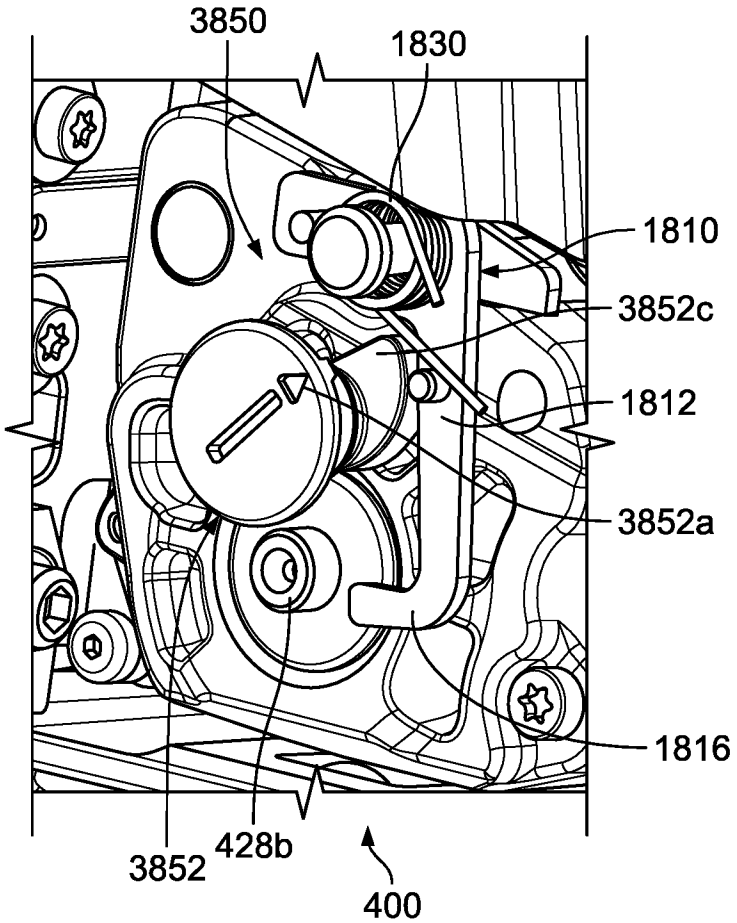
FIG. 11 is a perspective view of part of the strapping tool of FIG. 1A with the housing removed to show the retaining assembly of FIG. 8A and the retainer-activation assembly of FIG. 10.
Figure 10:
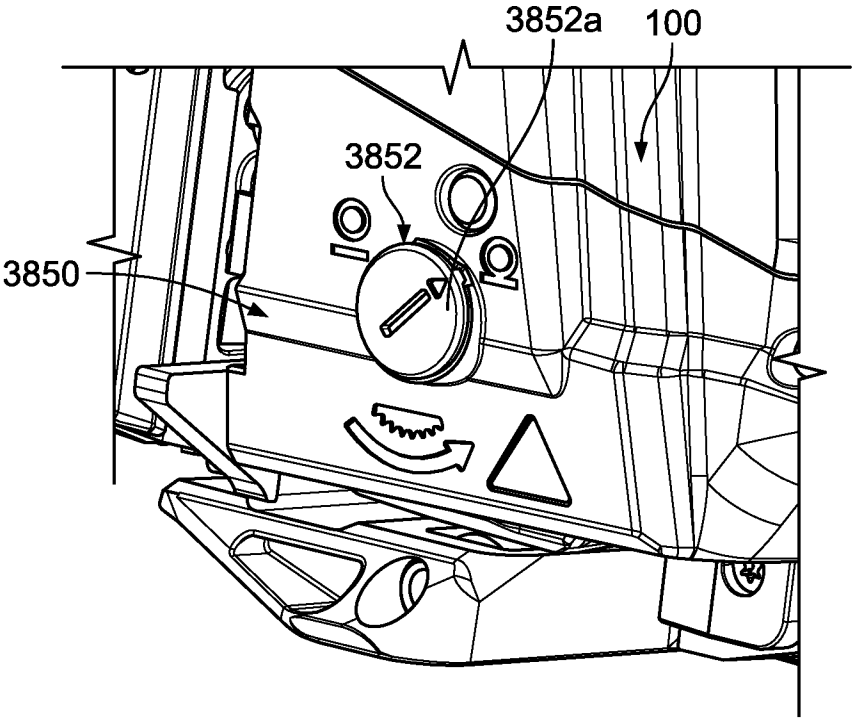
FIG. 10 is a perspective view of part of the housing of the strapping tool of FIG. 1A including the retainer-activation assembly of the strapping tool.
Figure 12A:
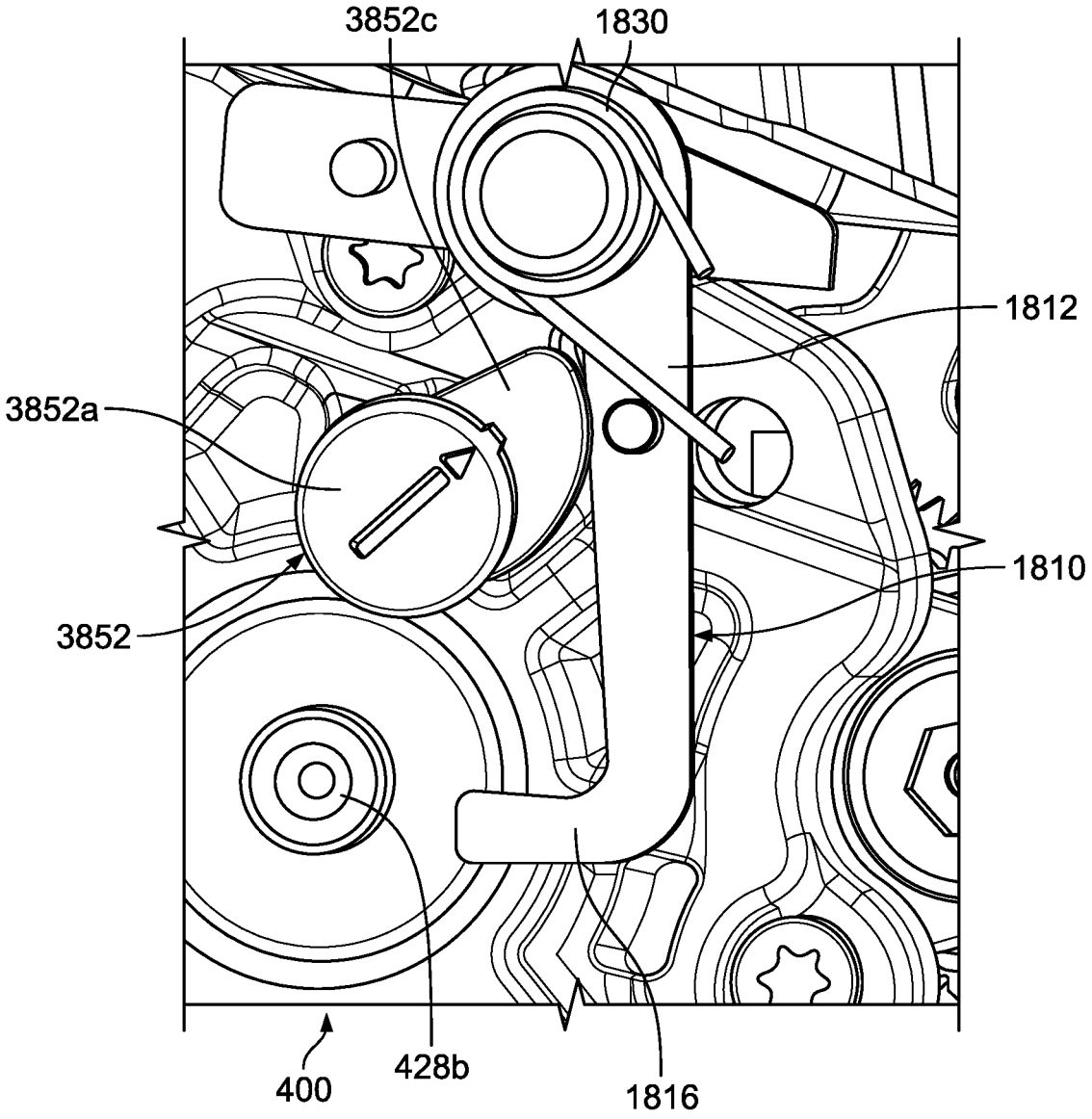
FIGS. 12A and 12B are perspective views of the retaining assembly of FIG. 8A and the retainer-activation assembly of FIG. 10 with the retainer-activation switch of the retainer-activation assembly in its deactivated and activated positions, respectively.

The retainer-activation assembly 3850 is mounted to the housing 100 such that the retainer-activation switch 3852 is rotatable relative to the housing 100 and the retainer 1810 of the retaining assembly 1800 between a deactivated position and an activated position. As shown in FIGS. 11 and 12A, when the retainer-activation switch 3852 is in its deactivated position, the retainer engager 3852*c* is positioned to engage the body 1812 of the retainer 1810 and hold the retainer 1810 in a deactivated position against the biasing force of the retainer biasing element 1830. In this example embodiment, when the retainer 1810 is in its deactivated position, the retainer 1810 is oriented so the tension-wheel-shaft engager 1816 is disengaged from the tension-wheel shaft 428*b* of the tensioning assembly 400 (though in other embodiments the deactivated position and the release position of the retainer 1810 are the same). By holding the retainer 1810 in the deactivated position, the retainer-activation switch 3852 prevents the retainer biasing element 1830 from rotating the retainer 1810 to its retaining position and into contact with the tension-wheel shaft 428*b* when the operator moves the rocker lever 910 from its home position to its actuated position (such as to release the strap from the strapping tool 50). This necessarily prevents the tension-wheel-shaft engager 1816 from engaging the underside of the tension-wheel shaft 428*b* and retaining the tensioning assembly 400 in its strap-insertion position when the operator releases the rocker lever 910. Accordingly, when the retainer-activation switch 3852 is in its deactivated position, it deactivates the ability of the retaining assembly 1800 to retain the tensioning assembly 400 in its strap-insertion position.

Figure 12B:
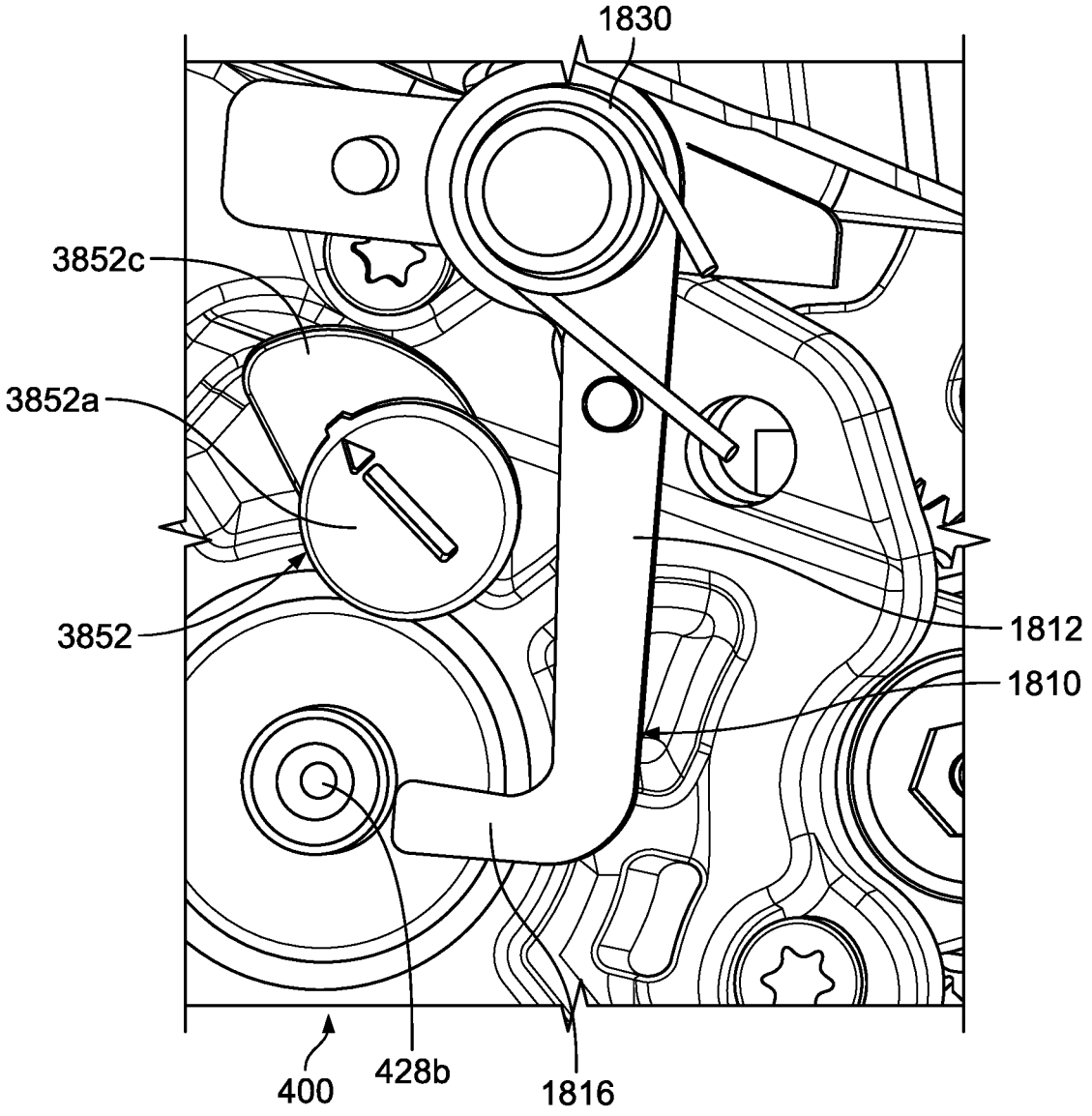
Figure 13:
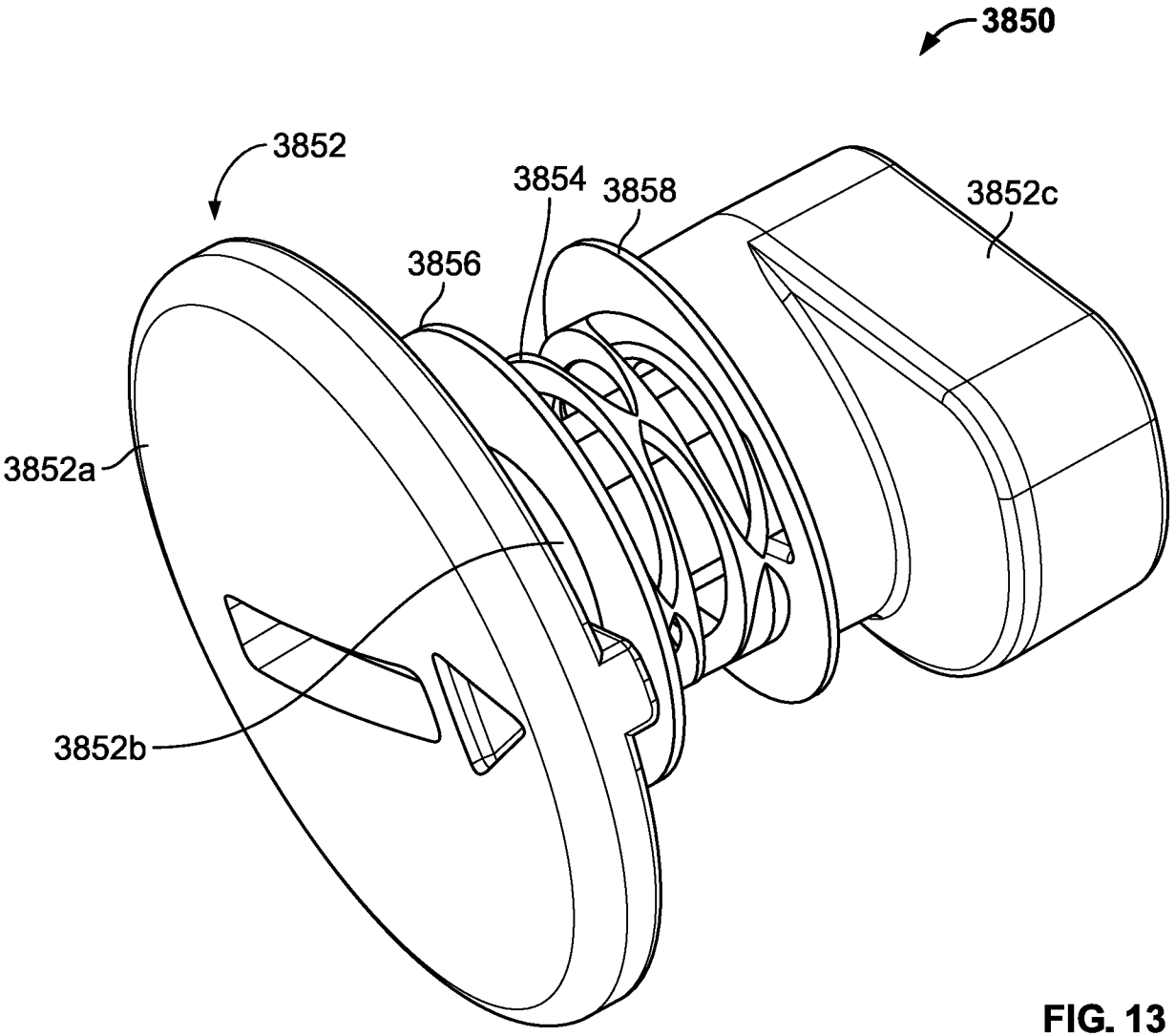
FIG. 13 is a perspective view of the retainer-activation assembly of FIG. 10.
Figure 14:
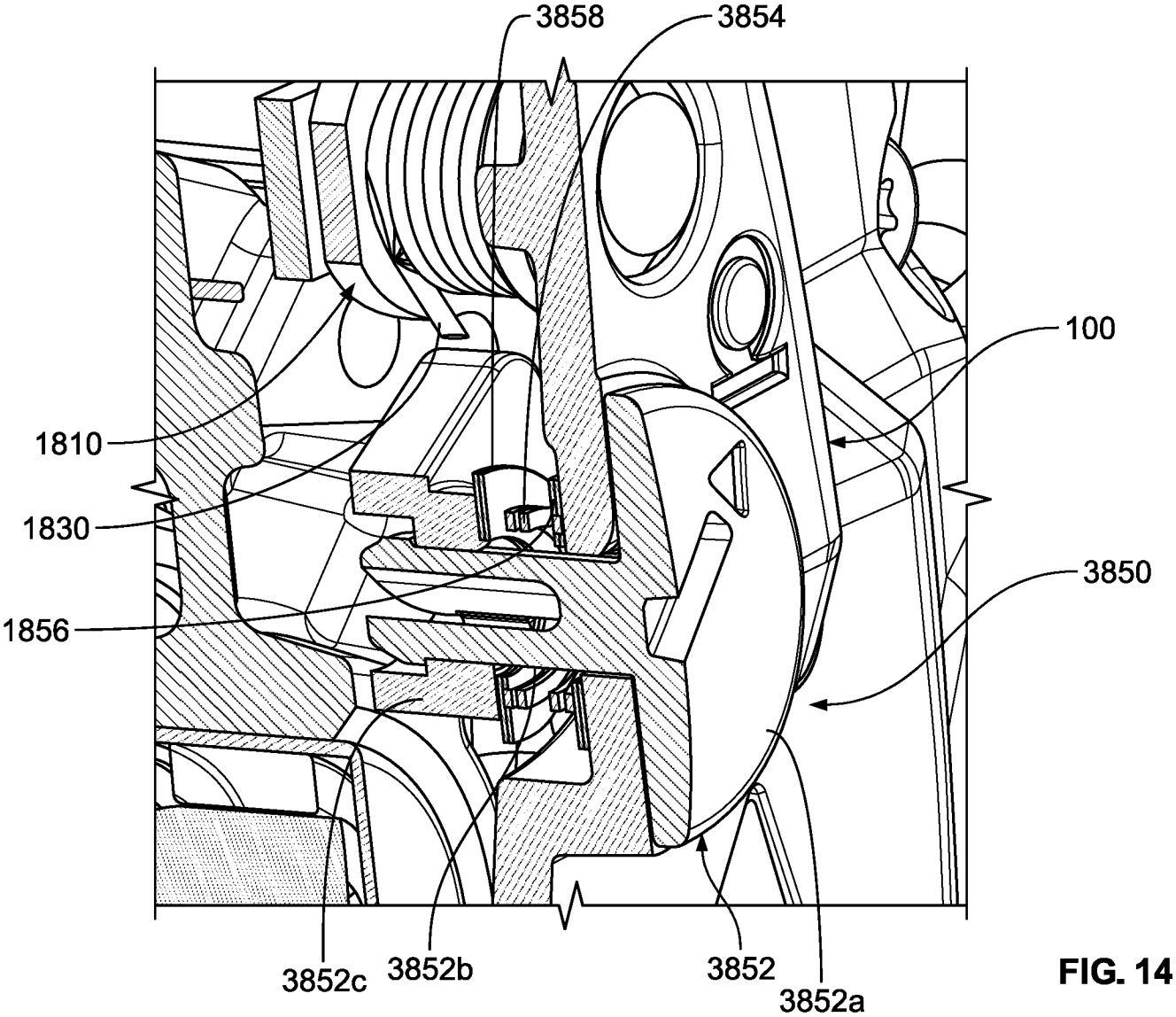
FIG. 14 is a cross-sectional perspective view of part of the strapping tool of FIG. 1A showing the retainer-activation assembly of FIG. 10.

As shown in FIG. 12B, when the retainer-activation switch 3852 is in its activated position, the retainer engager 3852*c* is disengaged from the body 1812 and positioned to enable the retainer 1810 to rotate between its release and retaining positions and operate as described above with respect to FIGS. 8A-9B. Thus, when the operator moves the rocker lever 910 from its home position to its actuated position, the retainer biasing element 1830 forces the retainer 1810 to rotate to its retaining position and contact the tension-wheel shaft 428*b*. When the operator releases the rocker lever 910, the tension-wheel-shaft engager 1816 of the retainer 1810 engages the underside of the tension-wheel shaft 428*b* and prevents the tensioning assembly 400 from moving from its strap-insertion position to its strap-tensioning position. Accordingly, when the retainer-activation switch 3852 is in its activated position, it activates the ability of the retaining assembly 1800 to retain the tensioning assembly 400 in its strap-insertion position.

The retainer-activation assembly 3850 thus provides operators the flexibility to choose whether they want to take advantage of the retaining assembly's ability to retain the tensioning assembly in its strap-insertion position, which may be desirable in certain use cases and not desirable in others. In certain embodiments, the tool includes the retaining assembly but not the retainer-activation assembly.

The gate assembly 1000, which is best shown in FIGS. 8A-9B, is configured to facilitate easy insertion of the strap and is adjustable to accommodate straps of differing thicknesses. The gate assembly 1000 includes a gate 1010 and multiple linkages 1012, 1014, and 1016.

The gate 1010 is slidably received in the gate-receiving recess 350 of the body 310 of the support 300 and retained in that recess via a retaining bracket (not shown for clarity). A strap-receiving opening (not labeled) is defined between the bottom of the gate 1010 and the top surface of the foot 320 of the support 300. The gate 1010 is movable relative to the support 300 between a home position (FIGS. 8A and 8B) and a retracted position (FIGS. 9A and 9B). When in the home position, the gate 1010 is positioned relative to the foot 320 so the height H1 of the strap-receiving opening is equal to or just larger than the thickness of the particular strap to-be-tensioned and sealed. When in the retracted position, the gate 1010 is positioned relative to the foot 320 so the height H2 of the strap-receiving opening is larger than the height H1.

The position of the tensioning assembly 400 controls the position of the gate 1010 via the linkages 1012, 1014, and 1016. The linkage 1016 is fixedly connected at one end to the tensioning assembly 400 and pivotably connected at the other end to one end of the linkage 1014. The other end of the linkage 1014 is pivotably connected to one end of the linkage 1012. The other end of the linkage 1012 is fixedly connected to the gate 1010. The linkages 1012, 1014, and 1016 are sized, shaped, positioned, oriented, and otherwise configured such that: (1) when the tensioning assembly 400 is in the strap-tensioning position, the gate 1010 is in its home position (and the strap-receiving opening has the height H1); and (2) when the tensioning assembly 400 is in its strap-insertion position, the gate 1010 is in its retracted position (and the strap-receiving opening has the height H2). More specifically, when the tensioning assembly 400 is pivoted from the strap-tensioning position to the strap-insertion position, the linkage 1016 is pivoted counter-clockwise (from the viewpoint shown in FIGS. 8A-9B). This causes the linkage 1014 to pivot clockwise, which forces the linkage 1012 to move upward and carry the gate 1010 with it.

One issue with certain known strapping tools is that it is difficult to insert the strap into the strapping tools. These known strapping tools include a gate positioned forward of the tension wheel so the seal engages the gate during the tensioning cycle and so the gate prevents the seal from contacting the tension wheel. The gate is fixed in place and positioned so the strap-receiving opening defined between the bottom of the gate the top of the foot of the strapping tool (on which the strap is positioned during operation) has the same height as or a height slightly larger than the thickness of the strap. This prevents the strap from moving up and down during operation of the strapping tool. The problem is that it is difficult and time-consuming for operators to align the strap with the strap-receiving opening to insert the strap into the strap-receiving opening that has a height that at best is slightly larger than the strap is thick.

The gate assembly of the present disclosure solves this problem by increasing the height of the strap-receiving opening when the tensioning assembly is moved to its strap-insertion position. In other words, the tensioning assembly is coupled to the gate (via the linkages) so movement of the tensioning assembly from the strap-tensioning position to the strap-insertion position causes the gate to move from its home position to its retracted position to enlarge the strap-receiving opening. This makes it easier for the operator to insert the strap into the strap-receiving opening, which streamlines operation of the strapping tool.

The position of the gate 1010 relative to the foot 320 is also variable. Specifically, the gate 1010 can be fixed to the linkage 1012 in any of several different vertical positions. By changing the vertical position of the gate 1010 relative to the linkage 1012, the operator can vary the height H1 of the strap-receiving opening when the gate 1010 is in the home position. For instance, in this embodiment, the linkage 1012 is connected to the gate 1010 via a screw. The screw extends through an elongated slot that extends along the length of the gate 1010. To change the height H1 of the strap-receiving opening when the gate 1010 is in its home position, the operator loosens the screw, slides the gate 1010 up or down relative to the linkage 1012 (taking advantage of the slot), and re-tightens the screw.

One issue with certain known strapping tools is that it is time-consuming to reconfigure the strapping tools for use with straps of different thicknesses. To reconfigure a strapping tool for use with a strap having a different thickness, the operator must replace the existing gate with another gate sized for use with the new strap (e.g., a gate that is longer (for thinner strap) or shorter (for thicker strap)). This requires the operator to partially disassemble the strapping tool, which not only causes downtime but also requires operators to keep the different gates on hand, recognize when a different gate is needed, and properly match the gates to the different strap thicknesses. Using the incorrect gate could result in a failed or suboptimal strapping operation (and in the latter case, suboptimal joint strength).

The gate assembly 1000 of the present disclosure solves this problem by enabling the operator to vary the position of the gate 1010 relative to the linkage 1012 and therefore the height H1 of the strap-receiving opening when the gate 1010 is in its home position. This improves upon prior art strapping tools by enabling the operator to quickly and easily move the gate to accommodate straps of different thicknesses without having to swap out one gate for another.

The sealing assembly 500, which is best shown in FIGS. 15A-20C, is configured to attach overlapping portions of the strap to one another to form a tensioned strap loop around the load during the sealing cycle by notching both a seal element positioned around the overlapping portions of the strap and the overlapping portions of the strap themselves. The sealing assembly 500 includes a front cover 502, a back cover 506, a jaw assembly 520, an object-blocking assembly 600, and an object-blocker-lift element 630.

The front cover 502 is generally U-shaped. The back cover 506 includes a generally planar base 506*a*, two mounting wings 506*b* and 506*c* extending rearward and inward from opposing lateral ends of the base 506*a*, and a lip 506*d* extending forward from the base 506*a* toward the jaw assembly 520. The object-blocker-lift element 630 is pivotably mounted to the base 506*a* via a pivot pin 640 and configured to rotate about the pivot pin 640, as described in more detail below in conjunction with the object-blocking assembly 600. The front cover 502 and the back cover 506 are connected to one another via one or more suitable fasteners (not labeled) and cooperate to partially enclose the jaw assembly 520, the object-blocking assembly 600, and the object-blocker-lift element 630.

Figure 19A:
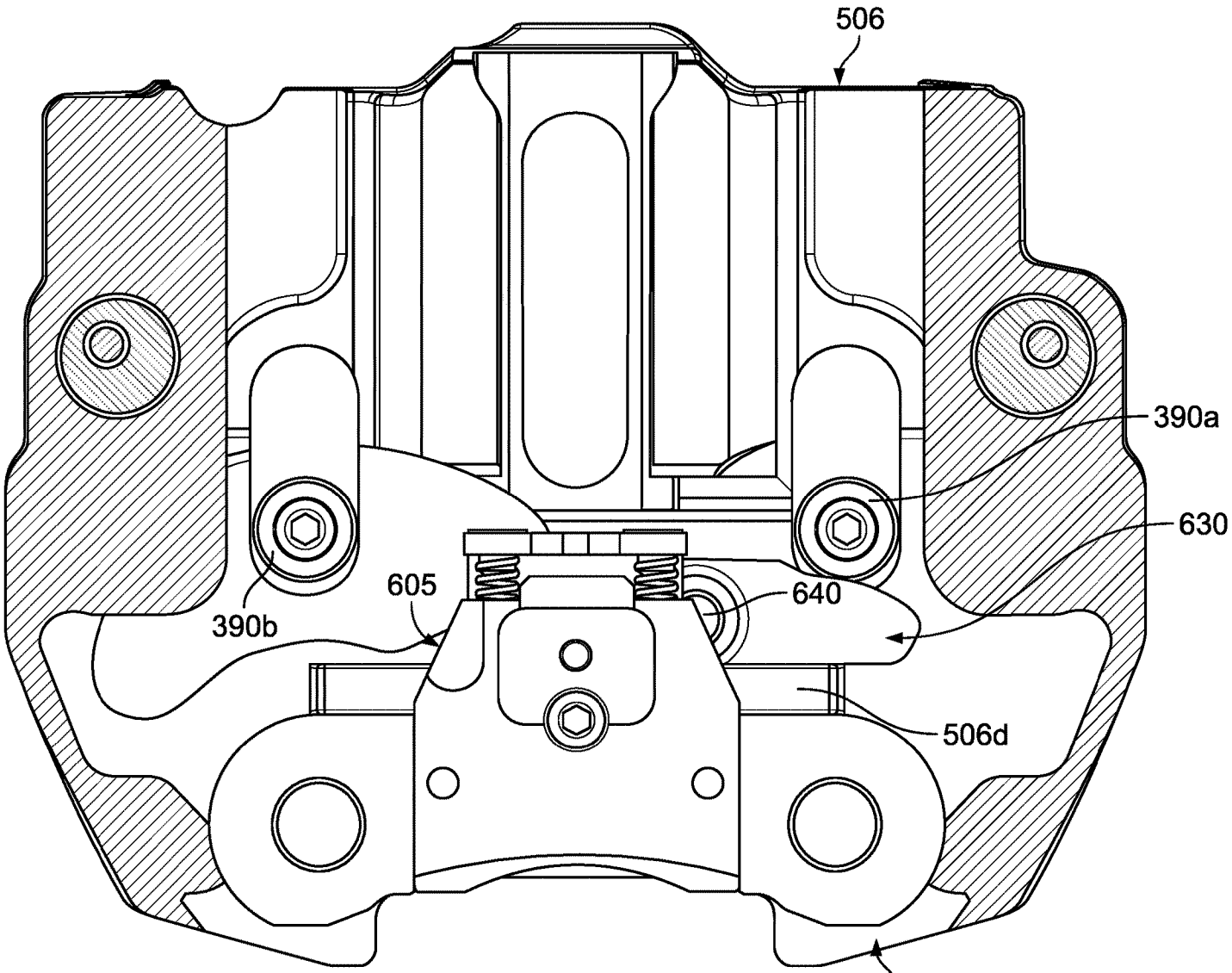
FIG. 19A is a cross-sectional elevational view of part of the sealing assembly of FIG. 15A showing the sealing assembly in its home position and the object blocker of the object-blocking assembly of FIG. 16A in its retracted position. Some components of the sealing assembly are not shown for clarity.
Figure 19B:
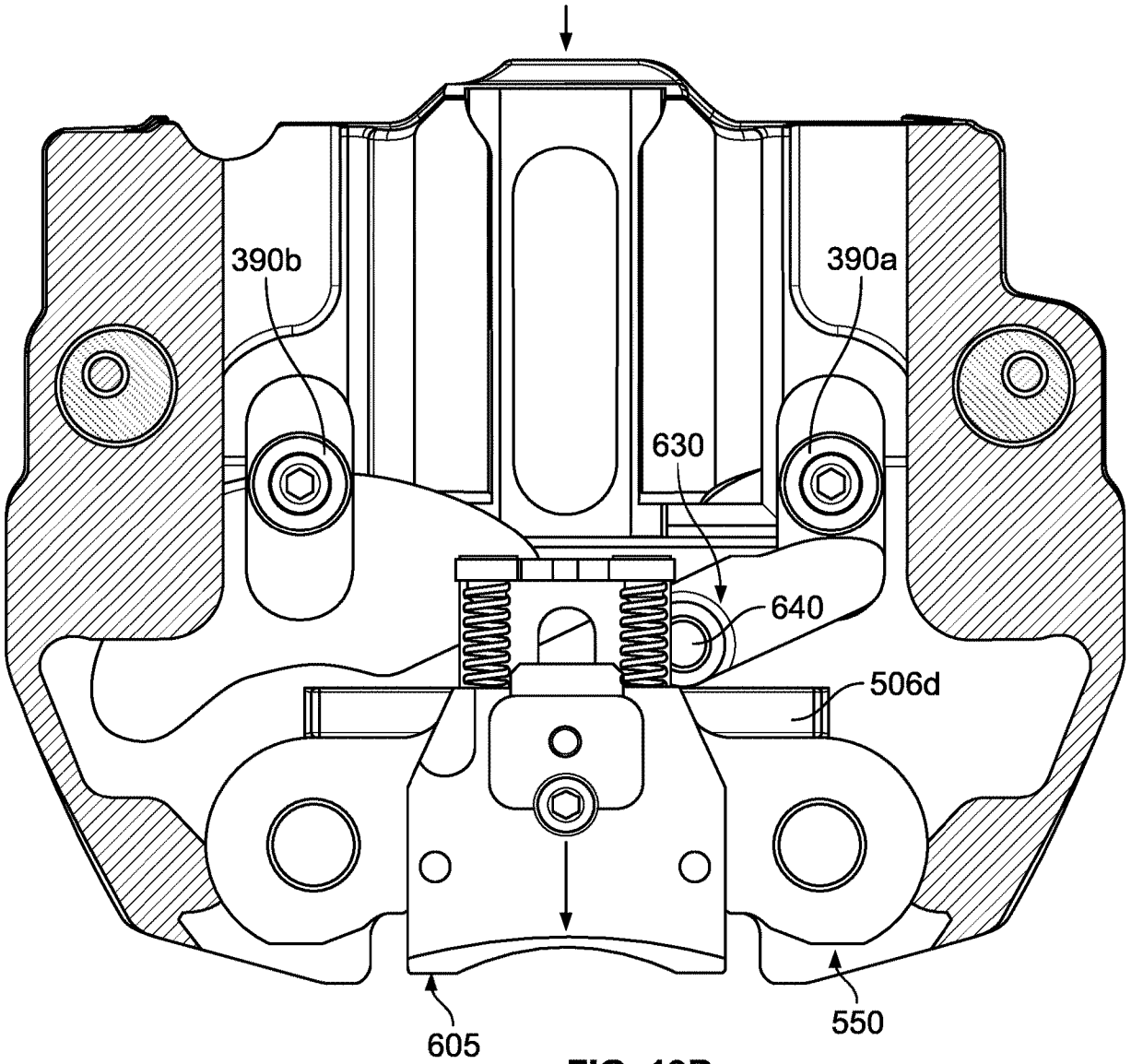
FIG. 19B is a cross-sectional elevational view of part of the sealing assembly of FIG. 6A showing the sealing assembly moved about halfway from its home position to its sealing position and the object blocker of the object-blocking assembly of FIG. 16A in its blocking position. Some components of the sealing assembly are not shown for clarity.

The sealing assembly 500 is movably (and more particularly, slidably) mounted to the support 300 via the back cover 506. Specifically, the back cover 506 is positioned so the first and second sealing-assembly-mounting tongues 372*a* and 372*b* of the support 300 are received in a groove defined between the base 506*a* and the first mounting wing 506*b* and so the third and fourth sealing-assembly-mounting tongues 374*a* and 374*b* of the support 300 are received in a groove defined between the base 506*a* and the second mounting wing 506*c*. This mounting configuration enables the sealing assembly 500 to move vertically relative to the support 300 and prevents the sealing assembly 500 from moving side-to-side or forward and rearward relative to the support 300. As best shown in FIGS. 19A and 19B, laterally-spaced-apart first and second sealing-assembly-mounting elements 390*a* and 390*b* are fixedly attached to the body 310 of the support 300 and extend through respective vertically-extending slots (not labeled) defined through the base 506*a* of the back cover 506. These slots and sealing-assembly-mounting elements 390*a* and 390*b* co-act to constrain the vertical movement of the sealing assembly 500 relative to the support 300 between a (upper) home position (FIGS. 19A and 28A) at which the sealing-assembly-mounting elements 390*a* and 390*b* are at the lower ends of the slots and a (lower) sealing position (FIGS. 19B, 28B, and 28C) at which the sealing-assembly-mounting elements 390*a* and 390*b* are at the upper ends of the slots. As explained below, the drive assembly 700 controls movement of the sealing assembly 500 between its home and sealing positions.

Figure 15A:
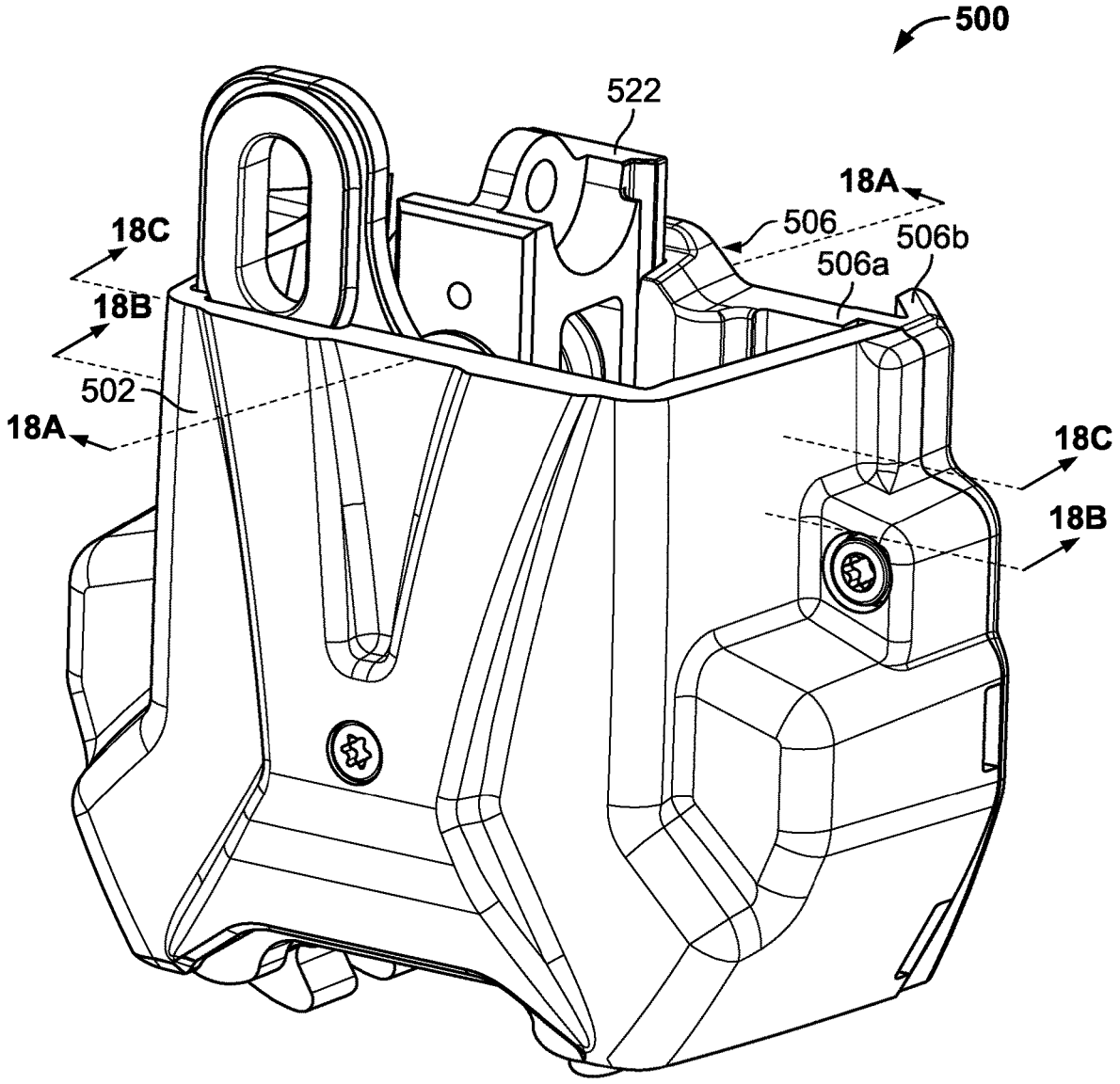
FIGS. 15A and 15B are perspective views of the sealing assembly of the working assembly of FIG. 3A.
Figure 15B:
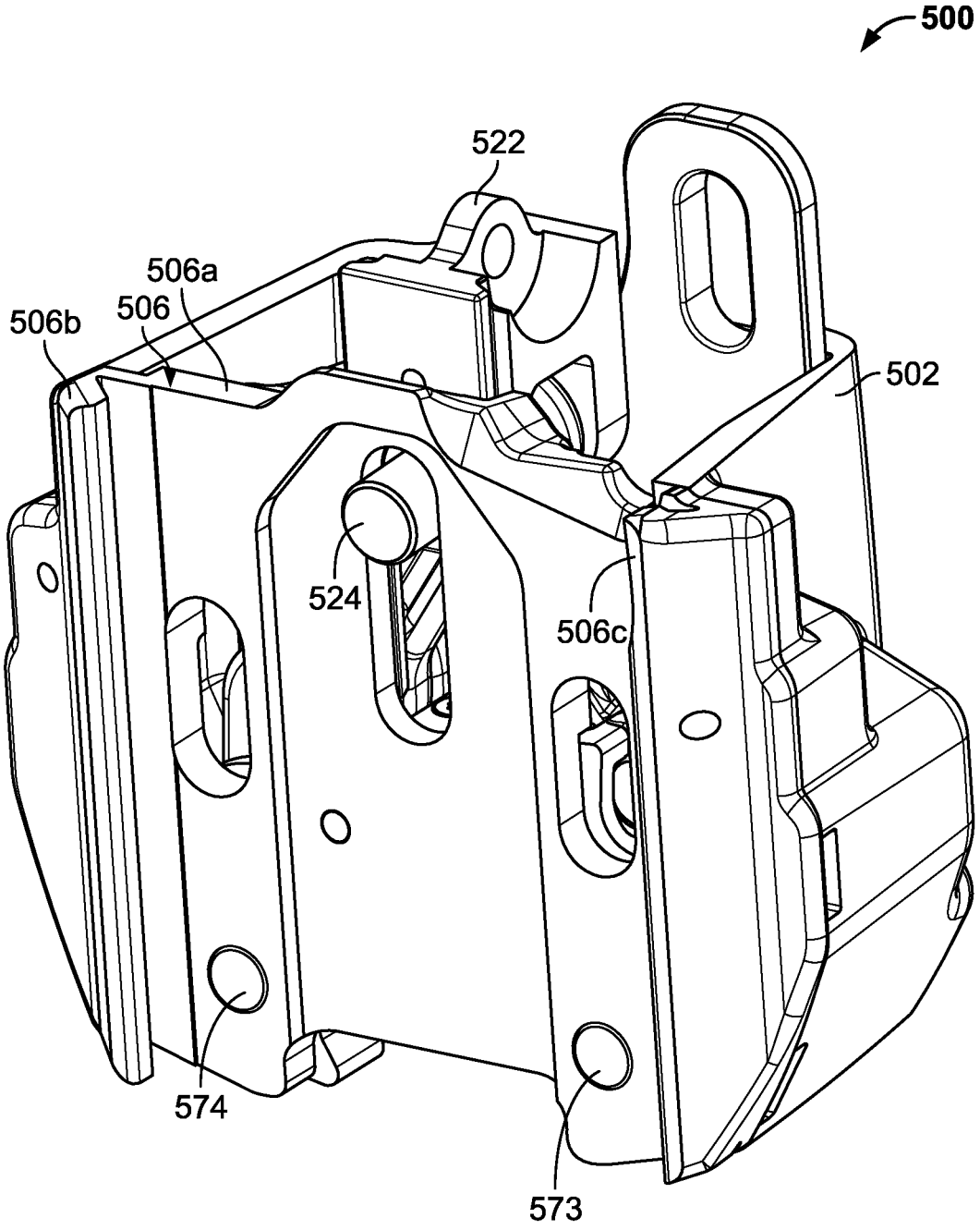
Figure 15C:
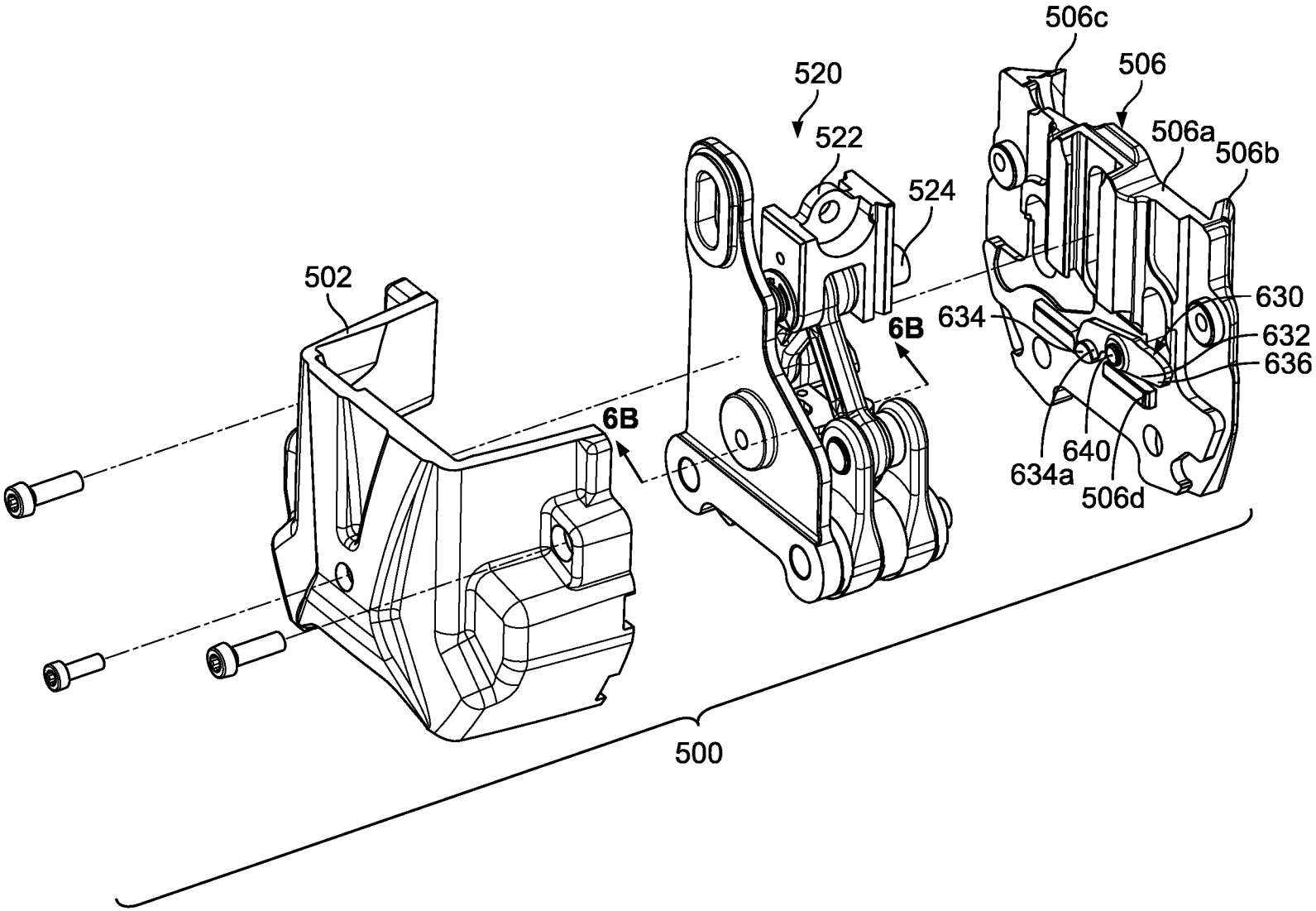
FIGS. 15C and 15D are a partially exploded perspective views of the sealing assembly of FIG. 15A.
Figure 15D:
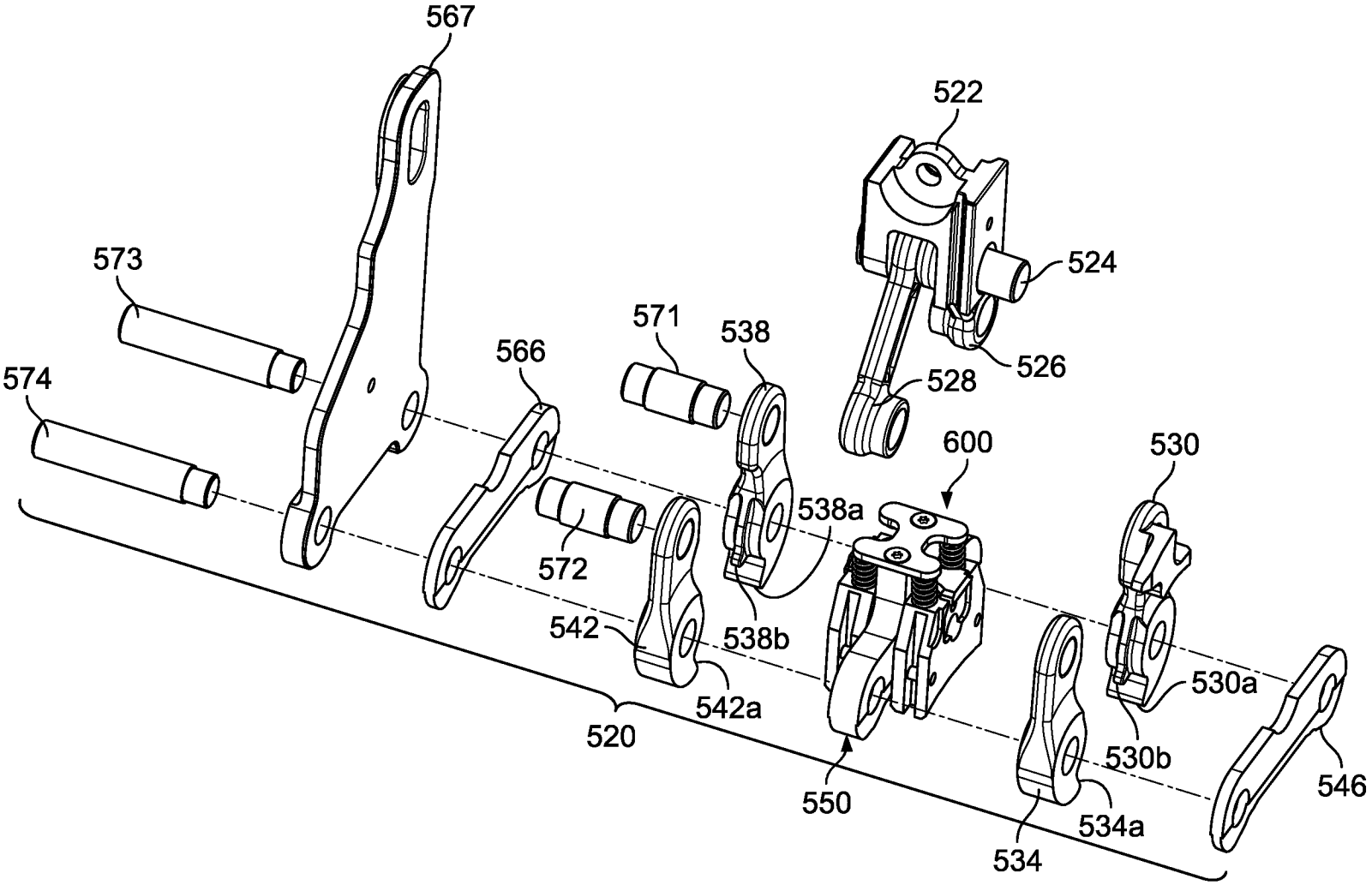

As best shown in FIGS. 15C and 15D, the jaw assembly 520 includes a coupler 522, a coupler pivot 524, first and second coupler/jaw linkages 526 and 528, a first jaw 530, a second jaw 534, a third jaw 538, a fourth jaw 542, a first jaw connector 546, a second jaw connector 550, a third jaw connector 566, a fourth jaw connector 567, first and second upper jaw pivots 571 and 572, and first and second lower jaw pivots 573 and 574. The first and second jaws 530 and 534 form a pair of opposing inner jaws, and the third and fourth jaws 538 and 542 form a pair of opposing outer jaws.

The first and second coupler/jaw linkages 526 and 528 are each pivotably connected to the coupler 522 near their respective upper ends via the coupler pivot 524. This pivotable connection enables the first and second coupler/jaw linkages 526 and 528 to pivot relative to the coupler 522 and the coupler pivot 524 about a longitudinal axis of the coupler pivot 524 (not shown). Here, the coupler pivot 524 includes a pivot pin retained via a retaining ring (not labeled), though it may be any other suitable pivot in other embodiments. As best shown in FIG. 15B, the rear end of the coupler pivot 524 is positioned in a slot (not labeled) defined in the back cover 506 so the slot limits the coupler pivot 524 to moving vertically between an upper and a lower position.

The respective upper portions of each of the first and second jaws 530 and 534 are pivotably connected to the respective lower ends of the coupler/jaw linkages 526 and 528 via the upper jaw pivots 571 and 572, respectively. The respective upper portions of each of the third and fourth jaws 538 and 542 are pivotably connected to the respective lower ends of the coupler/jaw linkages 526 and 528 via the upper jaw pivots 571 and 572, respectively. These pivotable connections enable the first inner and outer jaws 530 and 538 to pivot relative to the coupler/jaw linkage 526 about a longitudinal axis of the upper jaw pivot 571 (not shown) and the second inner and outer jaws 534 and 542 to pivot relative to the coupler/jaw linkage 528 about a longitudinal axis (not shown) of the upper jaw pivot 571.

Figure 28A:
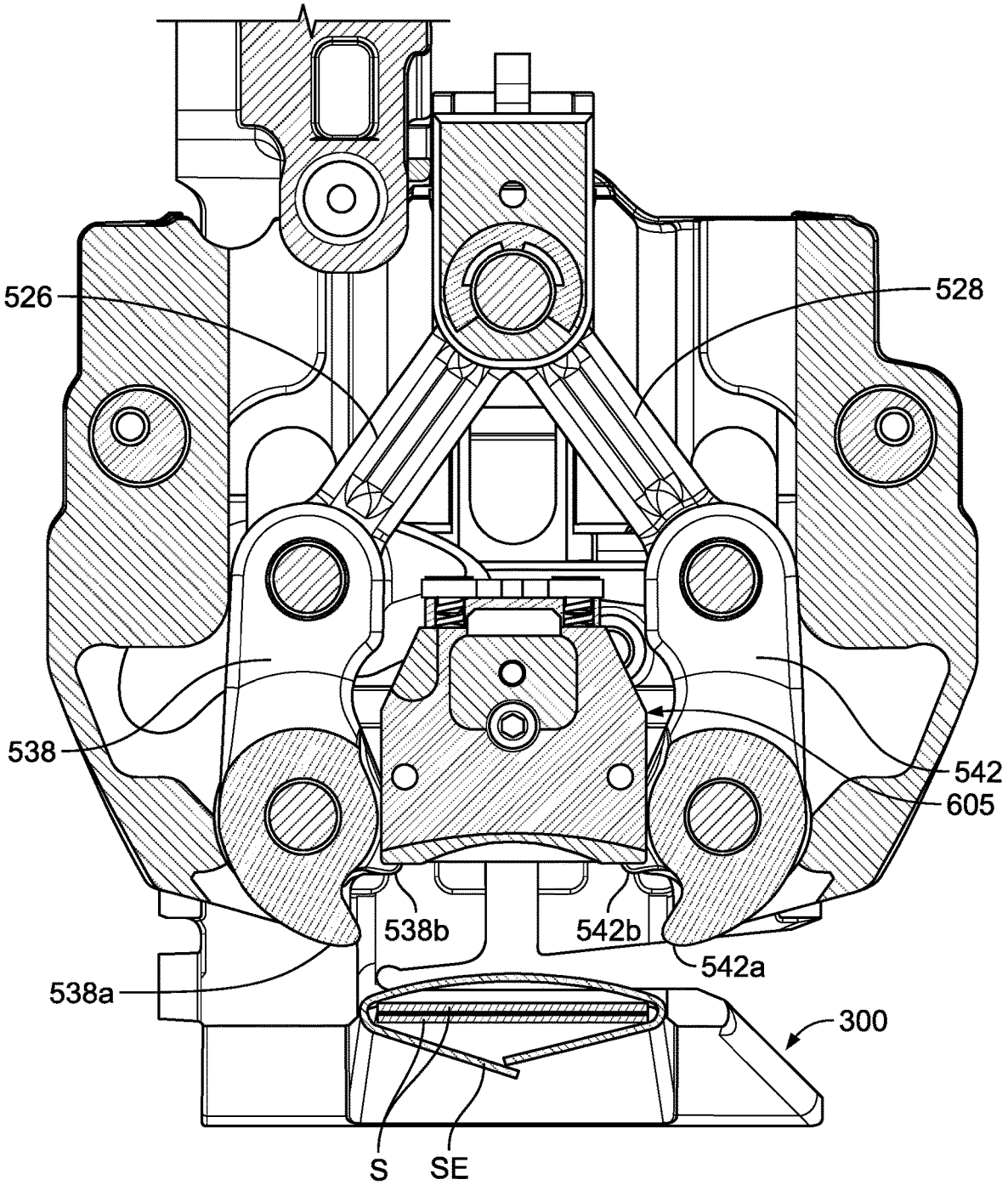
FIG. 28A is a cross-sectional elevational view of part of the support of FIG. 2 and part of the sealing assembly of FIG. 15A with the sealing assembly and the jaws in their home positions.
Figure 28B:
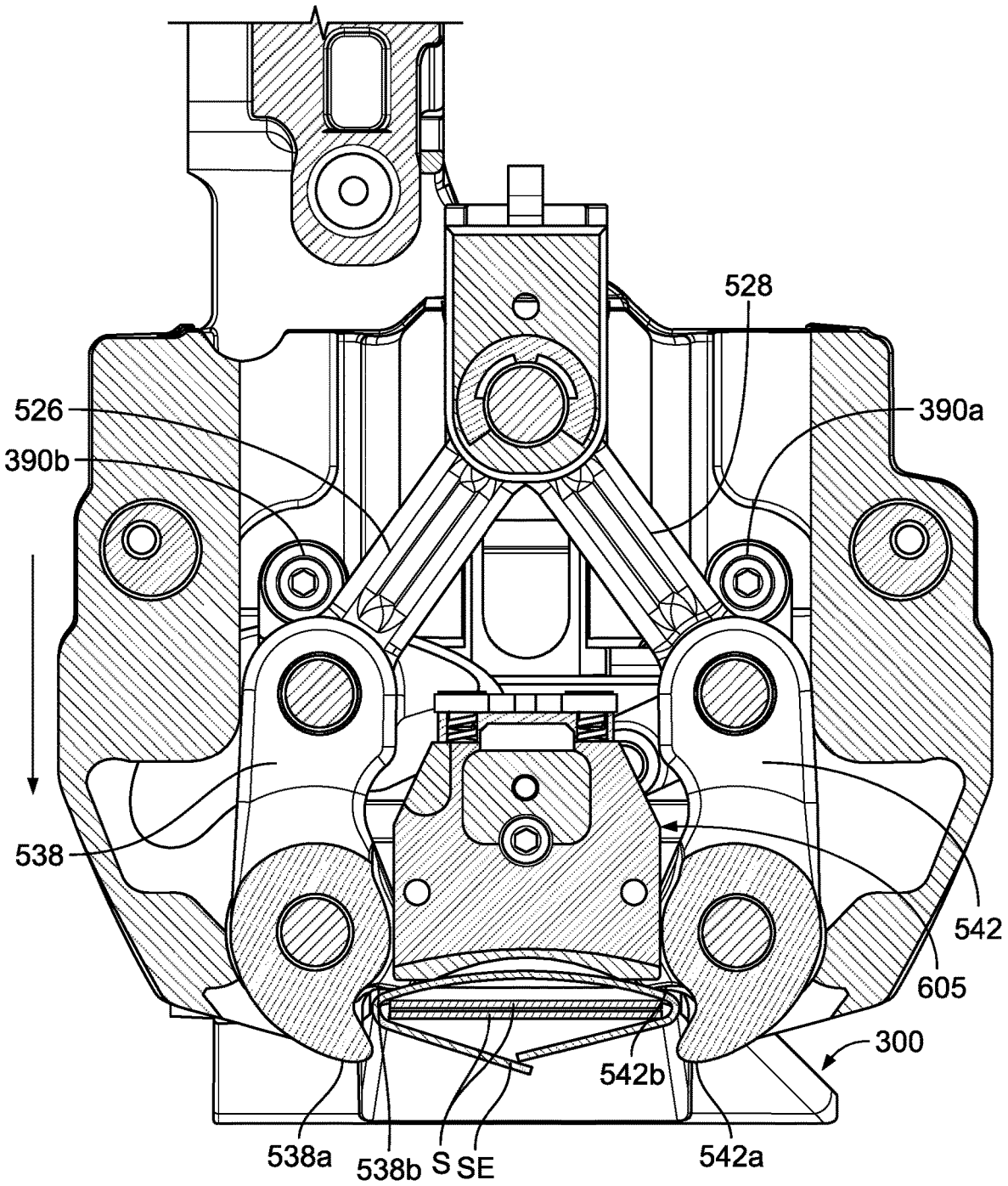
FIG. 28B is a cross-sectional elevational view of the part of the support of FIG. 2 and the part of the sealing assembly of FIG. 15A with the sealing assembly in its sealing position and the jaws in their home positions.
Figure 28C:
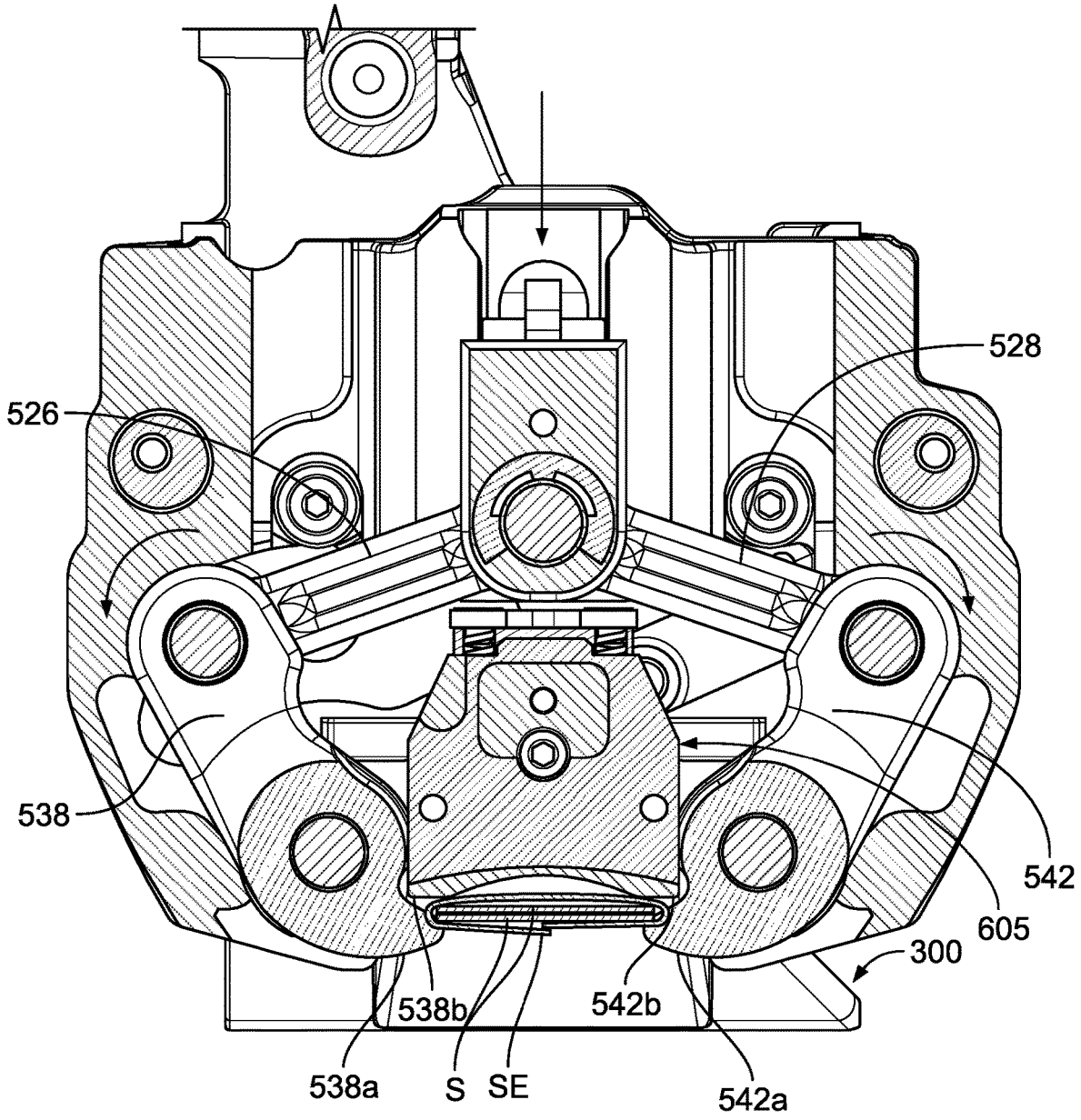
FIG. 28C is a cross-sectional elevational view of the part of the support of FIG. 2 and the part of the sealing assembly of FIG. 15A with the sealing assembly in its sealing position and the jaws in their sealing positions after cutting notches in the seal element and the strap.

The respective lower portions of each of the first and second jaws 530 and 534 are pivotably connected by the lower jaw pivots 573 and 574 to the first jaw connector 546, the second jaw connector 550, the third jaw connector 566, and the fourth jaw connector 567. The respective lower portions of each of the third and fourth jaws 538 and 542 are pivotably connected by the lower jaw pivots 573 and 574 to the first jaw connector 546, the second jaw connector 550, the third jaw connector 566, and the fourth jaw connector 567. The pivotable connections enable the first and third jaws 530 and 538 to pivot relative to the jaw connectors 546, 550, 566, and 567 about a longitudinal axis (not shown) of the lower jaw pivot 573 between respective home positions (FIG. 28A) and sealing positions (FIG. 28C). The pivotable connections enable the second and fourth jaws 534 and 542 to pivot relative to the jaw connectors 546, 550, 566, and 567 about a longitudinal axis (not shown) of the lower jaw pivot 574 between respective home positions (FIG. 28A) and sealing positions (FIG. 28C).

Figure 18A:
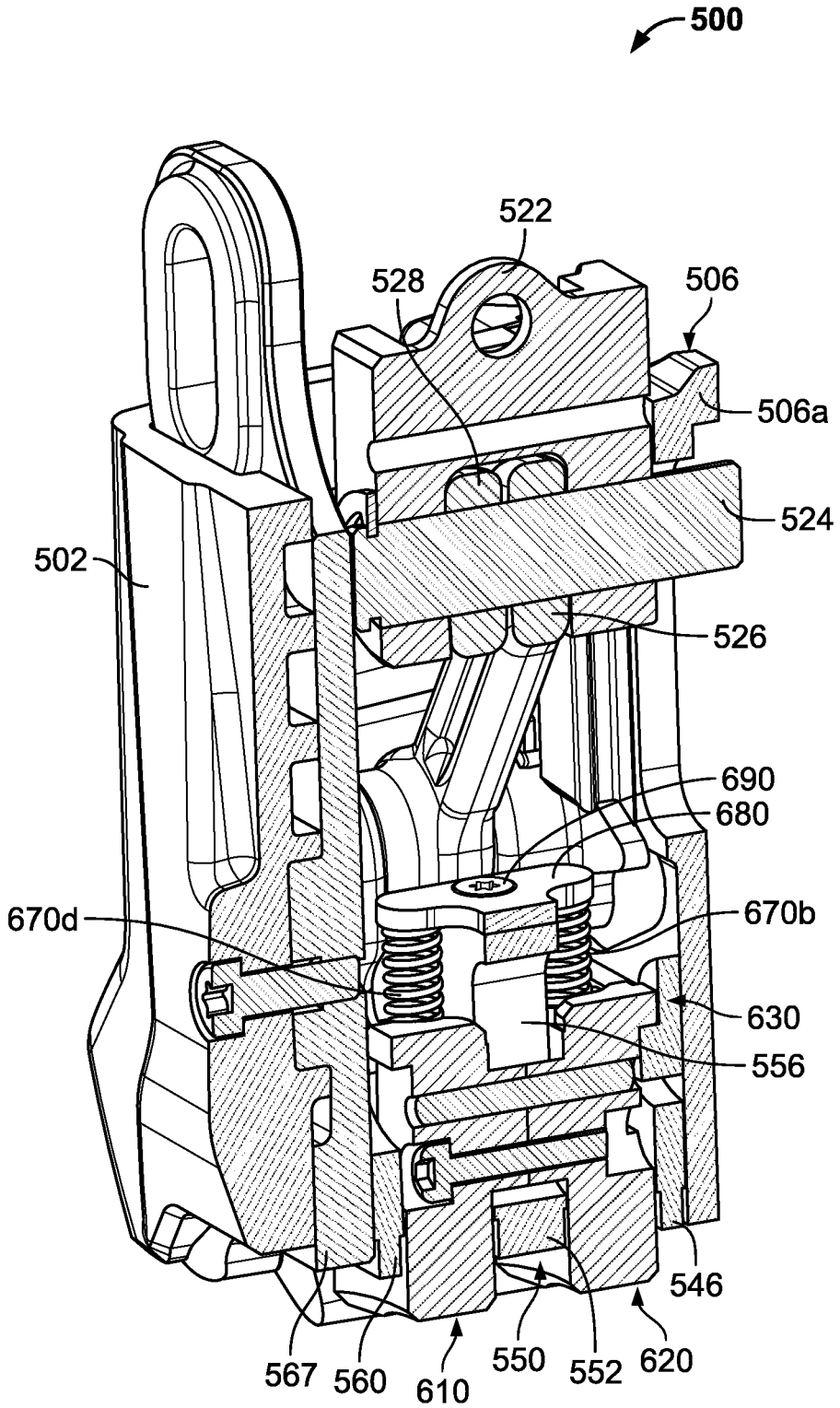
FIG. 18A is a cross-sectional perspective view of the sealing assembly of FIG. 15A taken substantially along line 18A-18A of FIG. 15A.
Figure 18B:
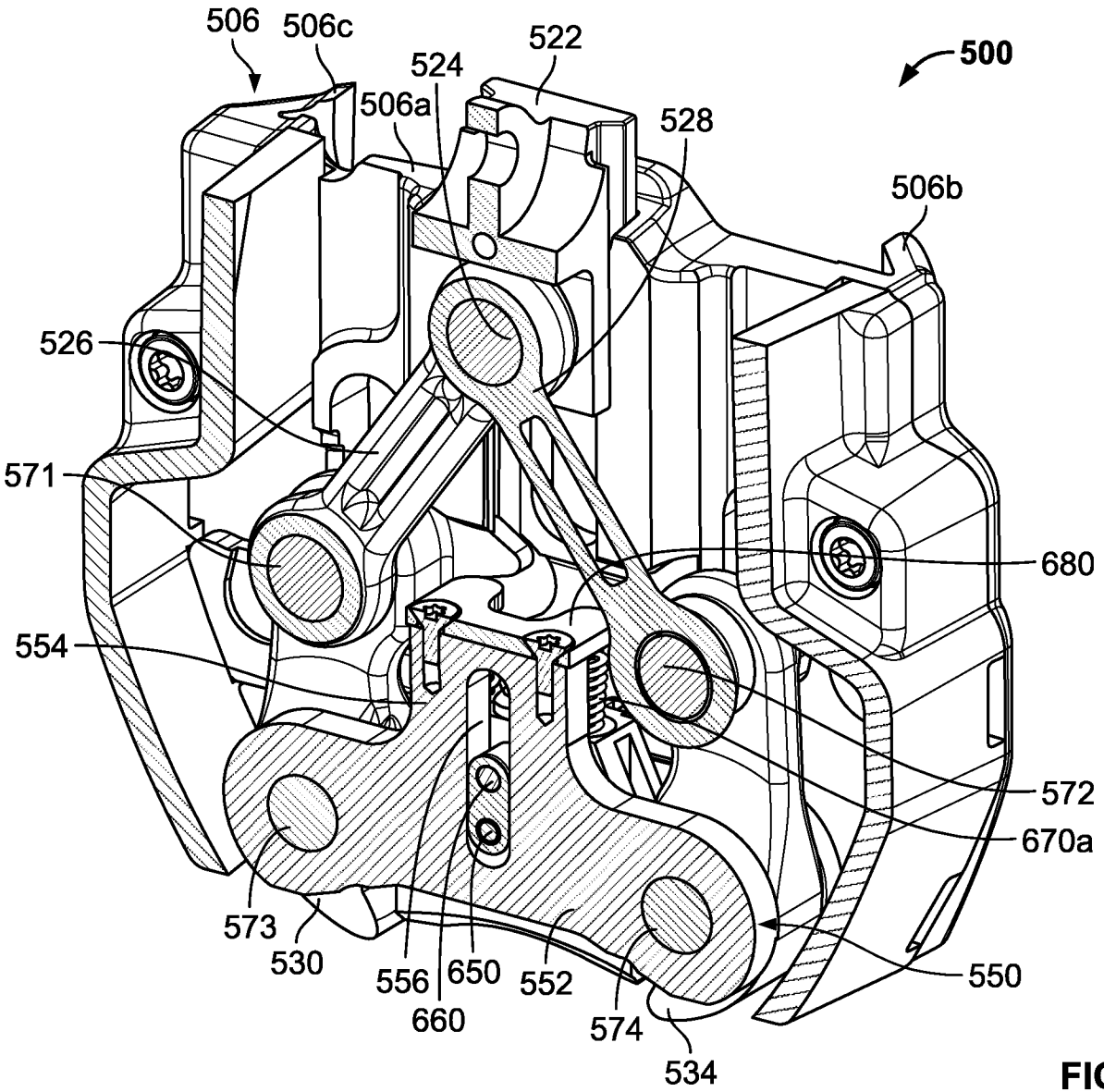
FIG. 18B is a cross-sectional perspective view of the sealing assembly of FIG. 15A taken substantially along line 18B-18B of FIG. 15A.
Figure 18C:
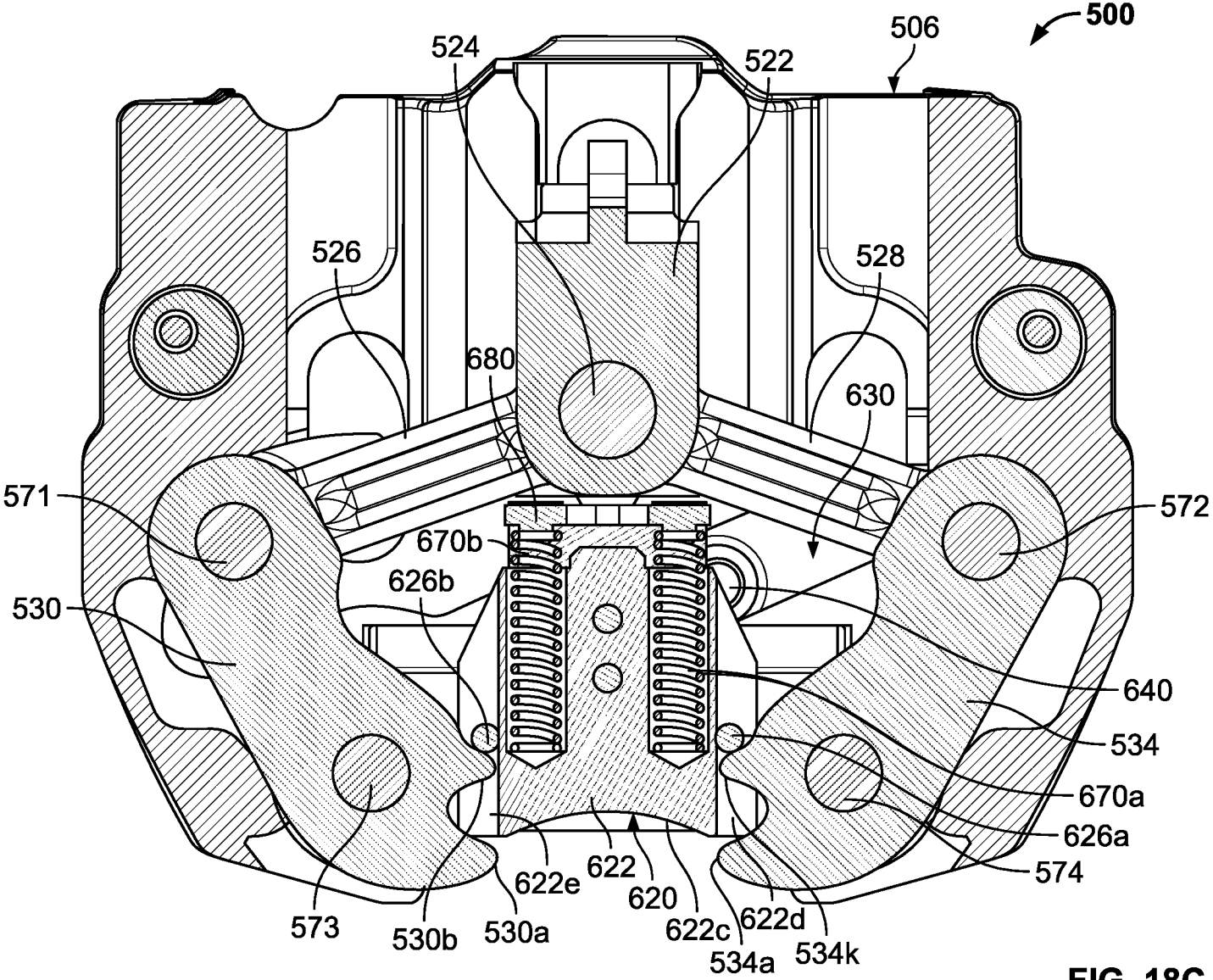
FIG. 18C is a cross-sectional elevational view of the sealing assembly of FIG. 15A taken substantially along line 18C-18C of FIG. 15A.

As best shown in FIGS. 15D and 18C, each jaw has a lower tooth that cuts a notch in the seal element and the overlapping portions of the strap during the sealing cycle and an upper tooth that engages an object blocker 605 of the object-blocking assembly 600 (described below) if the object blocker 605 is in its blocking position (described below) at the start of the sealing cycle and moves the object blocker 605 toward its retracted position as the jaws move to their respective sealing positions. This prevents the jaws from damaging the object blocker 605. More specifically, the first jaw 530 has a lower tooth 530*a* and an upper tooth 530*b*, the second jaw 534 has a lower tooth 534*a* and an upper tooth 534*b*, the third jaw 538 has a lower tooth 538*a* and an upper tooth 538*b*, and the fourth jaw 542 has a lower tooth 542*a* and an upper tooth 542*b*.

Figure 16A:
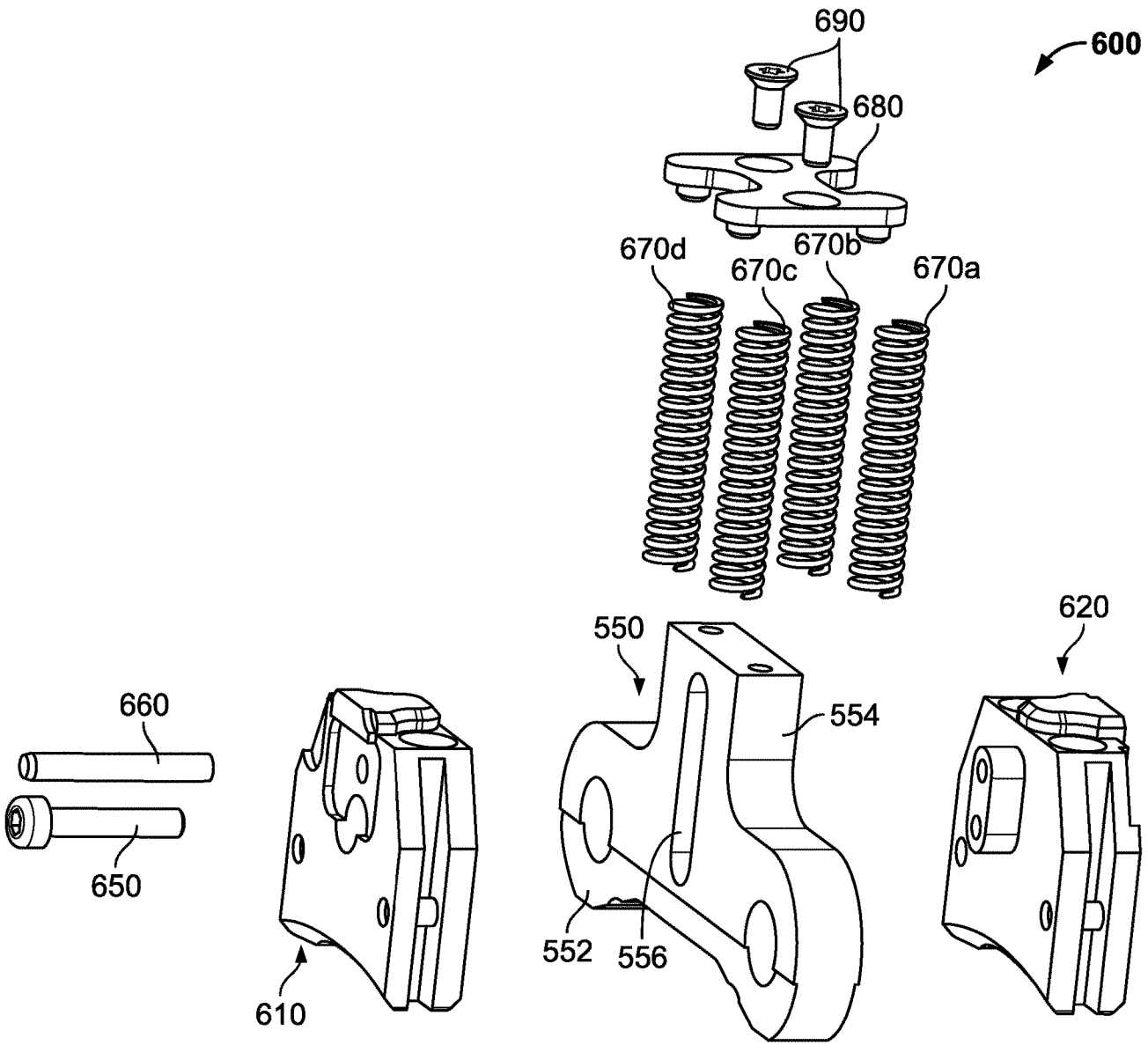
FIG. 16A is an exploded perspective view of the object-blocking assembly of the jaw assembly of the sealing assembly of FIG. 15A.
Figure 16B:
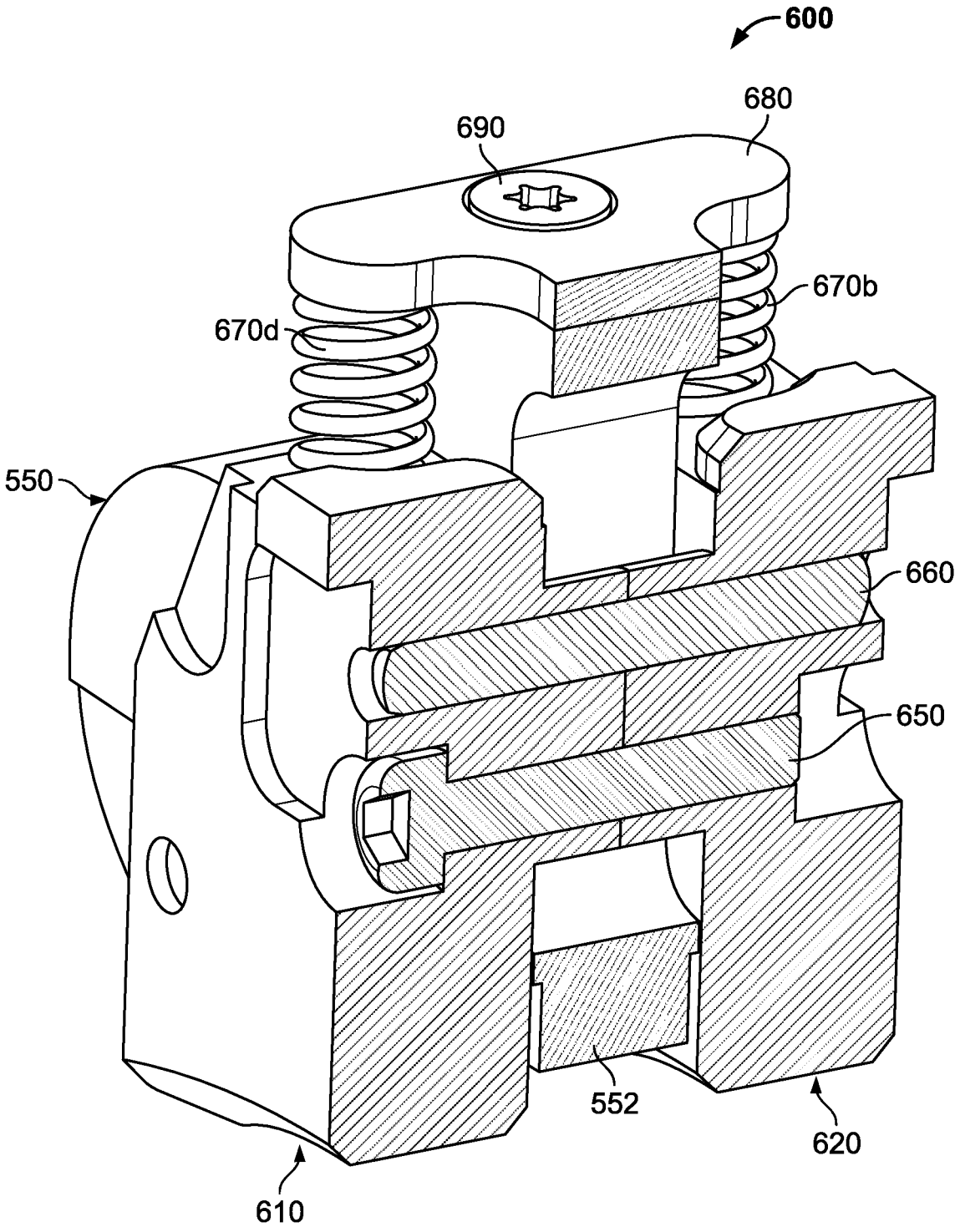
FIG. 16B is a cross-sectional perspective view of the object-blocking assembly of FIG. 16A taken substantially along the line 16B-16B of FIG. 15C.

The object-blocking assembly 600 is mounted to the jaw assembly 520 (and more particularly, to the second jaw connector 550) and configured to prevent objects from inadvertently entering the space between the first and second jaws 530 and 534 and the third and fourth jaws 538 and 542. This space is sometimes referred to herein as the "seal-element-receiving space." This reduces the possibility of an object interfering with the operation of the strapping tool. This also prevents the jaws of the strapping tool from damaging the object (or vice-versa). As best shown in FIGS. 16A and 16B, the object-blocking assembly 600 includes an object blocker 605 formed from a first object blocker portion 610 and a second object blocker portion 620; an object-blocker fastener 650; an pin 660; multiple biasing elements 670*a*, 670*b*, 670*c*, and 670*d*; a biasing-element retainer 680; and multiple fasteners 690.

Figure 17B:
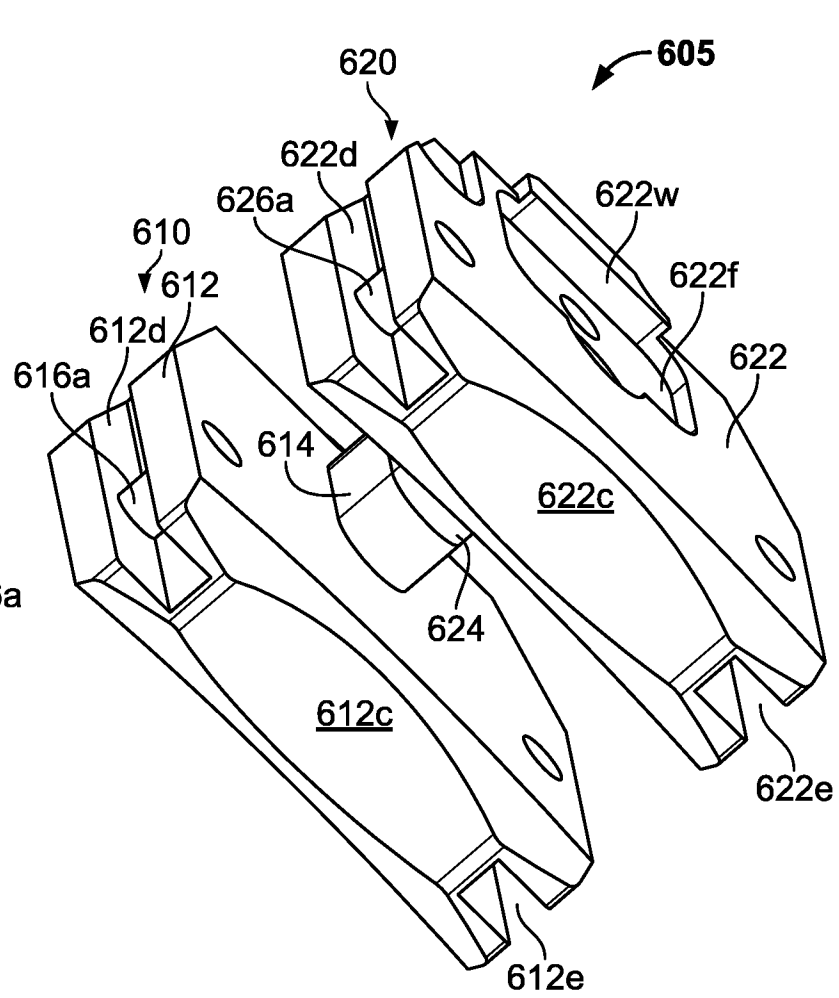
FIGS. 17A and 17B are perspective views of an object blocker of the object-blocking assembly of FIG. 16A.
Figure 17A:
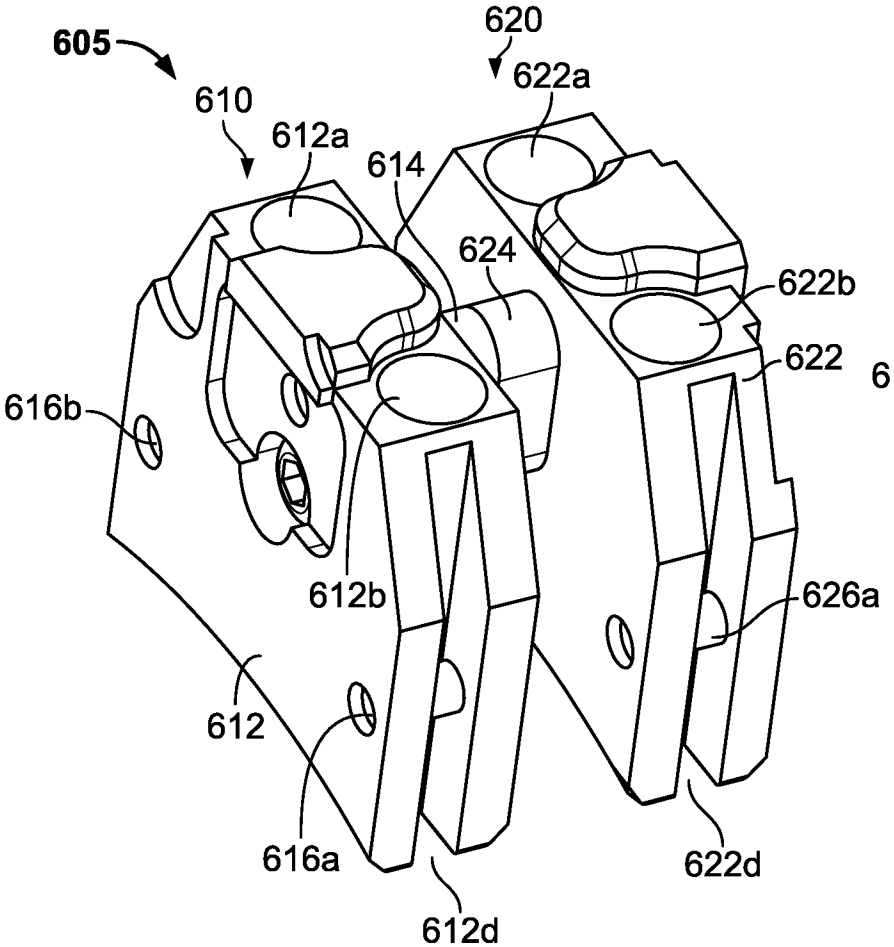

The object blocker 605 is best shown in FIGS. 17A and 17B and is formed from the first object blocker portion 610 and the second object blocker portion 620 joined by the object-blocker fastener 650 and the pin 660. The first object blocker portion 610 includes a body 612 and a mating lug 614 extending from a rear surface of the body 612. The body 612 defines cylindrical biasing-element-receiving bores 612*a* and 612*b* that extend downward from an upper surface of the body 612. The biasing-element-receiving bores are sized, shaped, oriented, and otherwise configured to partially receive the biasing elements 670*d* and 670*c*, respectively. The underside of the body 612 includes a curved object-engaging surface 612*c* (though this surface may be planar in other embodiments). Opposing side surfaces of the body 612 define vertically extending slots 612*d* and 612*e*. Tooth-engaging pins 616*a* and 616*b* are received in bores defined in the body 612 from front to back and are positioned to extend across the slots 612*d* and 612*e*, respectively.

The second object blocker portion 620 includes a body 622 and a mating lug 624 extending from a front surface of the body 622. The body 622 defines cylindrical biasing-element-receiving bores 622*a* and 622*b* that extend downward from an upper surface of the body 622. The biasing-element-receiving bores are sized, shaped, oriented, and otherwise configured to partially receive the biasing elements 670*b* and 670*a*, respectively. The underside of the body 622 includes a curved object-engaging surface 622*c* (though this surface may be planar in other embodiments). Opposing side surfaces of the body 622 define vertically extending slots 622*d* and 622*e*. Tooth-engaging pins 626*a* and 626*b* are received in bores defined in the body 612 from front to back and are positioned to extend across the slots 622*d* and 622*e*, respectively.

The object blocker 605 is slidably mounted to the second jaw connector 550. More specifically, as best shown in FIGS. 16A and 16B, the second jaw connector 550 includes a body 552 and a neck 554 extending upward from a center of the body 552. The body 552 and the neck 554 define an object-blocker-mounting slot 556 therethrough. The object blocker 605 is assembled such that the mounting elements 614 and 624, the object-blocker fastener 650, and the pin 660 extend through the object-blocker-mounting slot 556. After assembly, the object blocker 605 is vertically movable relative to the second jaw connector 550 (and constrained by the size of the object-blocker-mounting slot 556) between a (upper) retracted position (FIG. 19A) and a (lower) blocking position (FIG. 19B). The biasing-element retainer 680 is attached to the neck 554 of the second jaw connector 550 via the fasteners 690 to constrain the biasing elements 670*a*, 670*b*, 670*c*, and 670*d* in place in their respective biasing-element-receiving bores 622*b*, 622*a*, 612*b*, and 612*a* in the object blocker 605. The biasing elements 670 bias the object blocker 605 to its blocking position.

The object-blocker-lift element 630 is operably engageable with the object blocker 605 to maintain the object blocker 605 in its retracted position when the sealing assembly 500 is in its home position to prevent the object blocker 605 from interfering with the seal element and the strap during strap insertion and strap tensioning. In this example embodiment and as best shown in FIG. 15C, the object-blocker-lift element 630 includes a body 632 with an object-blocker engager 634 at one end and an opposing free end 636. As noted above, the object-blocker-lift element 630 is pivotably mounted to the back cover 506 via the pivot pin 640. The object-blocker-lift element 630 is pivotable relative to the object blocker 605 about a longitudinal axis of the pivot pin 640 (not shown). The object-blocker engager 634 is received in a recess 622*f* (FIG. 17B) that is defined in the second object blocker portion 620 of the object blocker 605 and that is partially defined by an upper wall 622*w* of the second object blocker portion 620. As best shown in FIGS. 19A and 19B, the free end 636 is positioned between the first sealing-assembly-mounting element 390*a* and the lip 506*d* of the back cover 506. The object-blocker-lift element 630 is pivotable relative to the remainder of the sealing assembly 500 between a home position (FIG. 19B) and a lifting position (FIG. 19A).

The object-blocker-lift element 630 is positioned and configured such that the position of the object-blocker-lift element 630 in part controls the position of the object blocker 605. Specifically, when the object-blocker-lift element 630 is in the lifting position, the object-blocker-lift element 630 imparts a force on the object blocker 605 that overcomes the biasing force of the biasing elements 670 and maintains the object blocker 605 in its retracted position. Specifically, a surface 634*a* of the object-blocker engager 634 imparts the force on the upper wall 622*w* of the second object blocker portion 620. Conversely, when the object-blocker-lift element 630 is in its home position, it does not impart this force on the object blocker 605, and the object blocker 605 can move between its retracted and blocking positions. The biasing elements 670 bias the object-blocker-lift element 630 to its home position (i.e., in this embodiment, biases the upper wall 622*w* into contact with the surface 634*a*).

The position of the sealing assembly 500 controls the position of the object-blocker-lift element 630 (and therefore, in part, the position of the object blocker 605). As best shown in FIG. 19A, when the sealing assembly 500 is in its home position, the first sealing-assembly-mounting element 390*a* engages the object-blocker-lift element 630 between its free end 636 and the pivot pin 640 and forces the object-blocker-lift element 630 into its lifting position. This in turn (and as explained above) forces the object blocker 605 into its retracted position. As the sealing assembly 500 moves from its home position to its sealing position, space is created between the lip 506*d* and the first sealing-assembly-mounting element 390*a*. As this space is created, the biasing elements 670 force the object blocker 605 to move toward its blocking position. This causes the object-blocker-lift element 630 to pivot so it maintains contact with the first sealing-assembly-mounting element 390*a*. FIG. 19B shows the object-blocker-lift element 630 and the object blocker 605 after they've reached their respective home and blocking positions.

When the object blocker 605 is in its blocking position and the jaws 530, 534, 538, and 542 are in their home positions, the object blocker 605 and the jaws are in a blocking configuration. When these components are in the blocking configuration, the object blocker 605 occupies most of the seal-element-receiving space (not labeled) defined between the pair of jaws 530 and 538 and the pair of jaws 534 and 542 and below the jaw connectors 546, 550, 566, and 567. As described in detail below, responsive to application of a force sufficient to overcome the biasing force of the biasing elements 670, the object blocker 605 moves from its blocking position to its retracted position and remains there until the force is removed. When in the retracted position, the object blocker 605 is not positioned in the seal-element-receiving space such that a seal element and strap can be positioned there for sealing.

If the sealing cycle (described below) is initiated with the object blocker 605 and the jaws 530, 534, 538, and 542 in the blocking configuration, the jaws are configured to move the object blocker 605 toward its retracted position to avoid damaging the jaw assembly 520 or any other component of the strapping tool 50 during the sealing cycle. Specifically, when the object blocker 605 is in its blocking position, the upper teeth 530*b*, 534*b*, 538*b*, and 542*b* of the jaws 530, 534, 538, and 542 are adjacent to the pins 626*b*, 626*a*, 616*b*, and 616*a* of the object blocker 605, respectively. As the jaws begin pivoting from their respective home positions to their respective sealing positions, the upper teeth engage their respective pins. Continued movement of the jaws to their respective sealing positions causes the upper teeth to apply sufficient force to the pins to overcome the biasing force of the biasing elements 670 and move the object blocker 605 toward its retracted position. As this occurs, the lower teeth enter the slots defined in the sides of the object blocker 605. FIG. 18C shows the jaws in their sealing positions after having moved the object blocker toward its retracted position.

One issue with certain known strapping tools that use jaws to crimp or notch the strap and (if applicable) the seal element is that a foreign object may (inadvertently) enter the space between the jaws instead of or in addition to the strap and (if applicable) the seal element. This is problematic for several reasons. The object may interfere with the operation of the strapping tool and cause the joint formed via the attachment of the overlapped strap portions to one another to have suboptimal strength, which could lead to unexpected joint failure and product loss. Additionally, the object could damage the jaws and/or other components of the sealing assembly during the sealing process, which would require tool repairs and cause downtime. Further, the sealing assembly could damage or destroy the object.

The object-blocking assembly of the present disclosure solves this problem by ejecting foreign objects from and by preventing foreign objects from inadvertently entering the seal-element-receiving space between the jaws. Specifically, if a loose foreign object—such as the shaft of a screwdriver—is in the seal-element-receiving space between the jaws as the sealing assembly reaches its sealing position, the object blocker will force that object out of the seal-element-receiving space as the object blocker moves from its retracted position to its blocking position. Once the object blocker reaches its blocking position, minimal space exists between the object blocker and the lower teeth of the jaws, thereby preventing foreign objects from entering the seal-element-receiving space between the jaws.

Figure 20A:
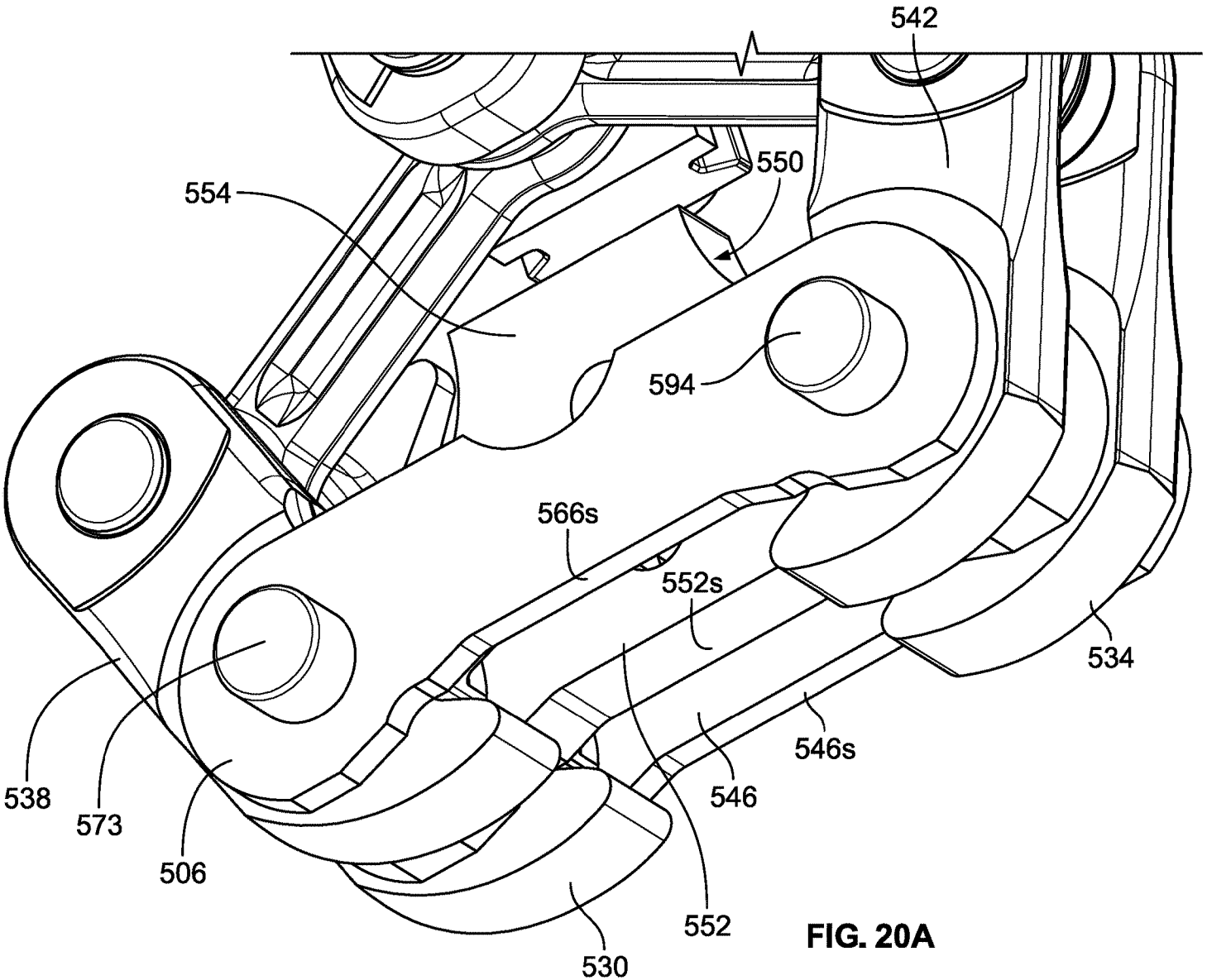
FIG. 20A is a perspective view of part of the sealing assembly of FIG. 15A.
Figure 20B:
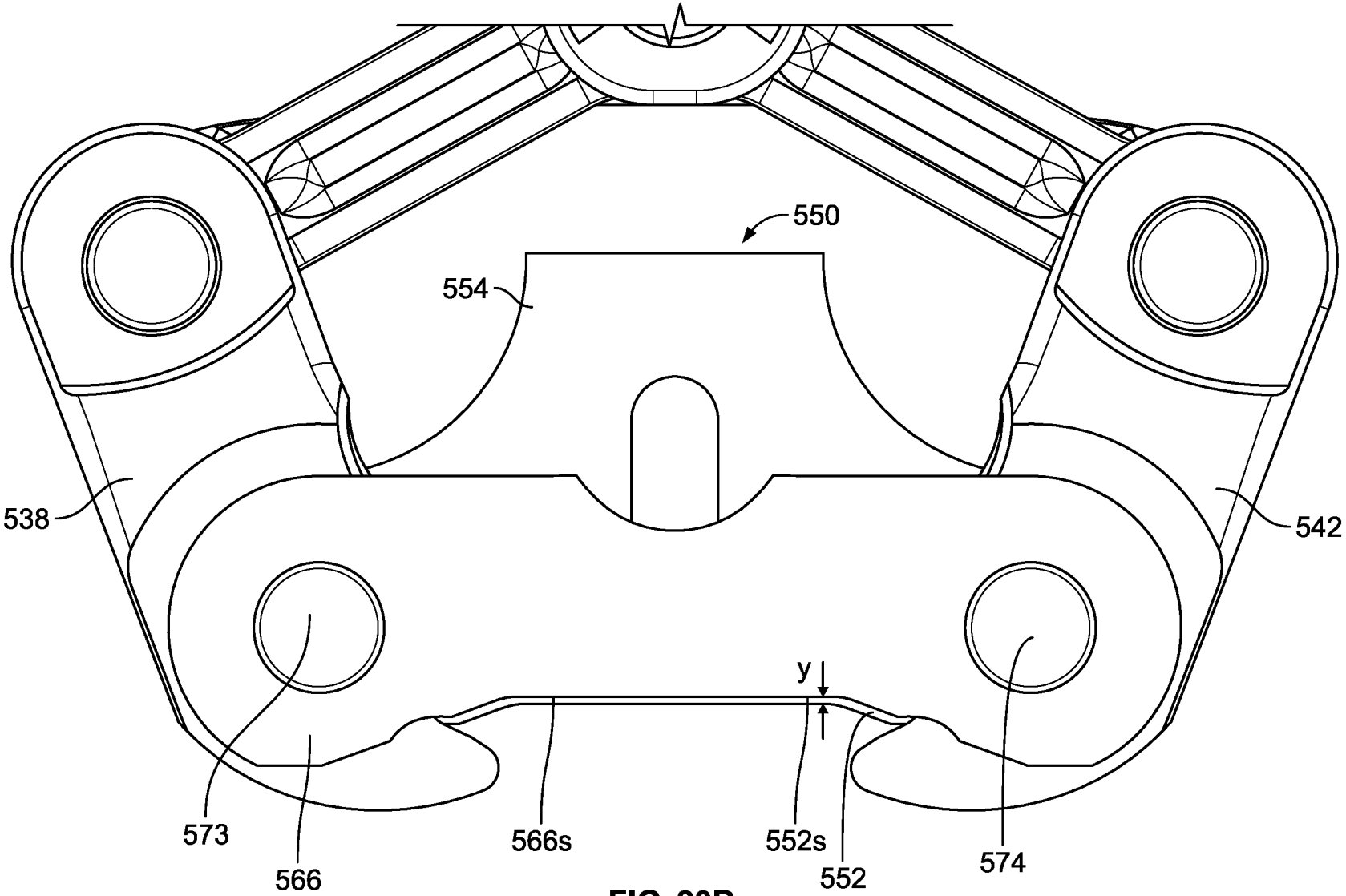
FIGS. 20B and 20C are opposing elevational views of part of the sealing assembly of FIG. 15A.
Figure 20C:
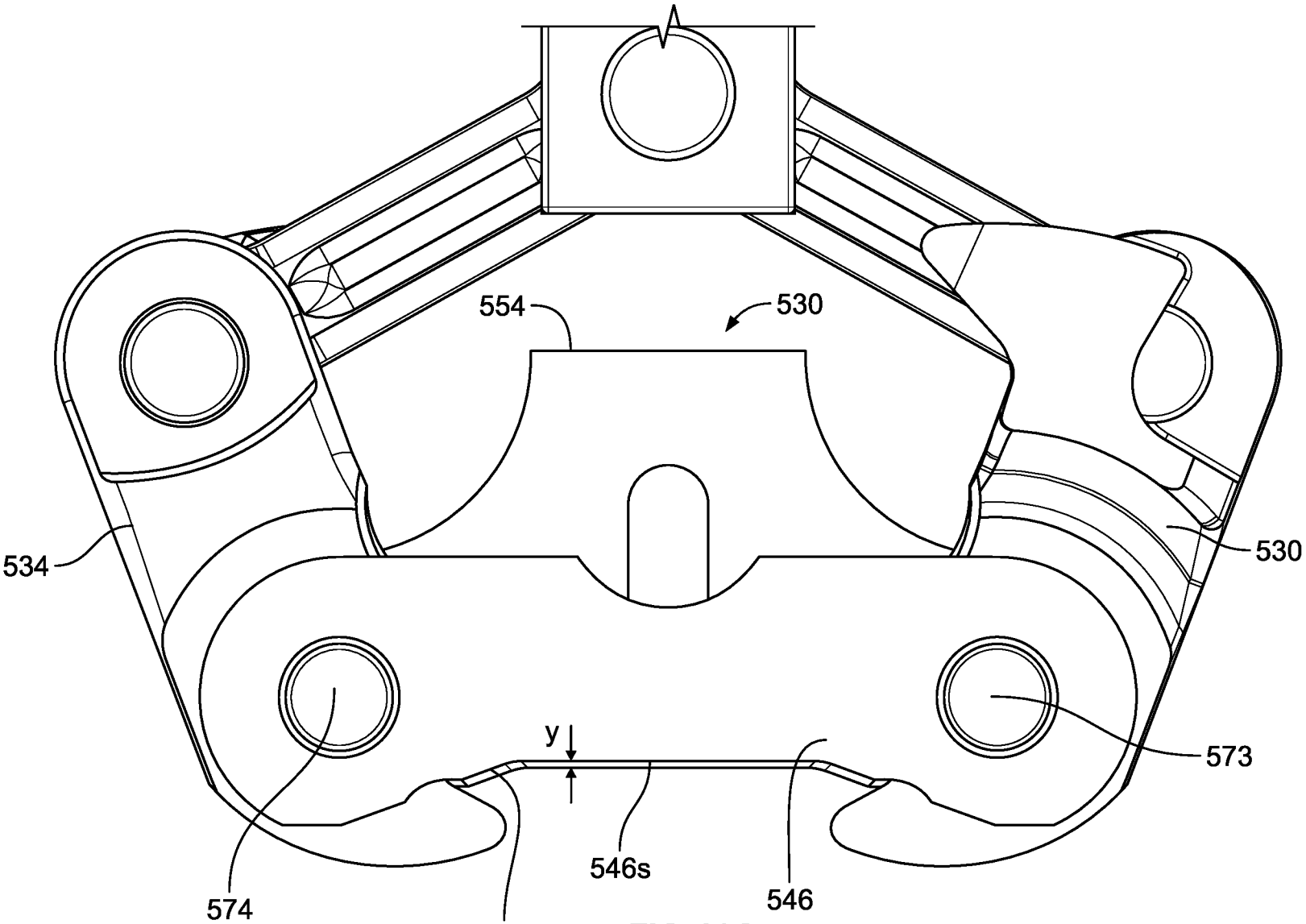

As shown in FIGS. 20A-20C, the first, second, and third jaw connectors 546, 550, and 566 include respective support surfaces 546*s*, 552*s*, and 566*s* configured to support the seal element during the sealing cycle. In this example embodiment, the support surfaces 546*s*, 552*s*, and 566*s* are planar and parallel to one another. The support surfaces 546*s*, 552*s*, and 566*s* support the seal element during the sealing cycle. In this example embodiment, as best shown in FIGS. 20B and 20C, the support surfaces 546*s* and 566*s* of the first and third jaw connectors 546 and 566 are coplanar while the support surface 552*s* of the second jaw connector 550 is offset below the support surfaces 546*s* and 566*s* by a distance Y. In other words, the support surface 552*s* of the second jaw connector 550 is below the support surfaces 546*s* and 566*s* of the first and third jaw connectors 546 and 566. The lower support surface of the second jaw connector helps prevent the seal element SE from bending along the longitudinal direction of the strap (into and out of the page from the perspective in FIGS. 20B and 20C) during completion of the sealing cycle.

Although not shown here, a cutter is positioned in and movable within a recess defined in the back cover 506 (best shown in FIG. 15B) and mounted to the coupler pivot 524. Movement of the coupler pivot 524 downwards causes the coupler pivot 524 to force the cutter downward to cut the strap from the strap supply, and movement of the coupler pivot 524 back upward causes the cutter to move back upward.

The drive assembly 700, which is best shown in FIGS. 3B and 21-23B, is operably connected to the tensioning assembly 400 and configured to rotate the tension wheel 440 to tension the strap and is operably connected to the sealing assembly 500 to attach the overlapping portions of the strap to one another. The drive assembly 700 includes a working-assembly actuator 710, a first transmission 720, a second transmission 730, a first belt 740, a third transmission 750, a second belt 760, and a conversion assembly 800.

In this example embodiment, the working-assembly actuator 710 includes a motor (and is referred to herein as the motor 710), and particularly a brushless direct-current motor that includes a motor output shaft 712 having a motor-output-shaft rotational axis 712*a* (though the motor 710 may be any other suitable type of motor in other embodiments). The motor 710 is operably connected to (via the motor output shaft 712) and configured to drive the first transmission 720, which (as described below) is configured to selectively transmit the output of the motor 710 to either the tensioning assembly 400 or the sealing assembly 500. In other embodiments, the strapping tool includes separate tensioning and sealing actuators respectively configured to actuate the tensioning assembly and the sealing assembly rather than a single actuator configured to actuate both.

The first transmission 720 includes any suitable gearing and/or other components that are configured to selectively transmit the output of the motor 710 to the second transmission 730 via the first belt 740 and to the third transmission 750 via the second belt 760. More specifically, the first transmission 720 is configured such that: (1) rotation of the motor output shaft 712 in a first rotational direction causes the first transmission 720 to transmit the output of the motor 710 to the second transmission 730 via the first belt 740 and not to the third transmission 750; and (2) rotation of the motor output shaft 712 in a second rotational direction opposite the first rotational direction causes the first transmission 720 to transmit the output of the motor 710 to the third transmission 750 via the second belt 760 and not to the second transmission 730. Thus, in this embodiment, a single motor (the motor 710) is configured to actuate both the tensioning and sealing assemblies 400 and 500.

To accomplish this selective transmission of the motor output, the first transmission 720 includes a first belt pulley (or other suitable component) (not labeled) mounted on a first freewheel (not labeled) that is mounted on the motor output shaft 712 and a second belt pulley (or other suitable component) (not labeled) mounted on a second freewheel (not labeled) that is mounted on the motor output shaft 712. The first belt pulley is operatively connected (via the first belt 740) to the second transmission 730, and the second belt pulley is operatively connected (via the second belt 760) to the third transmission 750. When the motor output shaft 712 rotates in the first direction: (1) the first freewheel and the first belt pulley rotate with the motor output shaft 712, thereby transmitting the motor output to the second transmission 730 via the first belt 740; and (2) the motor output shaft 712 rotates freely through the second freewheel, which does not rotate the second belt pulley. Conversely, when the motor output shaft 712 rotates in the second direction: (1) the second freewheel and the second belt pulley rotate with the motor output shaft 712, thereby transmitting the motor output to the third transmission 750 via the second belt 760; and (2) the motor output shaft 712 rotates freely through the first freewheel, which does not rotate the first belt pulley. This is merely one example embodiment of the first transmission 720, and it may include any other suitable components in other embodiments.

The second transmission 730 is configured to transmit the output of the first transmission 720 to the tensioning assembly 400 to cause the tension wheel 440 to rotate. More particularly, the second transmission 730 is configured to transmit the output of the first transmission 720 to the tensioning-assembly gearing 420 of the tensioning assembly 400 to rotate the tension-wheel shaft 428*b* and the tension wheel 440 thereon. Accordingly, the motor 710 is operatively coupled to the tension wheel 440 (via the first transmission 720, the first belt 740, the second transmission 730, the tensioning-assembly gearing 420, and the tension-wheel shaft 428*b*) and configured to rotate the tension wheel 440. In this example embodiment, the second transmission 730 includes intermediary gearing 732 positioned, oriented, and otherwise configured to engage the driven gear 421 of the tensioning-assembly gearing 420 of the tensioning assembly 400—regardless of the rotational position of the tensioning assembly 400—to transmit the output of the motor 710 to the tensioning-assembly gearing 420 to rotate the tension wheel 440. The intermediary gearing 732 is positioned and otherwise configured to maintain the operative connection between the motor 710 and the tensioning assembly 400 as the tensioning assembly 400 pivots between its strap-tensioning and strap-insertion positions.

Figure 21:
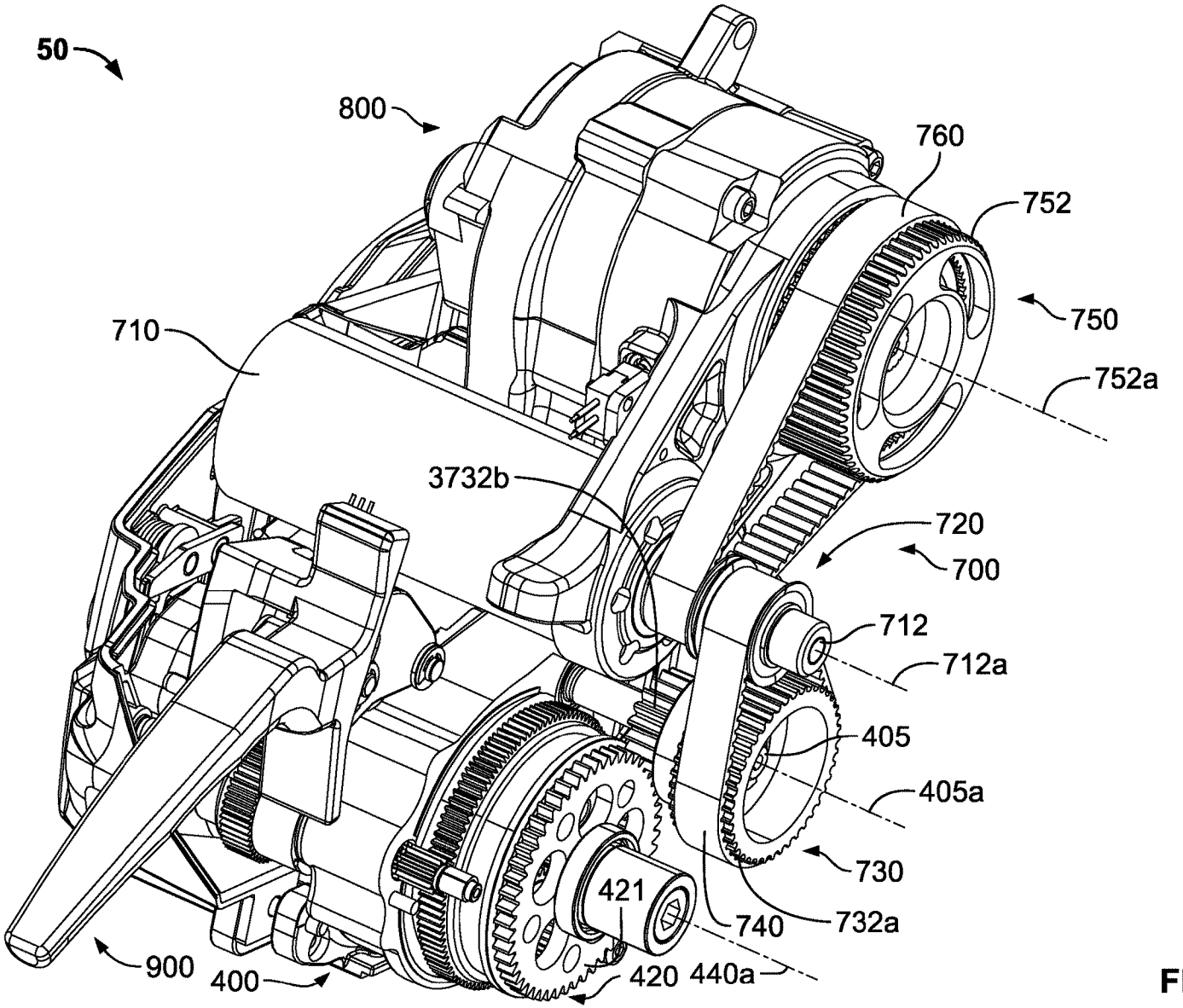
FIG. 21 is a perspective view of the working assembly of FIG. 3A showing the drive assembly.

Specifically, and as best shown in FIG. 21, the intermediary gearing 732 includes a first intermediary gear 732*a* and a second intermediary gear 732*b*. The first and second intermediary gears 732*a* and 732*b* are rotatably mounted (via bearings or any other suitable components) to the tensioning-assembly-pivot shaft 405 and rotatable about the tensioning-assembly-pivot axis 405*a*. That is, the first and second intermediary gears 732*a* and 732*b* rotate around the same axis about which the tensioning assembly 400 pivots between its strap-tensioning and strap-insertion positions. The first and second intermediary gears 732*a* and 732*b* are fixed in rotation relative to one another (such as via a splined or keyed connection) and therefore rotate together about the tensioning-assembly-pivot axis 405*a*. The first belt 740 engages the first intermediary gear 732*a* and therefore drives the first and second intermediary gears 732*a* and 732*b* in rotation about the tensioning-assembly-pivot axis 405*a*.

The intermediary gearing 732 transmits the output of the second transmission 730 to the tensioning assembly 400. More specifically, the second intermediary gear 732*b* is drivingly engaged to and directly drives the tensioning-assembly gearing 420—and here, the driven gear 421—which in turn rotates the gear 421 about the tension-wheel rotational axis 440*a*.

Figure 23A:
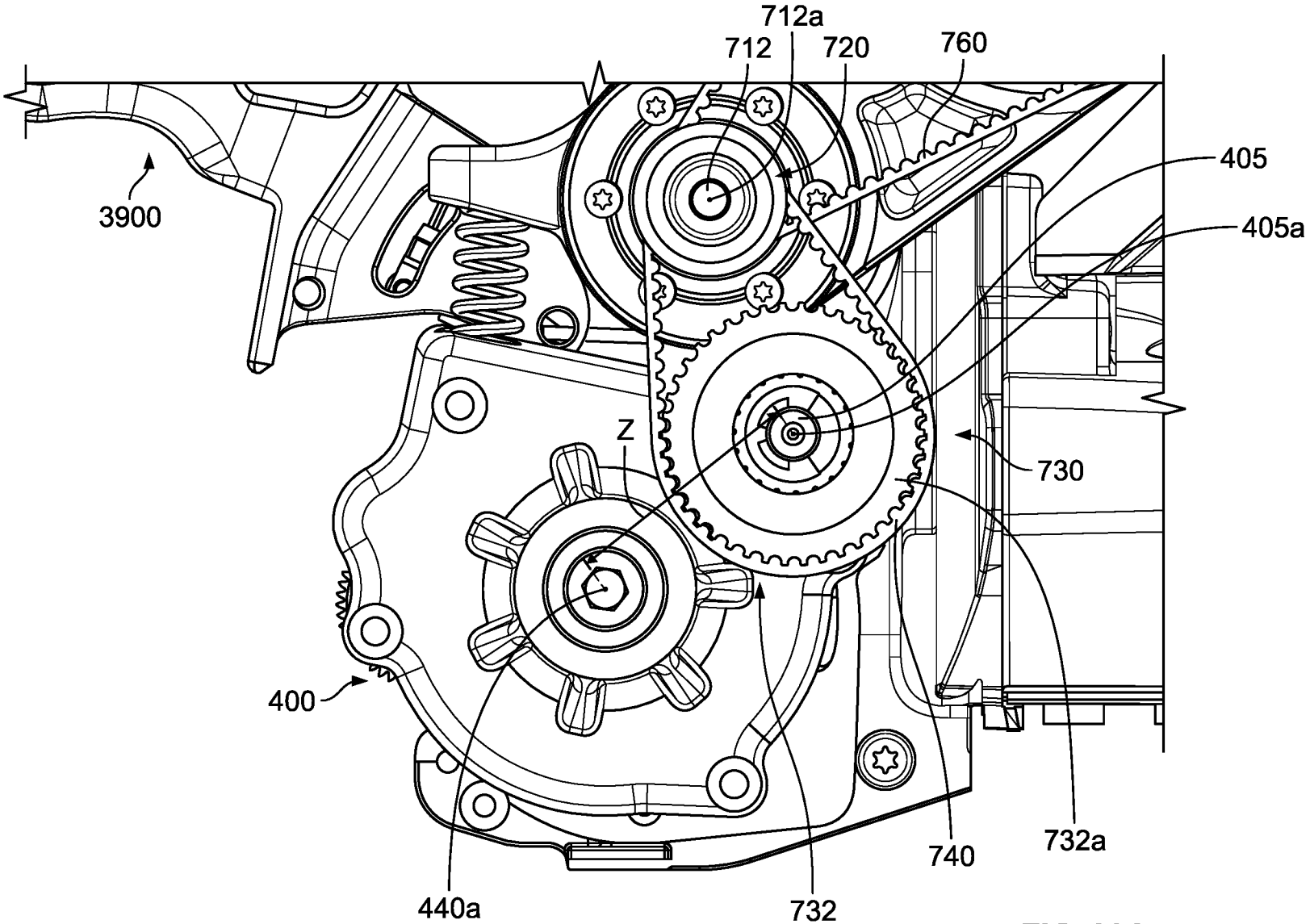
FIGS. 23A and 23B are side views of the working assembly of FIG. 3A showing the tensioning assembly in its strap-insertion and strap-tensioning positions, respectively.
Figure 23B:
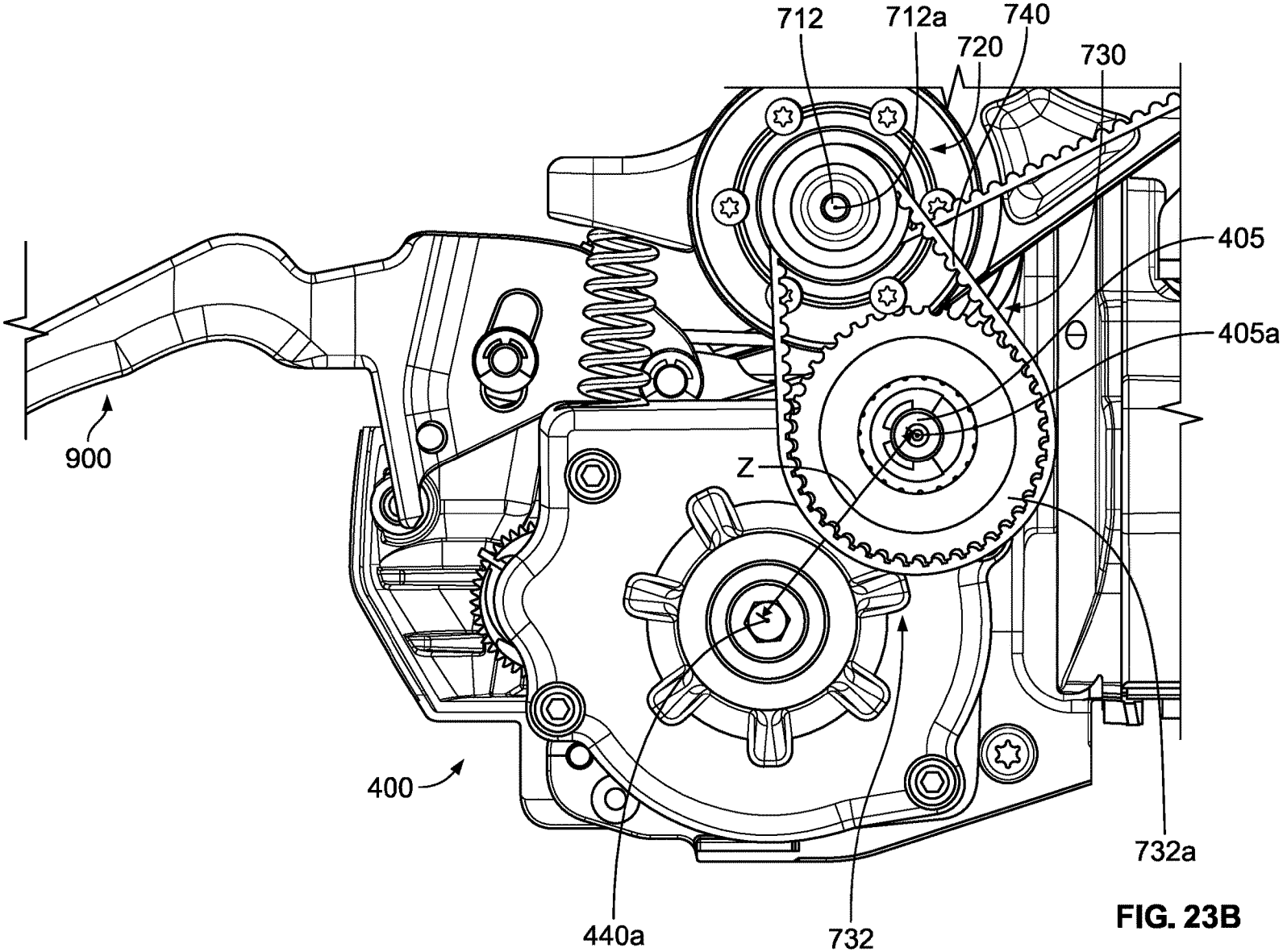

As shown in FIGS. 23A and 23B, since the intermediary gearing 732 is rotatable about the tensioning-assembly-pivot axis 405*a*, a distance Z between the tension-wheel rotational axis 440*a* and the tensioning-assembly-pivot axis 405*a* does not change, within operational tolerances, as the tensioning assembly 400 pivots between its strap-tensioning and strap-insertion positions. For example, the distance Z between the tension-wheel rotational axis 440*a* and the tensioning-assembly-pivot axis 405*a* remains the same or at least substantially the same (e.g., +/−10%) when the tensioning assembly 400 pivots between its strap-tensioning and strap-insertion positions. This ensures that the second intermediary gear 732*b* maintains its driving engagement to the driven gear 421 throughout the entire range of motion of the tensioning assembly 400, ensuring that the motor 710 does not operatively disconnect from the tensioning assembly 400 as the tensioning assembly 400 pivots. This arrangement improves upon an alternative arrangement (not shown) in which the intermediary gearing is not present and in which the first belt 740 directly drives the driven gear 421 of the tensioning-assembly gearing 420. In this alternative arrangement, the distance between the tension-wheel rotational axis 440*a* and the motor-output-shaft rotational axis 712*a* would decrease as the tensioning assembly 400 pivots from its strap-tensioning position to its strap-insertion position. This pivoting would create slack in the first belt 740, which could cause the first belt 740 to slip or completely disengage from the motor output shaft 712 and/or the driven gear 421, thereby causing the tool to malfunction.

The third transmission 750 is configured to transmit the output of the first transmission 720 to the conversion assembly 800. The third transmission 750 may include any suitable components, such as one or more gears and one or more shafts arranged in any suitable manner. In this example embodiment, the third transmission 750 includes third-transmission gearing 752 that is driven in rotation by the second belt 760 about a third-transmission rotational axis 752*a*.

Figure 22:
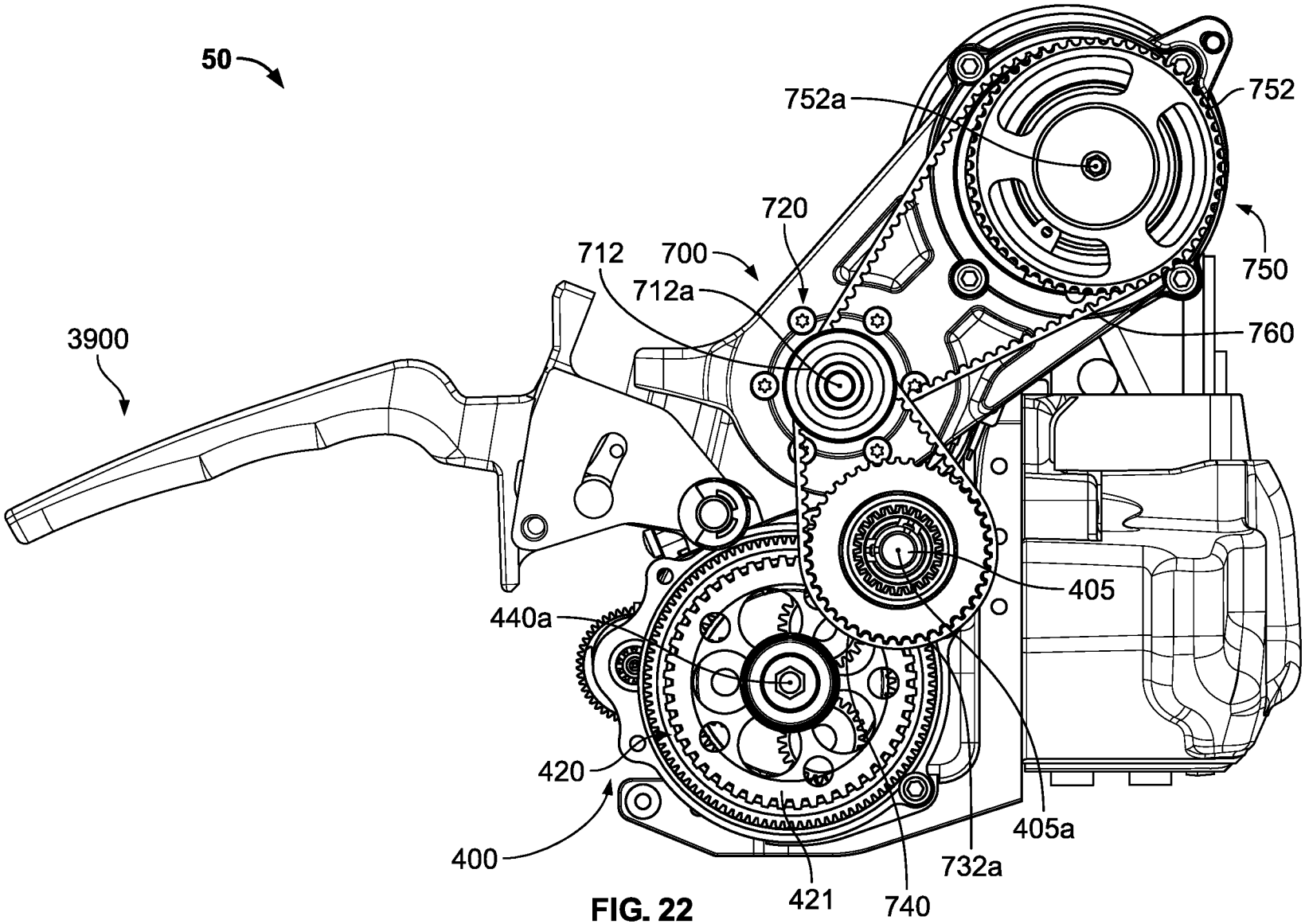
FIG. 22 is a side view corresponding to FIG. 21.

As best shown in FIGS. 21 and 22, the tensioning assembly 400 and the drive assembly 700 define at least four rotational axes: the motor-output-shaft rotational axis 712*a*, the tensioning-assembly-pivot axis 405*a*, the tension-wheel rotational axis 440*a*, and the third-transmission rotational axis 752*a*. In this example embodiment, these four rotational axes are parallel to each other. These axes are oriented as follows from left to right from the perspective shown in FIG. 22: the tension-wheel rotational axis 440*a*, the motor-output-shaft rotational axis, the tensioning-assembly pivot axis 405*a*, and the third-transmission rotational axis 752*a*. These axes are oriented as follows from bottom to top from the perspective shown in FIG. 22: the tension-wheel rotational axis 440*a*, the tensioning-assembly pivot axis 405*a*, the motor-output-shaft rotational axis 712*a*, and the third-transmission rotational axis 752*a*.

This arrangement of the rotational axes (and the components that rotate around these axes) enables the motor 710 to directly drive the conversion assembly 800 (via the second belt 760) and indirectly drive the tensioning assembly 400 (via the first belt 740 and intermediary gearing 732). This arrangement of the rotational axes also ensures that the distance Z between the motor-output-shaft rotational axis 712*a* and the tension-wheel rotational axis 440*a* does not change, within operational tolerances (as described above), when the tensioning assembly 400 pivots about the tensioning-assembly-pivot axis 405*a*. This distance Z is shown in FIG. 23A where the tensioning assembly 400 is in its strap-insertion position and in FIG. 23B where the tensioning assembly 400 is in its strap-tensioning position.

The conversion assembly 800 is configured to transmit the output of the third transmission 750 to the sealing assembly 500 to carry out the sealing cycle, which includes: moving the sealing assembly from its home position to its sealing position, causing the jaws of the sealing assembly to move from their home positions to their sealing positions to cut notches in the seal element and the strap, causing the jaws to move back to their home positions to release the notched seal element and strap, and moving the sealing assembly back to its home position. In doing so, in this embodiment the conversion assembly 800 is configured to convert rotational motion (the rotation of shafts and gears) to linear motion (the reciprocating translational movement of a coupler).

The conversion assembly 800 is best shown in FIGS. 24A-26H and includes a drive wheel 810, a bearing 815, a linkage 820, and a retainer 850.

Figure 24A:
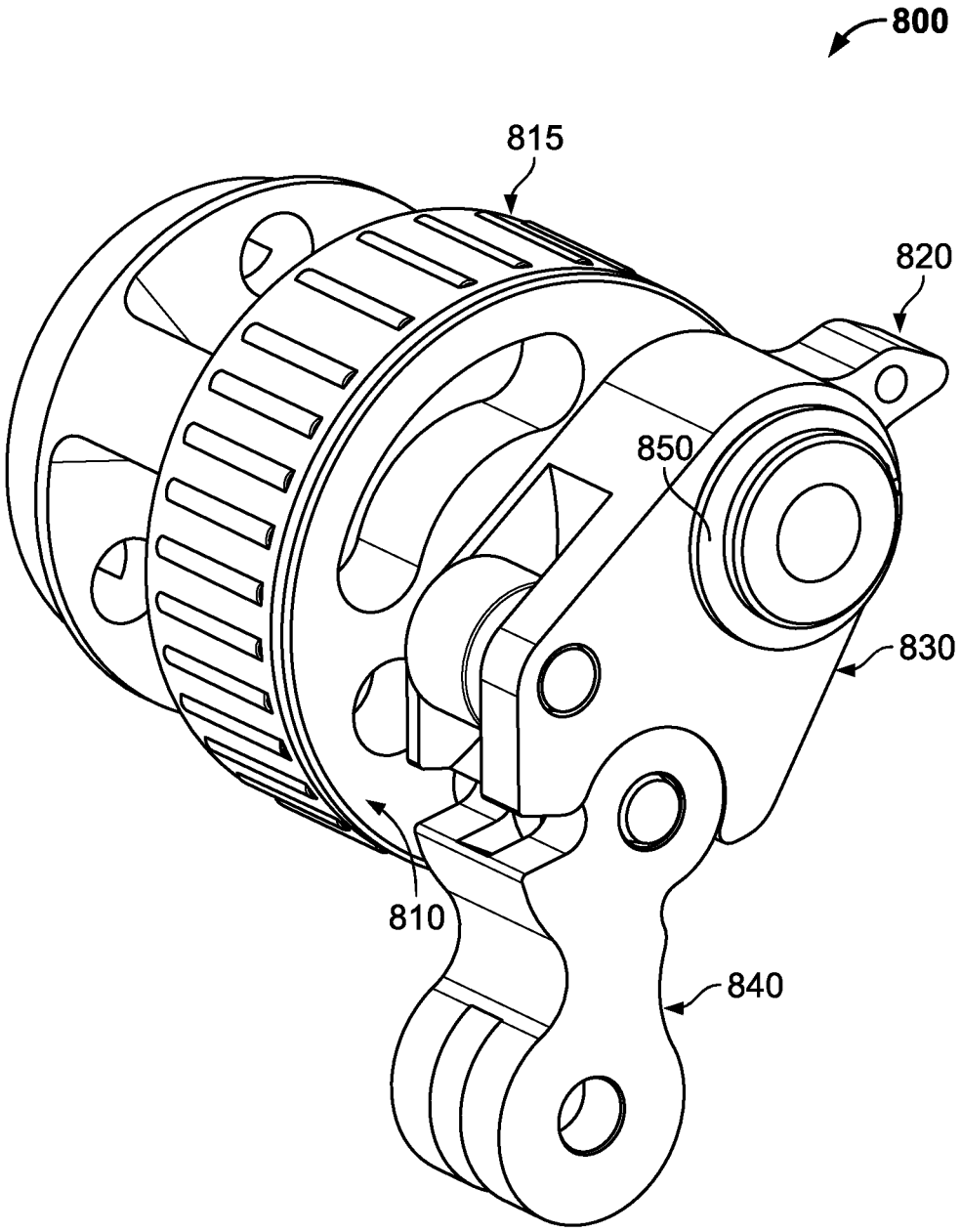
FIG. 24A is a perspective view of the conversion assembly of the drive assembly of the working assembly of FIG. 3A.
Figure 24B:
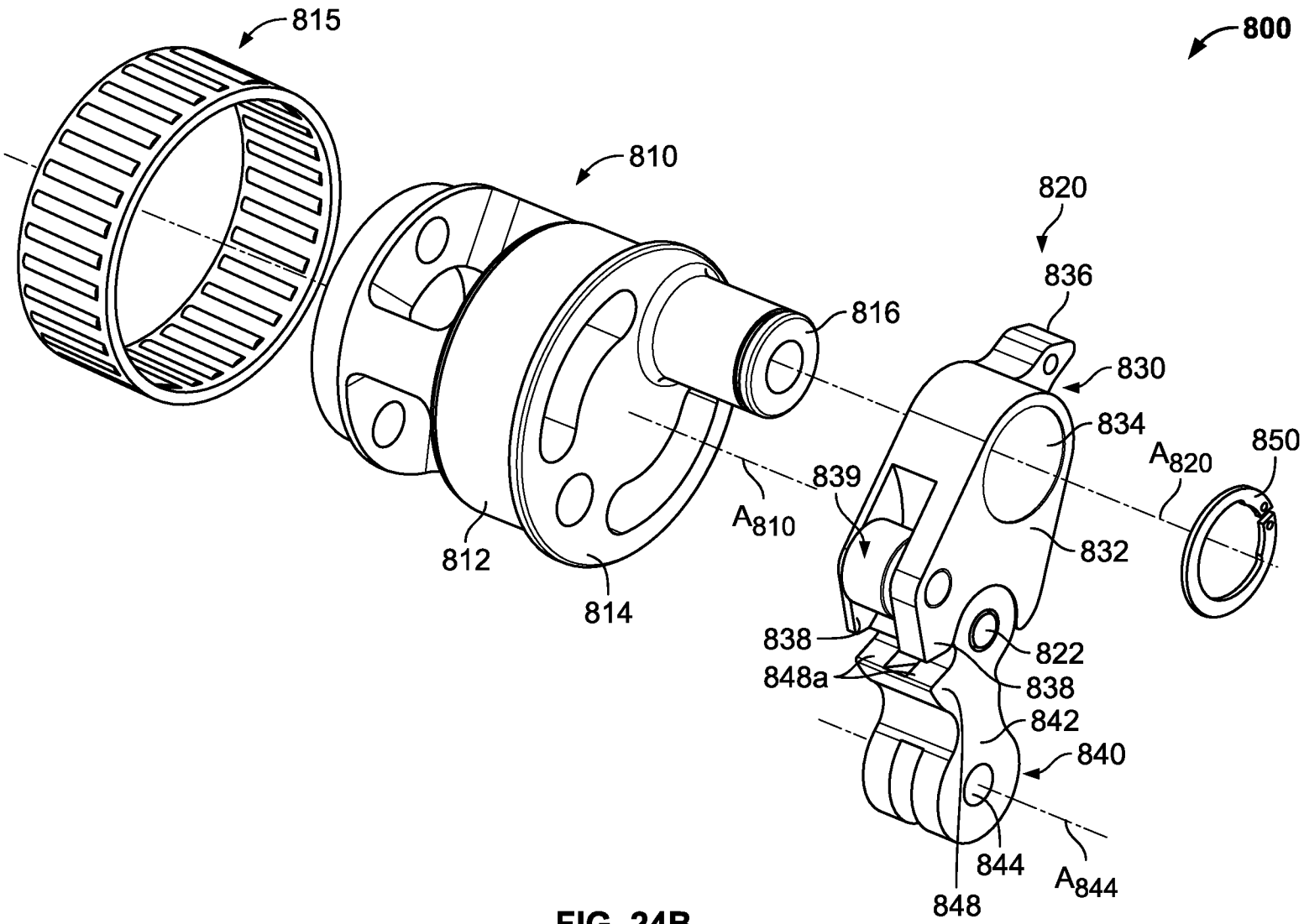
FIG. 24B is an exploded perspective view of the conversion assembly of FIG. 24A.

As best shown in FIG. 24B, the drive wheel 810 includes a generally cylindrical base 812 and a disc-shaped head 814 at one end of the base 812. The base 812 and the head 814 are centered on and rotatable about a drive-wheel rotational axis A810. A linkage driveshaft 816 extends from the head 814 and is centered on a linkage rotational axis A820. The linkage driveshaft 816 is positioned near the perimeter of the head 814 so the linkage rotational axis A820 is radially spaced apart from the drive-wheel rotational axis A810.

The linkage 820 includes a first link 830 and a second link 840. The first link 830 includes a body 832 having a head and an opposing foot. A linkage-driveshaft mounting opening 834 is defined through the head of the body 832. A first support engager 836 extends radially from the head of the body 832. The foot of the body 832 includes one or more (here, two) stop fingers 838. A second support engager 839 (here, a roller) is mounted between the stop fingers 838. The second link 840 includes a body 842 having a head and an opposing foot. A coupler-mounting opening 844 is defined through the foot of the body 842. Near the head, the body 842 includes a stop element 848 including one or more (here, two) stop surfaces 848*a*. The first and second links 830 and 840 are connected to one another via a pivot 822 that extends between the foot of the body 832 of the first link 830 and the head of the body 842 of the second link 840. The first and second links 830 and 840 are pivotable relative to one another about the pivot 822. Once connected, the head of the body 832 of the first link 830 forms the head of the linkage 820 (and is referred to as such below), and the foot of the body 842 of the second link 840 forms the foot of the linkage 820 (and is referred to as such below).

As best shown in FIG. 3A, the base 812 of the drive wheel 810 is journaled in the drive-and-conversion-assembly-mounting element 340 of the support 300 via the bearing 815, which is a roller bearing in this example embodiment, so the drive wheel 810 can rotate relative to the support 300 about the drive-wheel rotational axis A810. As best shown in FIG. 24A, the linkage driveshaft 816 of the drive wheel 810 is received in the linkage-driveshaft mounting opening 834 of the first link 830 of the linkage mount 820 to mount the linkage 820 to the drive wheel 810. The retaining ring 850 is inserted into a groove (not labeled) defined around the perimeter of the linkage driveshaft 816 to retain the linkage 820 on the drive wheel 810. Once mounted, the linkage 820 is rotatable relative to the drive wheel 810 about the linkage rotational axis A820.

Although not shown, the third transmission 750 is operably connected to the drive wheel 810 (such as via a shaft and suitable gearing) and configured to rotate the drive wheel 810 about the drive-wheel rotational axis A810. The foot of the linkage 820 is pivotably connected to the coupler 522 of the sealing assembly 500 via a pin (not labeled) that extends through the coupler-mounting opening 844, as best shown in FIGS. 3A, 24A, and 24B, so the linkage 820 is pivotable relative to the coupler 522 about an axis A844 (FIG. 24A). Accordingly, the motor 710 is operatively coupled to the sealing assembly 500 (via the third transmission 750, the second belt 760, and the conversion assembly 800) and configured to control the sealing assembly 500 to carry out a sealing cycle, as described below.

More specifically, rotation of the motor output shaft 712 of the motor 710 in the second rotational direction causes rotation of the second belt pulley of the first transmission 720. The second belt 760 transmits the output of the first transmission 720 (in this instance, the rotation of the second belt pulley) to the third transmission 750, which in turn transmits the output of the first transmission 720 to the conversion assembly 800. More specifically, the third transmission 750 transmits the output of the first transmission 720 to the drive wheel 810 of the conversion assembly 800, which causes the drive wheel 810 to rotate about the drive-wheel rotational axis A810, carrying the linkage 820 with it.

Figure 25B:
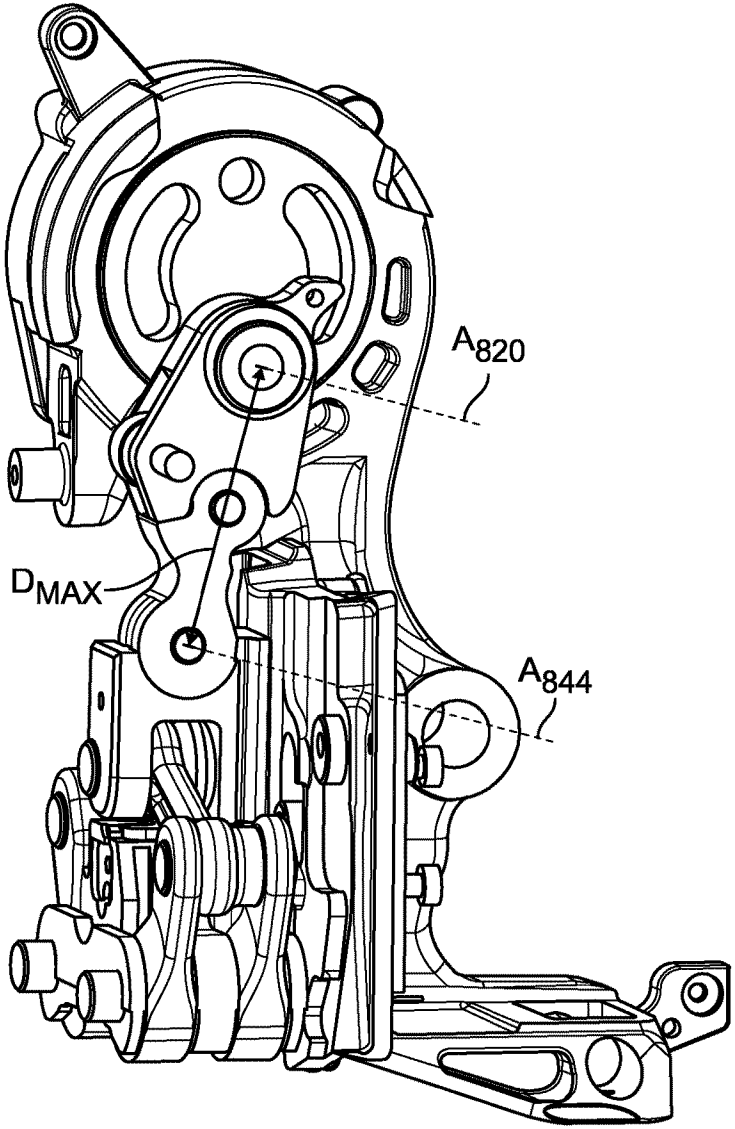
FIG. 25B is a perspective view of the part of the support of FIG. 2, part of the sealing assembly of FIG. 15A, and the part of the conversion assembly of FIG. 12A in which the effective length of the linkage of the conversion assembly is at a maximum.
Figure 25A:
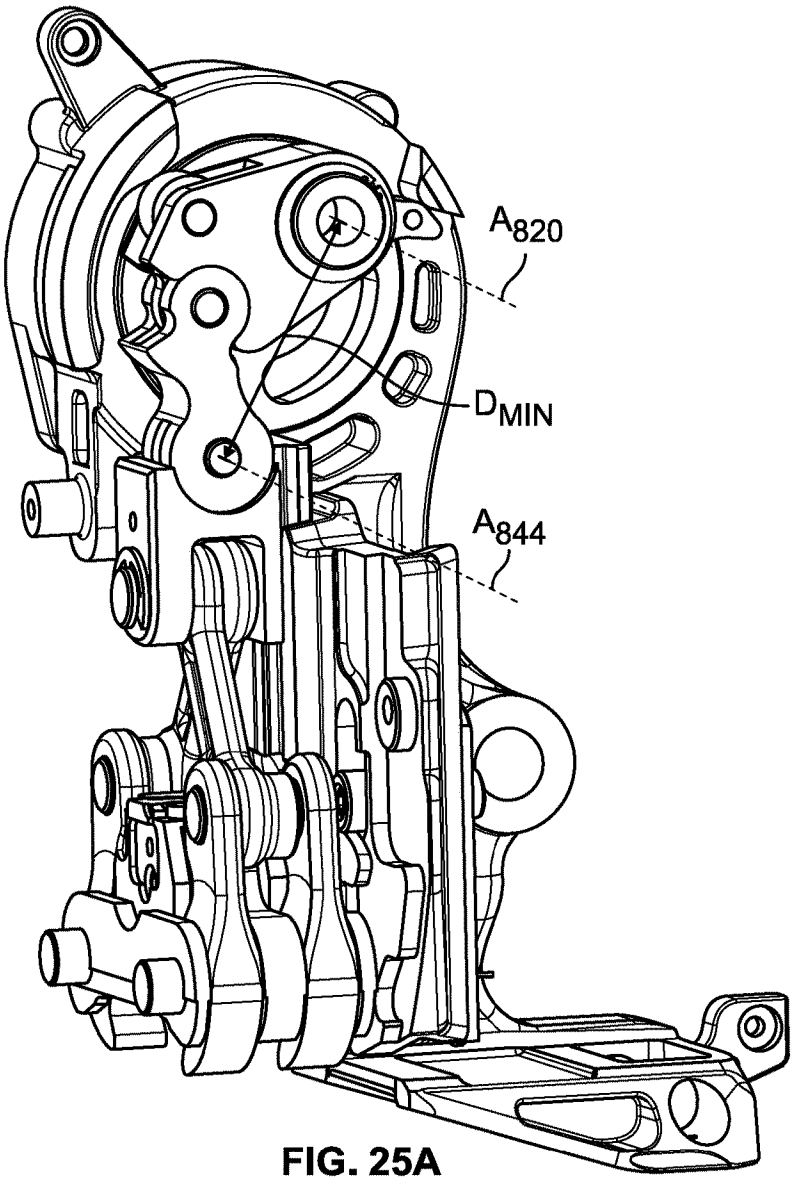
FIG. 25A is a perspective view of part of the support of FIG. 2, part of the sealing assembly of FIG. 15A, and part of the conversion assembly of FIG. 24A in which the effective length of the linkage of the conversion assembly is at a minimum.
Figure 26A:
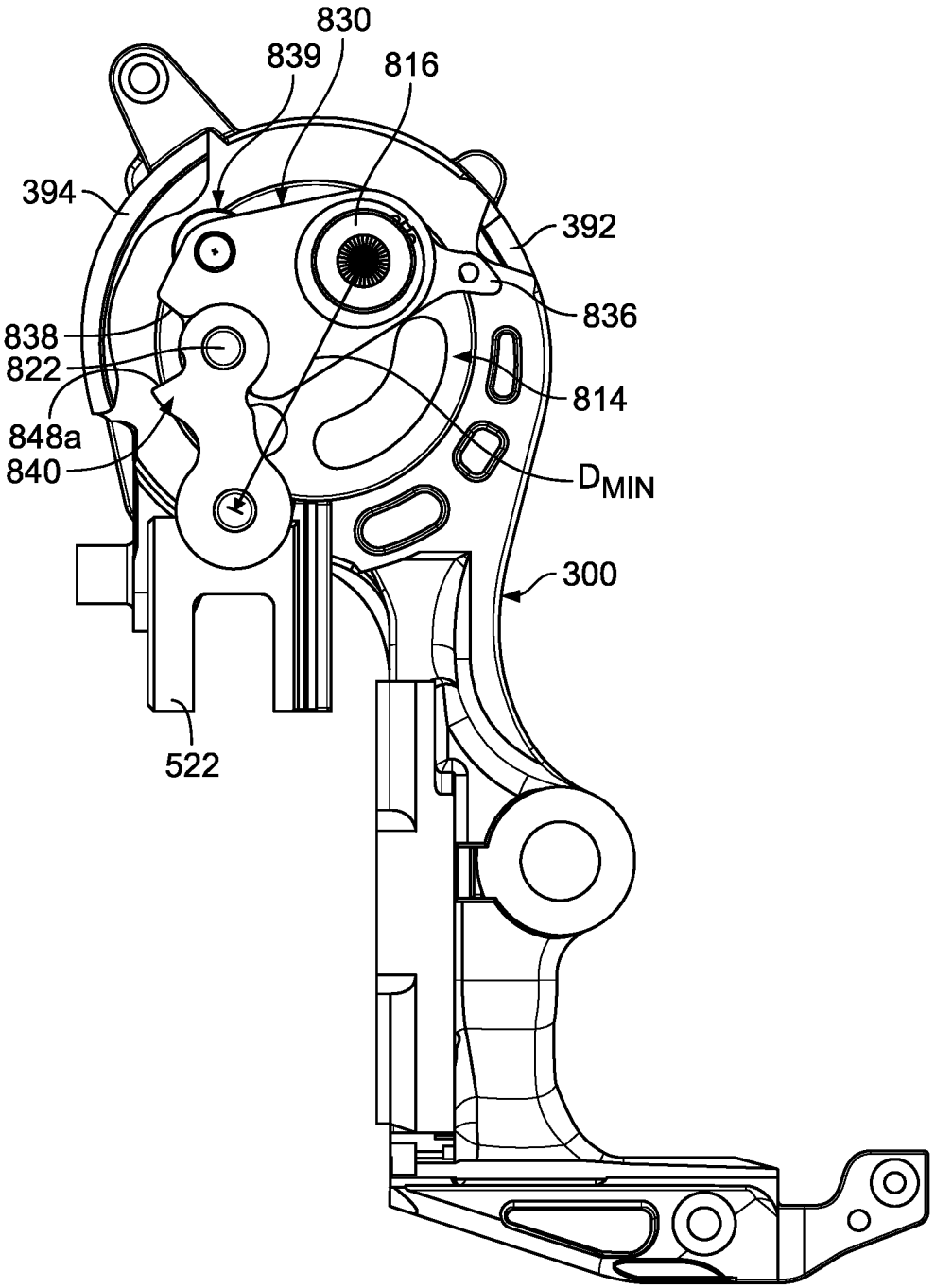
FIGS. 26A-26H are side views of the support of FIG. 2 and part of the conversion assembly of FIG. 24A illustrating how the effective length of the linkage of the conversion assembly varies during the sealing cycle.

The drive wheel 810 has a home position and a sealing position. In some embodiments, the sensor(s) 1700 include a home-position sensor configured to detect when the drive wheel 810 is at its home position and to communicate this to the controller 1300. As best shown in FIGS. 25A and 26A, when the drive wheel 810 is in its home position: the foot of the linkage 820 is at its home position (which is its uppermost position in this example embodiment); the sealing assembly 500 is in its home position; and the jaws 530, 534, 538, and 542 are in their respective home positions. Upon initiation of the sealing cycle, the drive wheel 810 begins rotating (counterclockwise in this example embodiment) from its home position to its sealing position. As the drive wheel 810 rotates from its home position to its sealing position, the linkage 820 imparts a force on the coupler 522 that causes the coupler to force the sealing assembly 500 to move from its home position toward its sealing position.

After the sealing assembly 500 reaches its sealing position (and before the drive wheel 810 reaches its sealing position), continued rotation of the drive wheel 810 toward its sealing position causes the coupler 522 to move toward the jaws relative to the front and back plates 502 and 506 of the sealing assembly 500 (guided by the coupler pivot 524 received in the slot defined in the back plate). This causes downward movement of the upper ends of first and second coupler/jaw linkages 526 and 528, which causes outward movement of the lower ends of the first and second coupler/jaw linkages 526 and 528. This causes outward movement of the upper portions of the jaws. This causes inward movement of the lower portions of the jaws. In other words, this causes the jaws to pivot from their respective home positions to their respective sealing positions. The jaws are in their respective sealing positions when the foot of the linkage 820 reaches its sealing position (which is its lowermost position in this example embodiment) and the drive wheel 810 reaches its sealing position, as shown in FIGS. 25B and 26F. Continued rotation of the drive wheel 810 back to its home position reverses the above movements: the jaws move from their sealing positions back to their home positions, and afterwards the sealing assembly moves back to its home position.

The components of the conversion assembly 800 are sized, shaped, positioned, oriented, and otherwise configured to change the distance between the head and the foot of the linkage during the sealing cycle. Put differently, the components of the conversion assembly 800 are sized, shaped, positioned, oriented, and otherwise configured to change the effective length of the linkage 820—which in this example embodiment is the distance D between the axes A820 and A844—during the sealing cycle to rapidly move the sealing assembly 500 toward its sealing position (by increasing the effective length of the linkage 820) and, after notching, back toward its home position (by decreasing the effective length of the linkage 820). The minimum effective length of the linkage 820 is DMIN, and the maximum effective length of the linkage 820 is DMAX, as shown in FIGS. 25A and 25B.

Figure 26B:
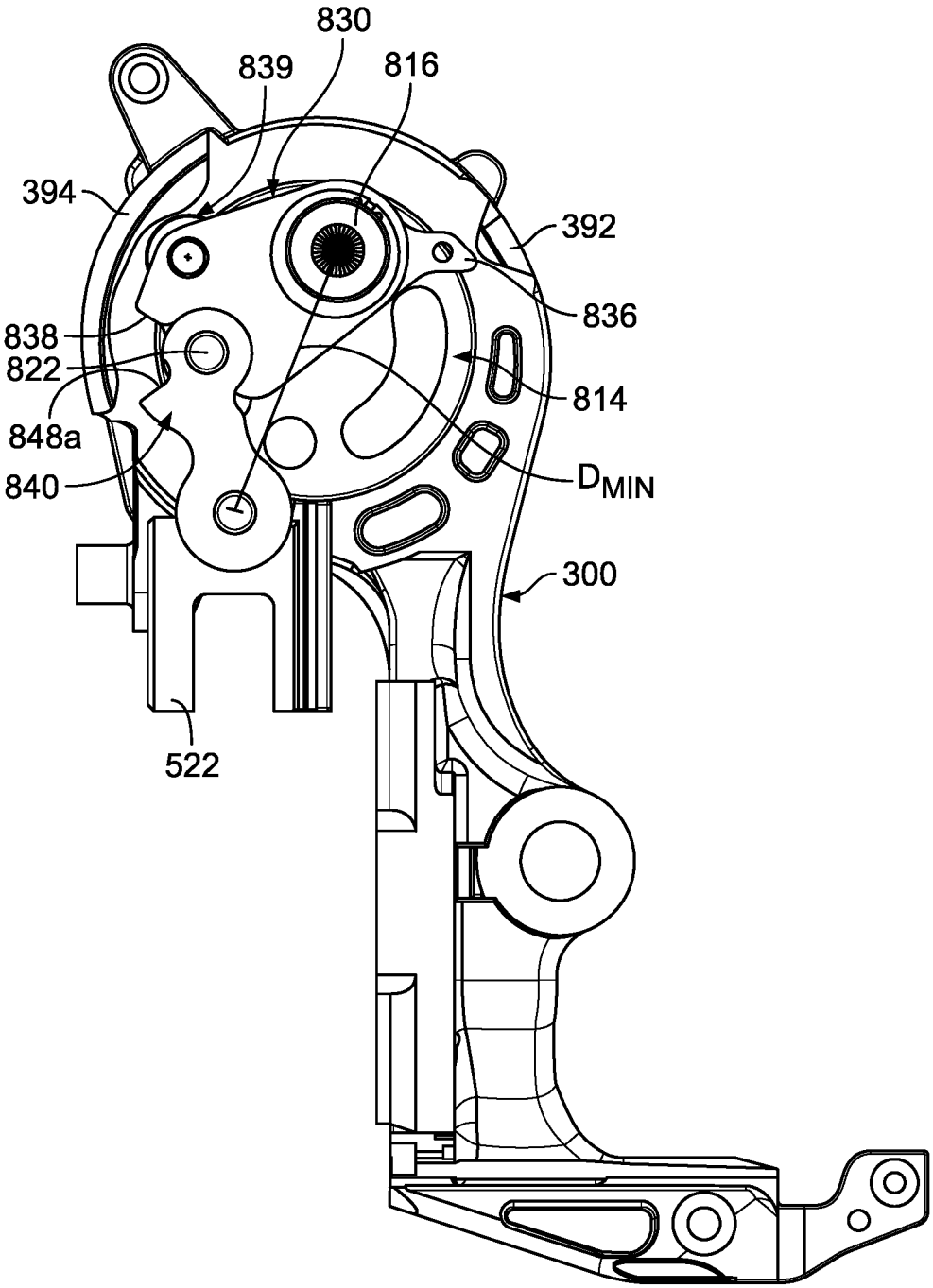
Figure 26C:
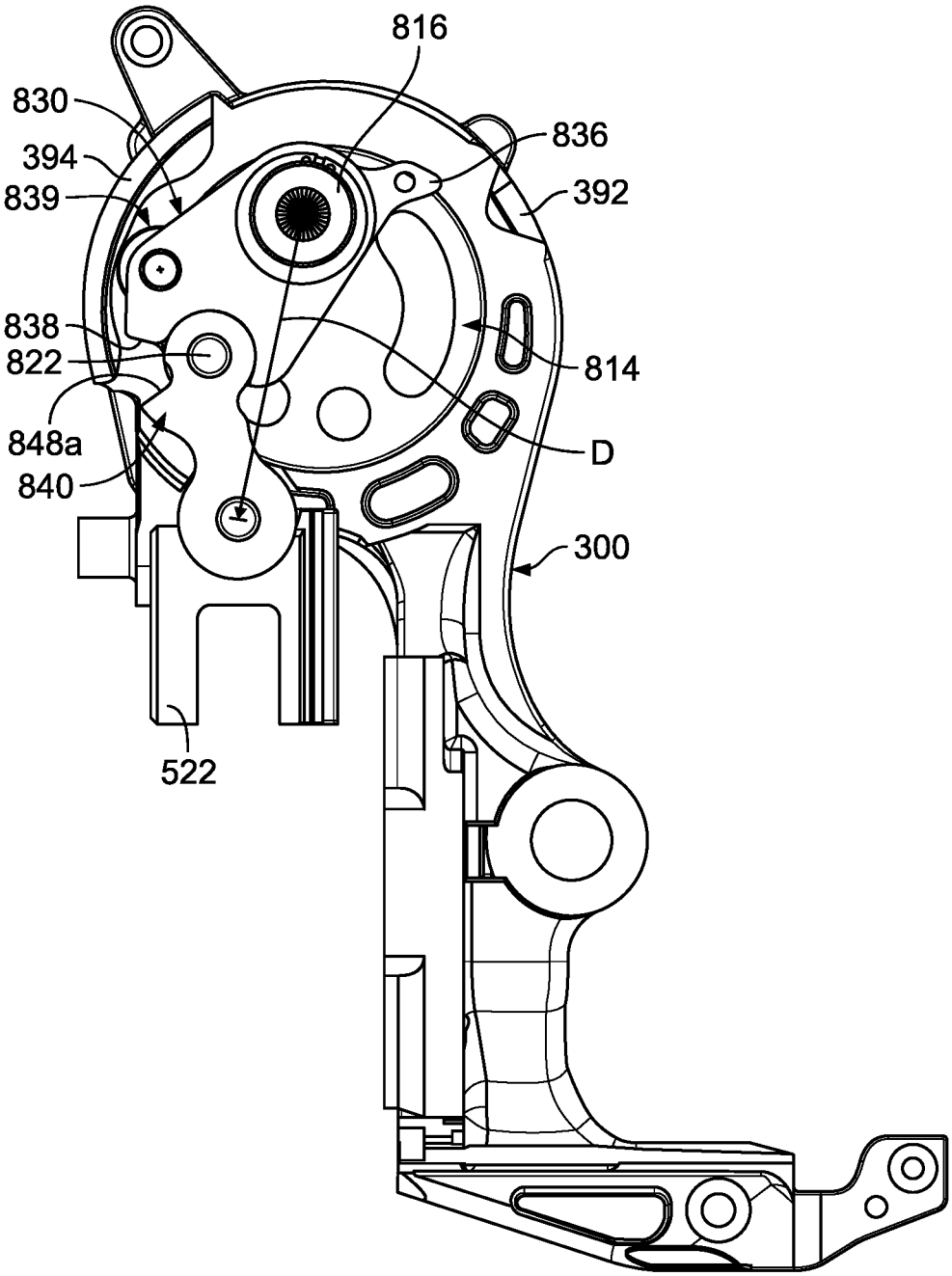
Figure 26D:
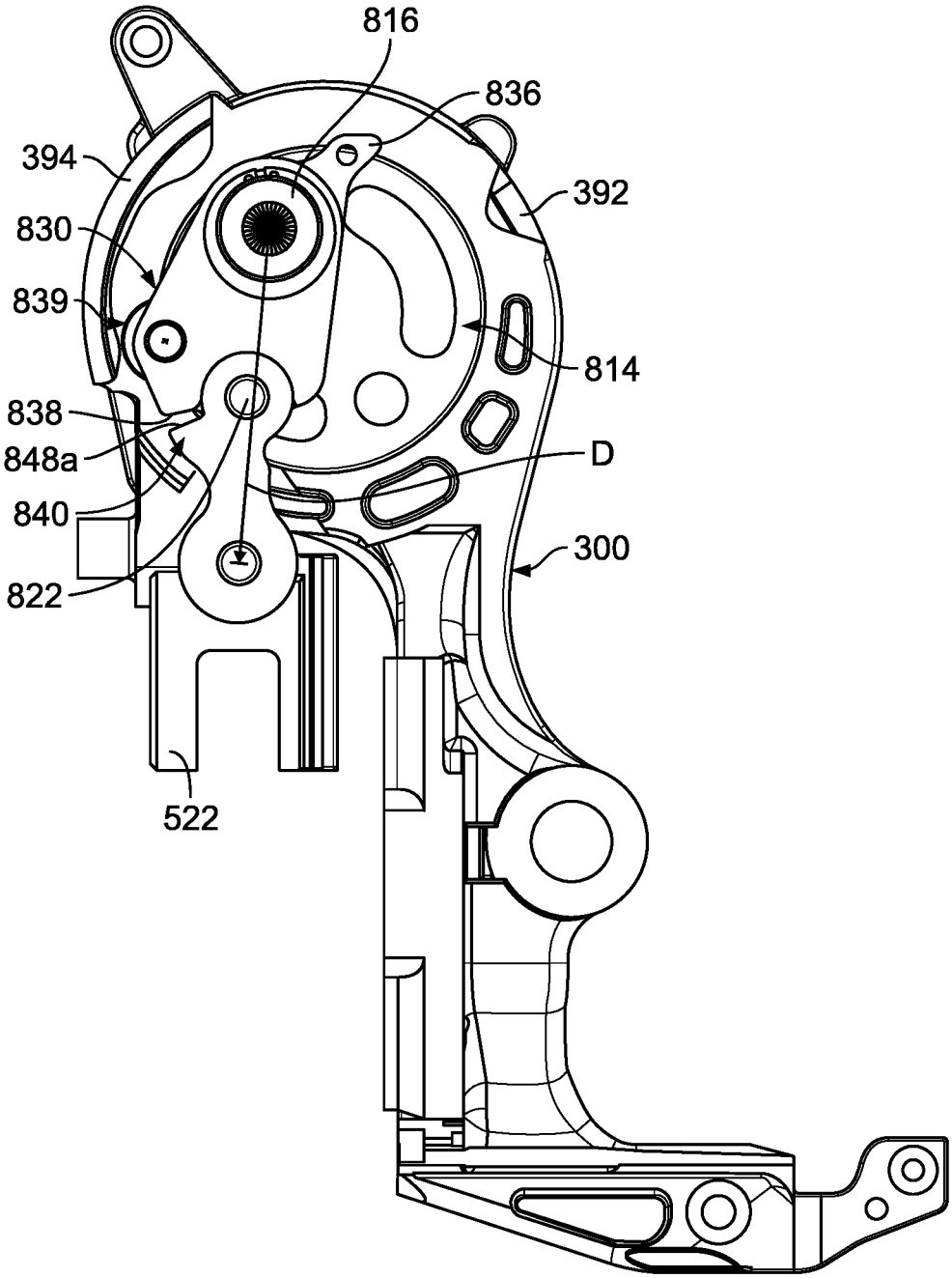
Figure 26E:
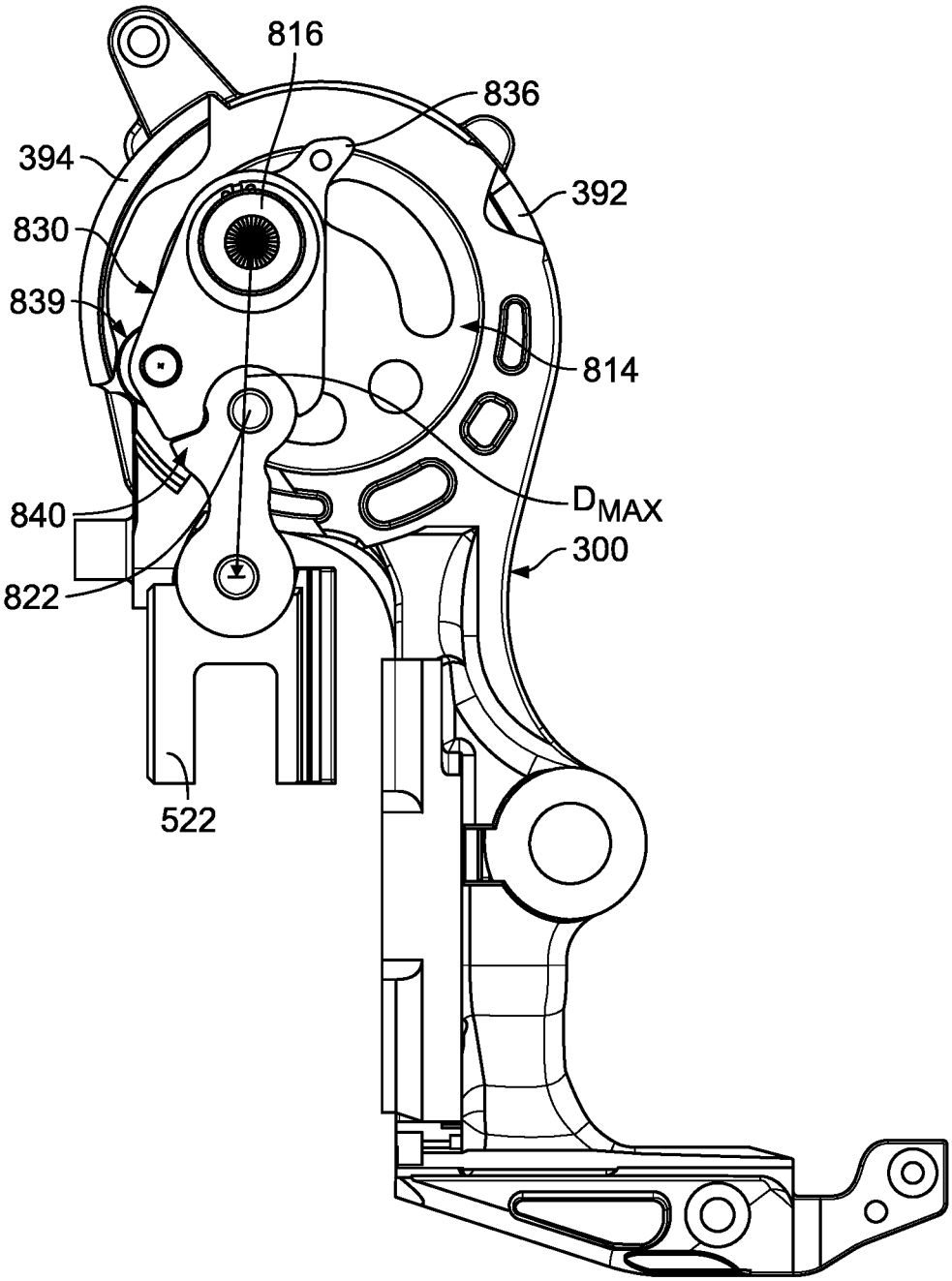
Figure 26F:
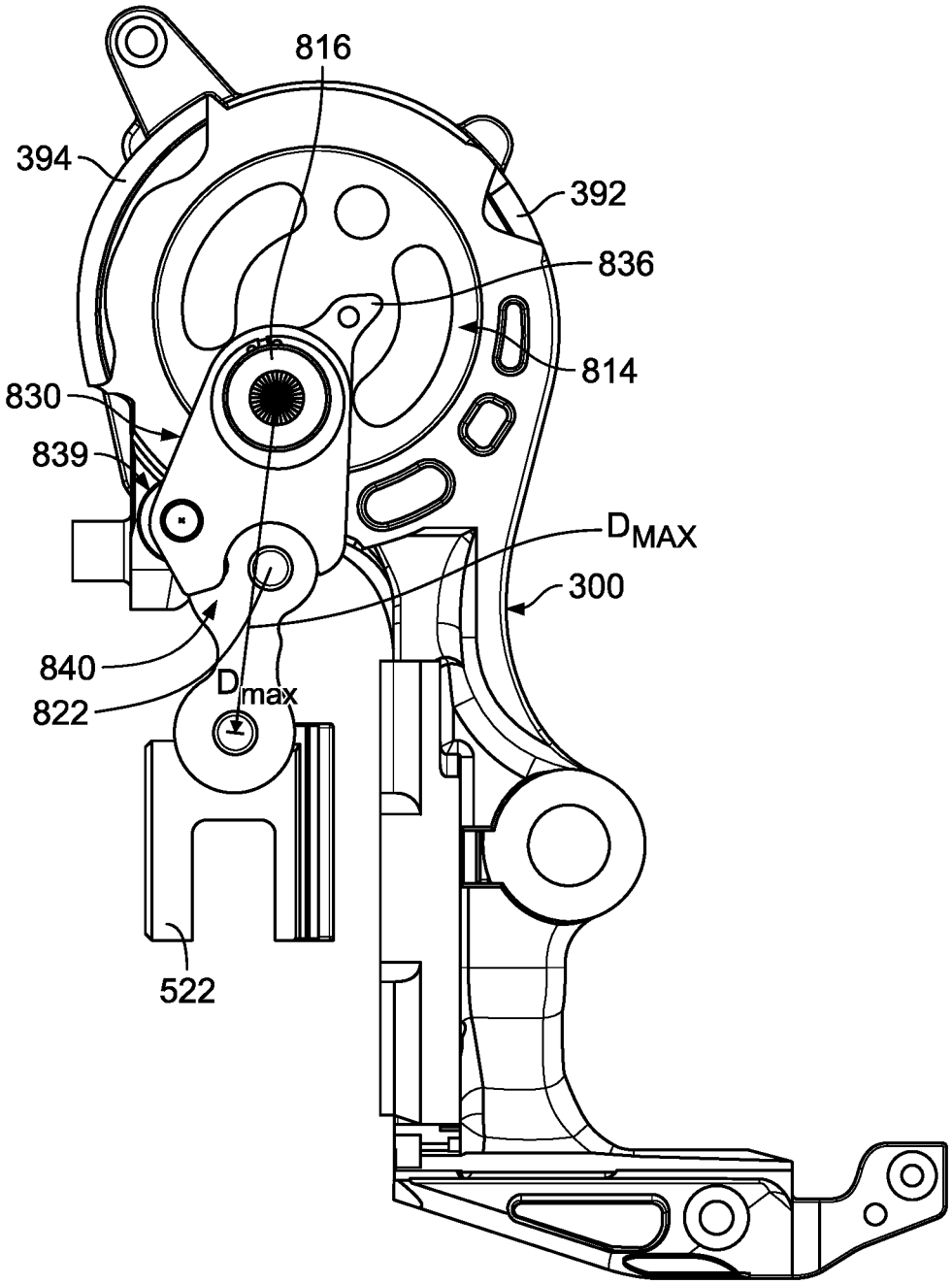

FIGS. 26A-26H illustrate how the components of the conversion assembly 800 cooperate to change the effective length of the linkage 820 during the sealing cycle. At the start of the sealing cycle, the drive wheel 810 and the foot of the linkage 820 are at their respective home positions and the effective length of the linkage 820 is DMIN, as shown in FIG. 26A. The drive wheel 810 begins rotating from its home position to its sealing position, carrying the linkage 820 with it. As shown in FIG. 26B, this brings the second support engager 839 into contact with the second linkage engager 394. Continued rotation of the drive wheel 810 causes the first link 830 to rotate counter-clockwise (from the viewpoint shown in FIGS. 26A-26H) relative to the drive wheel 810 and the second link 840, which causes the effective length of the linkage 820 to increase to its maximum DMAX as shown in FIGS. 26C-26E. As shown in FIG. 26E, just as the effective length of the linkage 820 reaches its maximum DMAX, the stop fingers 838 of the first link engage the stop surfaces 848*a* of the stop element 848 of the second link 848, which prevents further rotation of the first link 830 relative to the second link 840, and the second support engager 839 disengages the second linkage engager 394. In this example embodiment, the sealing assembly 500 reaches its sealing position and the jaws begin moving from their home positions to their sealing positions before the effective length of the linkage 820 reaches its maximum DMAX.

Figure 26G:
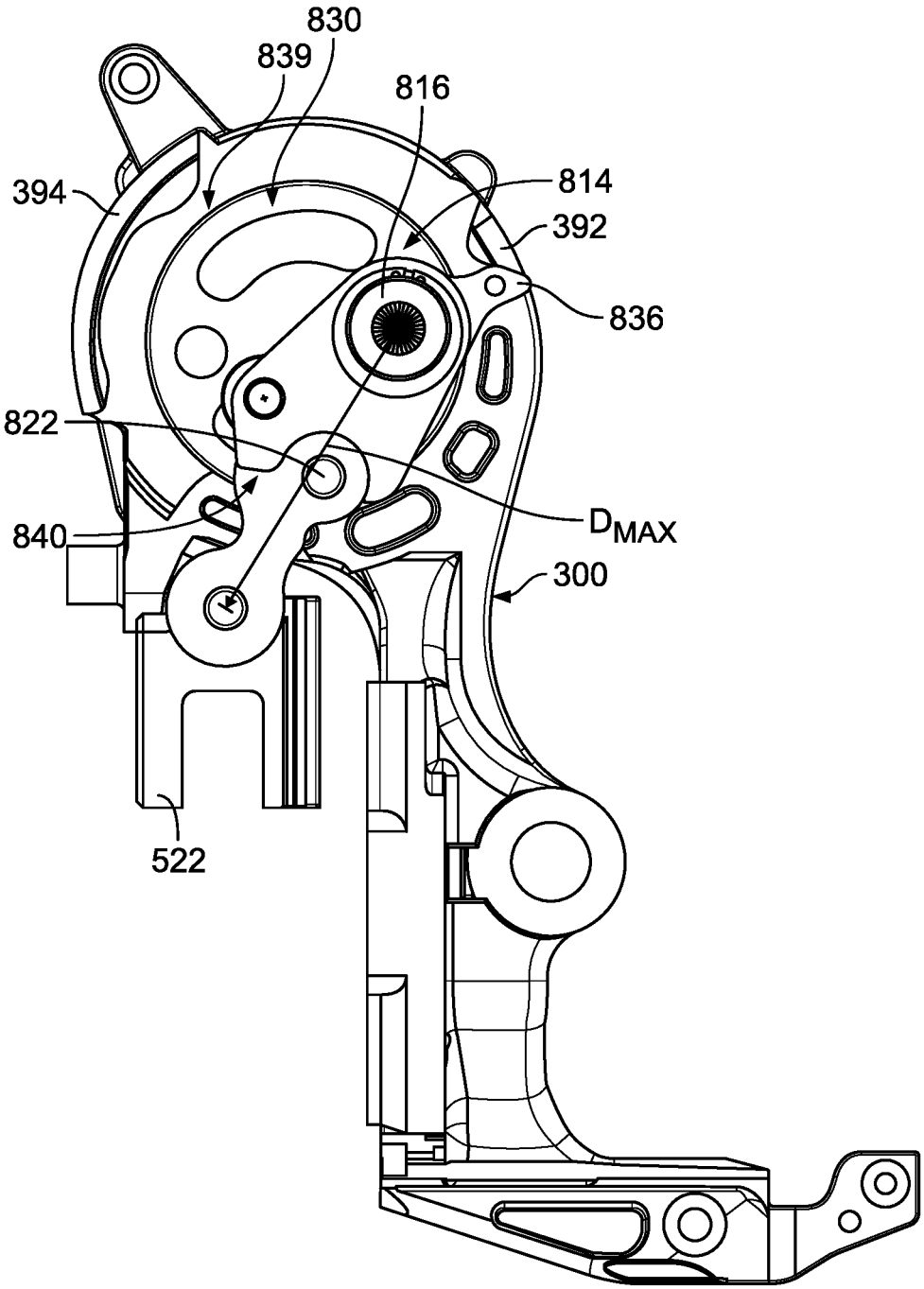
Figure 26H:
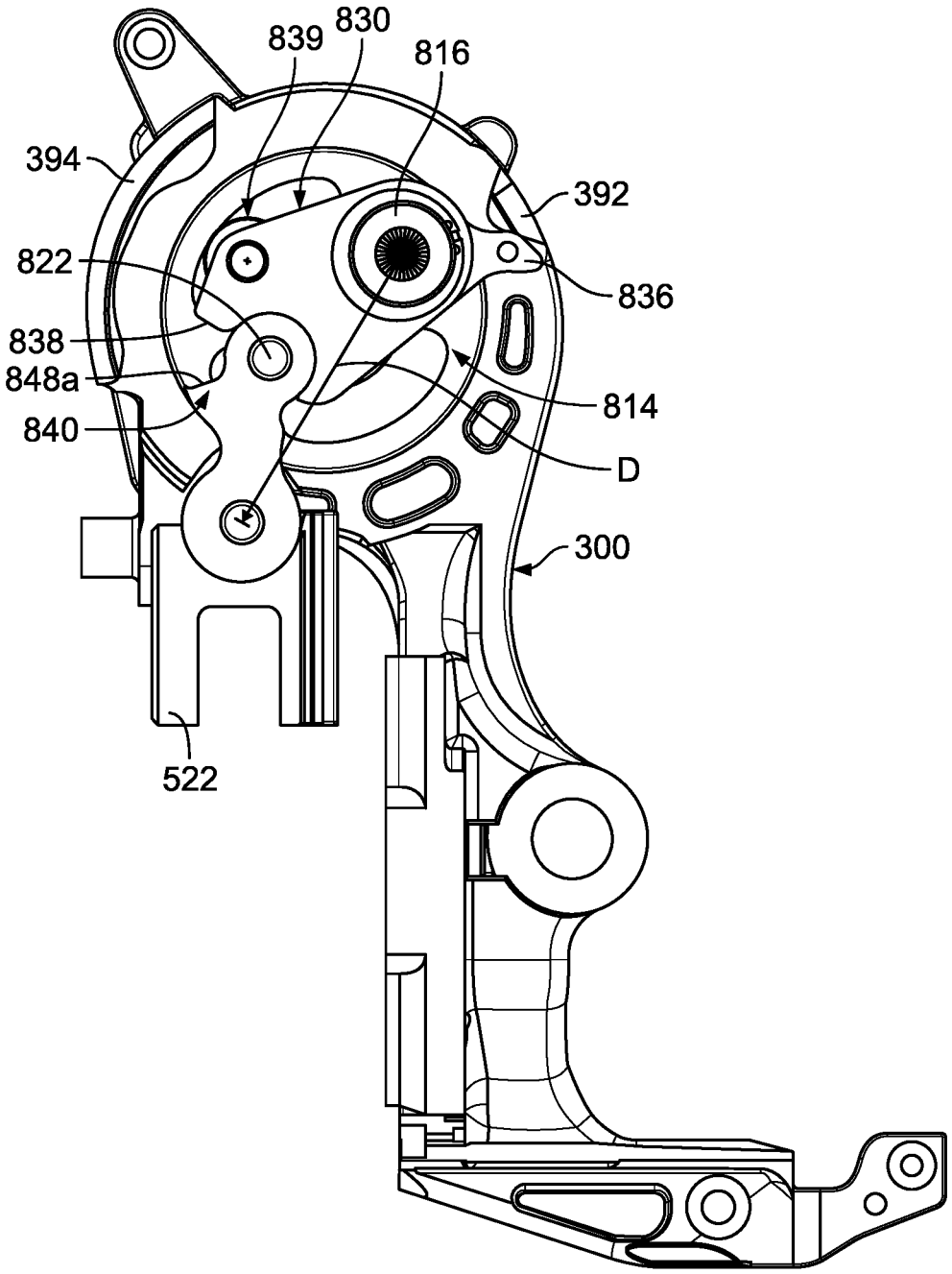

After the effective length of the linkage 820 reaches DMAX, as the drive wheel 810 continues to rotate toward its sealing position, the linkage 820 maintains its effective length as the jaws continue moving from their home positions to their sealing positions. In this example embodiment, the jaws begin to contact the seal element (as described in detail below) just as the effective length of the linkage 820 reaches its maximum DMAX. FIG. 26F shows the drive wheel 810 at its sealing position, at which point the jaws have also reached their sealing positions and notched the seal element and the strap. Afterwards, continued rotation of the drive wheel 810 brings the first support engager 836 into contact with the first linkage engager 392 of the base 300, as shown in FIG. 26G. As the drive wheel 810 continues to rotate back to its home position, the engagement between the first support engager 836 and the first linkage engager 392 causes the first link 830 to rotate clockwise relative to the drive wheel 810 and the second link 140. As shown in FIG. 26H, this relative rotation of the first link 830 causes the effective length of the linkage 820 to decrease from DMAX to DMIN by the time the drive wheel 810 reaches its home position. In this example embodiment, the sealing assembly 500 reaches its home position just as the effective length of the linkage 820 reaches its minimum DMIN.

The timing of movement of the sealing assembly 500 and the jaws relative to the rotation of the drive wheel 810 and the changing effective length of the linkage 820 may differ in other embodiments. For instance, in another embodiment, the sealing assembly 500 reaches its sealing position just as the effective length of the linkage 820 reaches its maximum DMAX, after which point the jaws begin moving to their sealing positions.

Varying the effective length of the linkage during the sealing cycle provides several benefits compared to prior art tools with linkages having a fixed effective length. Since the sealing assembly reaches its sealing position shortly after the start of the sealing cycle, more of the travel of the linkage-driveshaft as the drive wheel rotates from its home position to its sealing position is used to cut the notches in the seal element and the strap (as compared to prior art tools). This means that less force is required to cut the notches. In turn, the components of the jaw assembly—such as the jaws, gears, links, and the like—are lighter (and in some instances smaller) than those of prior art tools, rendering this tool lighter (and in some instances more compact) and therefore easier to handle. Since less force is required to cut the notches, the amount of torque the motor must provide is less than in prior art tools, meaning that the motor draws less current than in prior art tools and is more efficient. And this also allows the motor to run faster and therefore increase the speed of the sealing cycle as compared to prior art tools.

The display assembly 1300 includes a suitable display screen 1310 with a touch panel 1320. The display screen 1310 is configured to display information regarding the strapping tool (at least in this embodiment), and the touch screen 1320 is configured to receive operator inputs such as a desired strap tension, desired weld cooling time, and the like as is known in the art. A display controller (not shown) may control the display screen 1310 and the touch panel 1320 and, in these embodiments, is communicatively connected to the controller 1300 to send signals to the controller 1300 and to receive signals from the controller 1300. Other embodiments of the strapping tool do not include a touch panel. Still other embodiments of the strapping tool do not include a display assembly.

The actuating assembly 1400 is configured to receive operator input to start operation of the tensioning and sealing cycles. In this example embodiment, the actuating assembly 1400 includes first and second pushbutton actuators 1410 and 1420 that, depending on the operating mode of the strapping tool 50, initiate the tensioning and/or sealing cycles as described below. Other embodiments of the strapping tool 50 do not have an actuating assembly 1400 and instead incorporate its functionality into the display assembly 1300. For instance, in one of these embodiments two areas of the touch panel define virtual buttons that have the same functionality as mechanical pushbutton actuators.

The controller 1600 includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping tool 50. The controller 1600 is communicatively and operably connected to the motor 710, the display assembly 1300, the actuating assembly 1400, and the sensor(s) 1700 and configured to receive signals from and to control those components. The controller 1600 may also be communicatively connectable (such as via WiFi, Bluetooth, near-field communication, or other suitable wireless communications protocol) to an external device, such as a computing device, to send information to and receive information from that external device.

The controller 1600 is configured to operate the strapping tool in one of three operating modes: (1) a manual operating mode; (2) a semi-automatic operating mode; and (3) an automatic operating mode. In the manual operating mode, the controller 1600 operates the motor 710 to cause the tension wheel 440 to rotate responsive to the first pushbutton actuator 1410 being actuated and maintained in its actuated state. The controller 1600 operates the motor 710 to cause the sealing assembly 500 to carry out the sealing cycle responsive to the second pushbutton actuator 1420 being actuated. In the semi-automatic operating mode, the controller 1600 operates the motor 710 to cause the tension wheel 440 to rotate responsive to the first pushbutton actuator 1410 being actuated and maintained in its actuated state. Once the controller 1600 determines that the tension in the strap reaches the (preset) desired strap tension, the controller 1600 automatically operates the motor to cause the sealing assembly 500 to carry out the sealing cycle (without requiring additional input from the operator). In the automatic operating mode, the controller 1600 operates the motor 710 to cause the tension wheel 440 to rotate responsive to the first pushbutton actuator 1410 being actuated. Once the controller 1600 determines that the tension in the strap reaches the (preset) desired strap tension, the controller 1600 automatically operates the motor to cause the sealing assembly 500 to carry out the sealing cycle (without requiring additional input from the operator).

The power supply 1500 is electrically connected to (via suitable wiring and other components) and configured to power several components of the strapping tool 50, including the motor 710, the display assembly 1300, the actuating assembly 1400, the controller 1600, and the sensor(s) 1700. The power supply 1500 is a rechargeable battery (such as a lithium-ion or nickel cadmium battery) in this example embodiment, though it may be any other suitable electric power supply in other embodiments. The power supply 1500 is sized, shaped, and otherwise configured to be received in a receptacle (not labeled) defined by the housing 100. The strapping tool 50 includes one or more battery-securing devices (not shown) to releasably lock the power supply 1500 in place upon receipt in the receptacle. Actuation of a release device of the strapping tool 50 or the power supply 1500 unlocks the power supply 1500 from the housing 100 and enables an operator to remove the power supply 1500 from the housing 100.

Use of the strapping tool 50 to carry out a strapping cycle including: (1) a tensioning cycle in which the strapping tool 50 tensions a strap S around a load L; and (2) a sealing cycle in which the strapping tool 50 notches both a seal element SE positioned around overlapping top and bottom portions of the strap S and the top and bottom portions of the straps themselves and cuts the strap from the strap supply is described in accordance with FIGS. 28A-28C. Initially: the tensioning assembly 400 is in its strap-insertion position (held there by the retainer 1810); the sealing assembly 500 is in its home position; the jaws are in their respective home positions; the object blocker 605 is in its retracted position;

the drive wheel 810 is in its home position; the rocker lever 910 is in its actuated position; and the gate 1010 is in its strap-insertion position. The strapping tool 50 is in the automatic mode for the purposes of this example.

Figure 27:
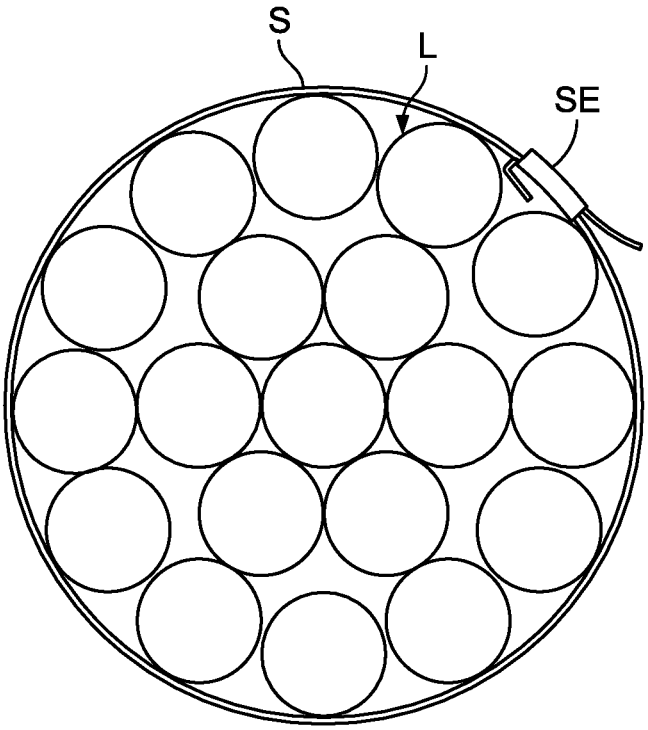
FIG. 27 is a diagrammatic elevational view of the strap and the seal element positioned around a load before being tensioned and sealed by the strapping tool.

The operator pulls the strap S leading-end first from a strap supply (not shown) and threads the leading end of the strap S through the seal element SE. While holding the seal element SE, the operator wraps the strap around the load L and positions the leading end of the strap S below another portion of the strap S, and again threads the leading end of the strap S through the seal element SE. Afterwards, the seal element SE is positioned around overlapping top and bottom portions of the strap S. The operator then bends the leading end of the strap S backward and slides the seal element SE along the strap S until it meets the bend. FIG. 27 shows the position of the bend and the seal element SE at this point.

The operator then introduces the top portion of the strap S rearward of the seal element SE into the strap-receiving opening so the top portion of the strap S is between the tension wheel 440 and the roller 380 of the foot 320 of the support 300. The operator then manually pulls the strap S to eliminate the slack and pushes the strapping tool 50 toward the seal element SE until the seal element SE engages the gate 1010 and is trapped between the bend in the bottom portion of the strap S and the gate 1010. As shown in FIG. 28A, at this point the seal element SE is below the object blocker 605.

The operator then actuates the first pushbutton actuator 1410 to initiate the strapping cycle. In response the controller 1600 starts the tensioning cycle by controlling the motor 710 to begin rotating the motor output shaft 712 in the first rotational direction, which causes the tension-wheel shaft 428*b* and tension wheel 440 thereon to begin rotating. Rotation of the tension-wheel shaft 428*b* forces the retainer 1810 to rotate to its release position. As this occurs, the tensioning-assembly-biasing element forces the tensioning assembly 400 to its strap-tensioning position. This causes the tension wheel 440 to engage the top portion of the strap S and pinch it against the roller 380. At this point the bottom portion of the strap S is beneath the foot 320. Movement of the tensioning assembly 400 back to the strap-tensioning position causes the gate 1010 to return to its home position in which the gate 1010 barely contacts or is just above the top portion of the strap.

As the tension wheel 440 rotates, it pulls on the top portion of the strap S, thereby tensioning the strap S around the load L. Throughout the tensioning cycle, the controller 1600 monitors the current drawn by the motor 710. When this current reaches a preset value that is correlated with the (preset) desired strap tension for this strapping cycle, the controller 1600 stops the motor 710, thereby terminating the tensioning cycle.

Figure 29:
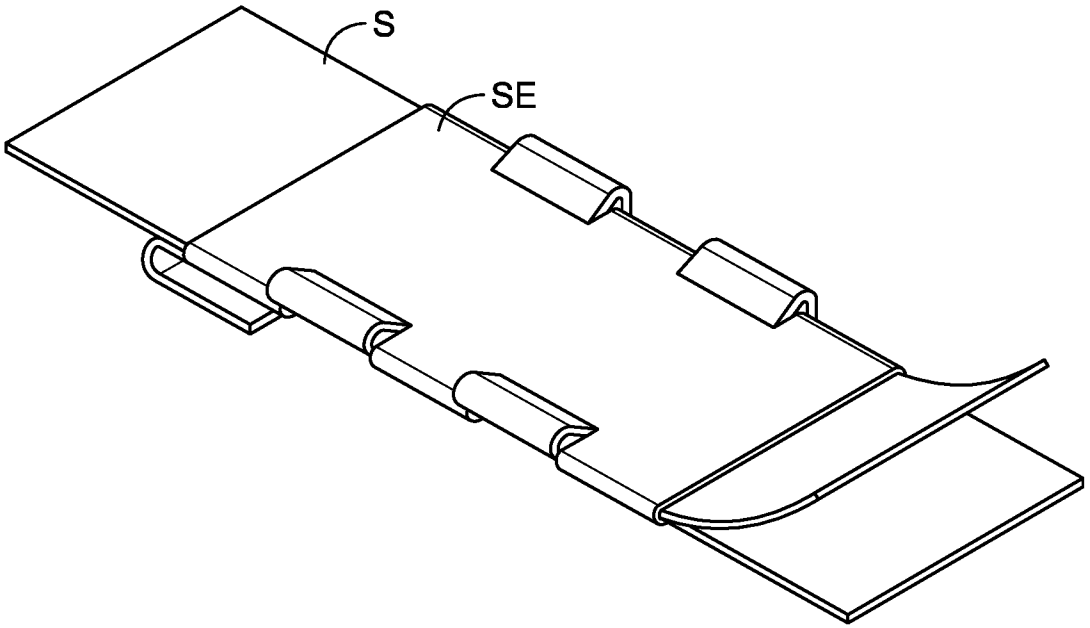
FIG. 29 is a perspective view of the notched seal element.

The controller 1600 then automatically starts the sealing cycle by controlling the motor 710 to begin rotating the motor output shaft 712 in the second rotational direction. As described in detail above, this causes the sealing assembly 500 to move to its sealing position. As the sealing assembly 500 moves to its sealing position, the object-blocker-lift element 630 frees the object blocker 605 to move toward its blocking position. The object blocker 605 contacts the seal element SE and is forced to remain in place by the seal element SE, as shown in FIG. 28B. The sealing assembly 500 is positioned relative to the seal element SE so the seal element SE is within the seal-element-receiving space of the sealing assembly 500 when in its sealing position. After the sealing assembly 500 reaches its sealing position, the jaws: (1) pivot from their respective home positions to their respective sealing positions to cut notches in the seal element SE and the top and bottom portions of the strap S within the seal element SE, as shown in FIG. 28C; and then (2) pivot from their respective sealing positions back to their respective home positions to enable the strapping tool 50 to be removed from the strap S. FIG. 29 shows the notched seal element SE and strap S.

Although the sealing assembly comprises jaws configured to cut into seal elements to attach two portions of the strap to itself, the sealing assembly may comprise other sealing mechanisms in other embodiments, such as a friction-welding assembly or a sealless-attachment assembly.

Other embodiments of the strapping tool may include fewer assemblies, components, and/or features than those included in the strapping tool 50 described above and shown in the Figures. For instance, other strapping tools may include fewer than all of (including only one of) and any combination of two or more of the conversion assembly, the object-blocking assembly, the retaining assembly, the retainer-activation assembly, the intermediary gearing, the double-pivoting rocker lever, the rocker lever with blocking finger, the decoupling assembly, jaw connectors with offset support surfaces, and the gate assembly. In other words, while the particular example strapping tool 50 described above includes all of these assemblies, components, and features, they are independent of one another and may be included in other strapping tools either alone or in any combination of two or more.

Various embodiments of the strapping tool comprise: a support comprising a foot; a tensioning assembly mounted to the support and pivotable relative to the foot of the support about a tensioning-assembly-pivot axis between a strap-tensioning position and a strap-insertion position, the tensioning assembly comprising a rotatable tension-wheel shaft, a tension wheel mounted to the tension-wheel shaft to rotate with the tension-wheel shaft, and tensioning-assembly gearing operably connected to the tension-wheel shaft to rotate the tension wheel about a tension-wheel rotational axis that is spaced-apart from the tensioning-assembly-pivot axis; intermediary gearing rotatable about the tensioning-assembly-pivot axis and operably connected to the tensioning-assembly gearing to drive the tensioning-assembly gearing; a rocker lever mounted to the tensioning assembly and pivotable relative to the tensioning assembly and about a rocker-lever pivot axis between a home position and an intermediate position, wherein the tensioning-assembly pivot axis is different from the rocker-lever pivot axis, wherein the rocker lever is pivotable relative to the support and about the tensioning-assembly pivot axis from the intermediate position to an actuated position to move the tensioning assembly from the strap-tensioning position to the strap-insertion position, wherein the rocker lever comprises blocking means for preventing the tensioning assembly from moving from the strap-tensioning position to the strap-insertion position when the rocker lever is in the home position; decoupling means for enabling the tension wheel to rotate about the tension-wheel rotational axis in a direction opposite a tensioning rotational direction, wherein the rocker lever is operably connected to the decoupling assembly to actuate the decoupling means when pivoted from the home position to the intermediate position; a sealing assembly mounted to the support and movable relative to the support between a sealing assembly home position and a sealing assembly sealing position, the sealing assembly comprising: spaced-apart first and second jaw connectors comprising first and second support surfaces, respectively; a central jaw connector positioned between the first and second jaw connectors and comprising a central support surface; a first pair of jaws between the first and central jaw connectors and comprising opposing first and second jaws pivotable between respective jaw home positions and jaw sealing positions; a second pair of jaws between the central and second jaw connectors and comprising opposing third and fourth jaws pivotable between respective jaw home positions and jaw sealing positions; wherein a strap path is defined between the first and second jaws and the third and fourth jaws and beneath the first, second, and central support surfaces, wherein the central support surface is closer to the strap path than the first and second support surfaces; a conversion assembly comprising a linkage operably connected to the sealing assembly and configured to move the sealing assembly from the sealing assembly home position to the sealing assembly sealing position and the jaws from their respective jaw home positions to their respective jaw sealing positions, the linkage comprising means for changing an effective length of the linkage while moving the sealing assembly from the sealing assembly home position to the sealing assembly sealing position; drive means for driving the intermediary gearing and the conversion assembly; retaining means for retaining the tensioning assembly in the strap-insertion position; deactivating means for preventing the retaining means from retaining the tensioning assembly in the strap-insertion position.

Various embodiments of the strapping tool comprise: a support comprising a foot; a housing comprising a handle and defining a blocking-finger opening, the housing at least partially enclosing the support; a tensioning assembly mounted to the support and pivotable relative to the foot of the support about a tensioning-assembly-pivot axis between a strap-tensioning position and a strap-insertion position, the tensioning assembly comprising a rotatable tension-wheel shaft, a tension wheel mounted to the tension-wheel shaft to rotate with the tension-wheel shaft, and tensioning-assembly gearing operably connected to the tension-wheel shaft to rotate the tension wheel about a tension-wheel rotational axis that is spaced-apart from the tensioning-assembly-pivot axis; intermediary gearing rotatable about the tensioning-assembly-pivot axis and operably connected to the tensioning-assembly gearing to drive the tensioning-assembly gearing; a rocker lever mounted to the tensioning assembly and pivotable relative to the tensioning assembly and about a rocker-lever pivot axis between a home position and an intermediate position, wherein the tensioning-assembly pivot axis is different from the rocker-lever pivot axis, wherein the rocker lever is pivotable relative to the support and about the tensioning-assembly pivot axis from the intermediate position to an actuated position to move the tensioning assembly from the strap-tensioning position to the strap-insertion position, wherein the rocker lever comprises a blocking finger positioned and oriented such that movement of the rocker lever from the home position to the intermediate position causes the blocking finger to pass through the blocking-finger opening and into the housing, and the blocking finger prevents the tensioning assembly from moving from the strap-tensioning position to the strap-insertion position when the rocker lever is in the home position; a decoupling assembly actuatable to enable the tension wheel to rotate about the tension-wheel rotational axis in a direction opposite a tensioning rotational direction, wherein the rocker lever is operably connected to the decoupling assembly to actuate the decoupling assembly when pivoted from the home position to the intermediate position; a sealing assembly mounted to the support and movable relative to the support between a sealing assembly home position and a sealing assembly sealing position, the sealing assembly comprising: spaced-apart first and second jaw connectors comprising first and second support surfaces, respectively; a central jaw connector positioned between the first and second jaw connectors and comprising a central support surface; a first pair of jaws between the first and central jaw connectors and comprising opposing first and second jaws pivotable between respective jaw home positions and jaw sealing positions; a second pair of jaws between the central and second jaw connectors and comprising opposing third and fourth jaws pivotable between respective jaw home positions and jaw sealing positions; wherein a strap path is defined between the first and second jaws and the third and fourth jaws and beneath the first, second, and central support surfaces, wherein the central support surface is closer to the strap path than the first and second support surfaces; a conversion assembly comprising a linkage comprising a first link and a second link connected to one another, wherein the linkage is operably connected to the sealing assembly and configured to move the sealing assembly from the sealing assembly home position to the sealing assembly sealing position and the jaws from their respective jaw home positions to their respective jaw sealing positions, wherein the first and second links are configured to move relative to one another to change an effective length of the linkage while moving the sealing assembly from the sealing assembly home position to the sealing assembly sealing position; a drive assembly comprising a motor operably connected to the intermediary gearing to rotate the intermediary gearing about the tensioning-assembly pivot axis in the tensioning rotational direction and operably connected to the conversion assembly and configured to drive the linkage; a retainer comprising a body having a tension-wheel-shaft engager, wherein the retainer is movable relative to the tension-wheel shaft between a release position and a retaining position; a retainer-biasing element biasing the retainer to the retaining position; and a retainer engager movable relative to the retainer between an activated position and a deactivated position, wherein when the tensioning assembly is in the strap-insertion position and the retainer is in the retaining position, the tension-wheel-shaft engager of the retainer engages the tension-wheel shaft of the tensioning assembly to retain the tensioning assembly in the strap-insertion position, wherein when the retainer engager is in the deactivated position, the retainer engager prevents the retainer from moving to the retaining position, wherein when the retainer engager is in the activated position, the retainer engager enables the retainer to move to the retaining position.

What is claimed is:

1. A strapping tool comprising:

a support;

a sealing assembly mounted to the support and comprising a connector and multiple jaws pivotably connected to the connector such that the jaws are pivotable movable from respective jaw home positions to respective jaw sealing positions, wherein the sealing assembly including the connector and the jaws is movable up and down relative to the support between a sealing assembly home position and a sealing assembly sealing position, and wherein at least part of the connector extends between the jaws;

a conversion assembly comprising a linkage comprising a first link and a second link connected to one another;

wherein the linkage is operably connected to the sealing assembly and configured to move the sealing assembly from the sealing assembly home position to the sealing assembly sealing position and, in addition, to move the jaws from their respective jaw home positions to their respective jaw sealing positions, wherein the first and second links are configured to move relative to one another to change an effective length of the linkage while moving the sealing assembly from the sealing assembly home position to the sealing assembly sealing position; and a drive assembly operably connected to the conversion assembly and configured to drive the linkage.

2. The strapping tool of claim 1, wherein the conversion assembly further comprises a drive wheel comprising a driveshaft radially spaced from a rotational axis of the drive wheel, wherein the drive assembly is operably connected to the drive wheel and configured to rotate the drive wheel, wherein the first link of the linkage is mounted to the driveshaft and pivotable about the driveshaft.

3. The strapping tool of claim 2, wherein the second link is operably connected to the sealing assembly.

4. The strapping tool of claim 3, wherein the effective length of the linkage is a minimum effective length when the first and second links are in a first orientation relative to one another and is a maximum effective length when the first and second links are in a second, different orientation relative to one another.

5. The strapping tool of claim 4, wherein a first angle is defined between the first and second links when in the first orientation and a second, greater angle is defined between the first and second links when in the second orientation.

6. The strapping tool of claim 5, wherein the conversion assembly is mounted to the support, wherein the support comprises a first linkage engager and a second linkage engager, wherein the linkage further comprises a first support engager and a second support engager.

7. The strapping tool of claim 6, wherein the first and second linkage engagers are positioned such that, as the drive wheel rotates from a drive wheel home position toward a drive wheel sealing position, the second support engager engages the second linkage engager and continued rotation of the drive wheel toward the drive wheel sealing position causes the first link to pivot about the driveshaft and relative to the second link to increase the effective length of the linkage.

8. The strapping tool of claim 7, wherein the first and second links are in the first orientation when the drive wheel is in the drive wheel home position and in the second orientation when the drive wheel is in the drive wheel sealing position.

9. The strapping tool of claim 7, wherein the first and second linkage engagers are positioned such that, as the drive wheel rotates from the drive wheel sealing position toward the drive wheel home position, the first support engager engages the first linkage engager and continued rotation of the drive wheel causes the first link to pivot about the driveshaft and relative to the second link to decrease the effective length of the linkage.

10. The strapping tool of claim 9, wherein the sealing assembly is in the sealing assembly home position and the jaws are in the jaw home positions when the effective length of the linkage is the minimum effective length.

11. The strapping tool of claim 10, wherein when the sealing assembly is in the sealing assembly sealing position and the jaws are in the jaw sealing positions, the effective length of the linkage is the maximum effective length.

12. The strapping tool of claim 11, wherein the first link further comprises a stop finger, wherein the second link further comprises a stop element comprising a stop surface, wherein the stop finger engages the stop surface when the effective length of the linkage is the maximum effective length.

13. The strapping tool of claim 12, wherein the second support engager disengages the second linkage engager as the effective length of the linkage reaches the maximum effective length.

14. The strapping tool of claim 13, wherein the first and second links are in the first orientation when the drive wheel is in the drive wheel home position and in the second orientation when the drive wheel is in the drive wheel sealing position.

15. The strapping tool of claim 1, wherein the second link comprises a foot of the linkage that is coupled to the sealing assembly, wherein the effective length of the linkage comprises a distance between the driveshaft of the drive wheel and the foot of the linkage.

* * * * *